US007914977B2

(12) United States Patent
Sakai et al.

(10) Patent No.: US 7,914,977 B2
(45) Date of Patent: Mar. 29, 2011

(54) SILVER HALIDE COLOR PHOTOSENSITIVE MATERIAL AND METHOD OF PROCESSING THE SAME

(75) Inventors: Hidekazu Sakai, Kanagawa (JP); Tatsuya Ishizaka, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 161 days.

(21) Appl. No.: 11/664,104

(22) PCT Filed: Sep. 28, 2005

(86) PCT No.: PCT/JP2005/018390

§ 371 (c)(1), (2), (4) Date: Mar. 29, 2007

(87) PCT Pub. No.: WO2006/035996

PCT Pub. Date: Apr. 6, 2006

(65) Prior Publication Data

US 2008/0286702 A1 Nov. 20, 2008

(30) Foreign Application Priority Data

Sep. 29, 2004 (JP) ..... 2004-284124
Sep. 29, 2004 (JP) ..... 2004-284136
Sep. 29, 2004 (JP) ..... 2004-285290

(51) Int. Cl.

| | |
|---|---|
| ***G03C 1/005*** | (2006.01) |
| ***G03C 1/494*** | (2006.01) |
| ***G03C 1/46*** | (2006.01) |
| ***G03C 1/06*** | (2006.01) |
| ***G03C 1/08*** | (2006.01) |

(52) U.S. Cl. ..... 430/567; 430/502; 430/503; 430/504; 430/505; 430/506; 430/543; 430/559; 430/944; 430/604; 430/346

(58) Field of Classification Search ..... 430/502–506, 430/543, 559, 944, 604, 346, 567
See application file for complete search history.

(56) References Cited

U.S. PATENT DOCUMENTS

| | | | | |
|---|---|---|---|---|
| 2,266,452 | A | 12/1941 | Vittum et al. | |
| 3,458,315 | A | 7/1969 | Loria | |
| 3,705,208 | A | 12/1972 | Nakamuta et al. | |
| 3,705,799 | A | 12/1972 | Bello et al. | |
| 3,705,800 | A | 12/1972 | Lane | |
| 3,705,801 | A | 12/1972 | Holtz | |
| 3,705,802 | A | 12/1972 | Baptista | |
| 3,705,803 | A | 12/1972 | Bevis et al. | |
| 3,737,312 | A | 6/1973 | Baptista et al. | |
| 3,749,572 | A | 7/1973 | Willis et al. | |
| 3,940,271 | A | 2/1976 | Kawai et al. | |
| 4,208,210 | A | 6/1980 | Sakai et al. | |
| 4,216,284 | A | 8/1980 | Sakai et al. | |
| 4,250,251 | A | 2/1981 | Osborn et al. | |
| 4,269,923 | A | 5/1981 | Roosen et al. | |
| 4,839,267 | A | 6/1989 | Monbaliu et al. | |
| 5,030,544 | A | 7/1991 | Olbrechts et al. | |
| 5,639,585 | A | 6/1997 | Callahan, Jr. et al. | |
| 6,180,312 | B1 | 1/2001 | Edwards | |
| 6,521,395 | B1 * | 2/2003 | Begley et al. | 430/384 |
| 6,660,463 | B2 | 12/2003 | Noguchi et al. | |
| 6,780,575 | B2 * | 8/2004 | Szajewski | 430/503 |
| 2003/0203326 | A1 | 10/2003 | Takada et al. | |
| 2004/0023170 | A1 | 2/2004 | Sakai et al. | |

FOREIGN PATENT DOCUMENTS

| | | | |
|---|---|---|---|
| EP | 0 268 704 | A1 | 6/1988 |
| EP | 0 779 542 | A2 | 6/1997 |
| EP | 1 136 883 | A2 | 9/2001 |
| EP | 1 205 794 | A2 | 5/2002 |
| JP | 49-103629 | | 10/1974 |
| JP | 51-77334 | | 7/1976 |
| JP | 51-151134 | | 12/1976 |
| JP | 53-125836 | | 11/1978 |
| JP | 55-110242 | | 8/1980 |
| JP | 63-143546 | | 6/1988 |
| JP | 10-333295 | | 12/1998 |
| JP | 10-333295 | A | 12/1998 |
| JP | 11-282106 | | 10/1999 |
| JP | 2001-281782 | | 10/2001 |
| JP | 2001-281782 | A | 10/2001 |
| JP | 2003-228155 | | 8/2003 |
| JP | 2003-307801 | | 10/2003 |
| JP | 2003-307801 | A | 10/2003 |

* cited by examiner

*Primary Examiner* — Geraldina Visconti

(74) *Attorney, Agent, or Firm* — Sughrue Mion, PLLC

(57) ABSTRACT

A silver halide color photosensitive material, having, on a transparent support, at least one each of yellow-, cyan-, and magenta-color-forming photosensitive silver halide emulsion layers, and photosensitive silver halide emulsion layer containing a coupler that forms a dye having its absorption maximum at a wavelength longer than 730 nm upon reaction with an oxidized product of a developing agent, wherein the yellow-color-forming photosensitive silver halide emulsion layer contains photosensitive silver halide grains having an average grain size of 0.4 μm or below and a silver chloride content of 95 mole % or above based on total silver in the grains, and wherein the photosensitive silver halide grains include photosensitive silver halide grains whose iodide ion concentrations have their maxima at grain surfaces and decrease gradually toward the interior of the grains;

and a method of processing a silver halide color photosensitive material for use in film screening.

12 Claims, No Drawings

SILVER HALIDE COLOR PHOTOSENSITIVE MATERIAL AND METHOD OF PROCESSING THE SAME

TECHNICAL FIELD

The present invention relates to a silver halide color photosensitive material; more specifically to a silver halide color cinematographic photosensitive material having suitability for processing expedited substantially by simplification and time-reduction of processing steps.

The present invention also relates to a silver halide color photosensitive material that can be processed in simplified and shortened exposure and processing processes, and to a processing method thereof. More specifically, the present invention concerns a silver halide color cinematographic photosensitive material, and a processing method thereof.

BACKGROUND ART

In the music industry, media for sound recording were changed from records to CDs, and analog recording was abruptly changed to digital recording in the 1980s. Further, large-capacity DVDs as media for recording information including video images have also been penetrating the market. Dramatic improvements in storage capacity have also been achieved in the field of magnetic recording materials, typified by cassette tapes, by adopting a vertical magnetic recording system, or by developing magneto-optic recording media; as a result, random access has become feasible. In the field of motion pictures, an analog soundtrack has been used as a sound-recording system since the invention of talk-type film (talkie) by De Forest et al. in the U.S. in the 1920s. As to sound-recording in the motion picture industry, a noise reduction system was developed and released by Dolby Laboratories, Inc., and high-quality analog audio recordings are produced at present. In addition, from the second half of the 1980s to the first half of the 1990s, several formats for digitizing motion picture sound, including the Dolby Stereo SR-D system by Dolby Laboratories, Inc., and the SDDS system by Sony Corporation, were released, and the number of film screenings with digital sound has been growing. However, the formats permitting the use of both analog sound and digital sound have been adopted, up to the present, as insurance against reproduction failure by accidental impairments of digital recording information, so at present, analog sound is used for audio recording in almost all motion pictures.

In the method of reading information from such an analog soundtrack, information on light signals modulated by transmission through the area-modulated analog soundtrack region is detected as sound information with a phototube having high sensitivity in the infrared region of 750 nm to 850 nm, or with a recent silicon-type photodiode having its absorption maximum in the region of 900 mm, and the optical signals detected are converted into electrical signals and reproduced as sound information for film screening. Since the detection wavelength is in the infrared region, the sound information is required to be recorded as silver images on an analog soundtrack, and even today's colorized motion picture films retain silver images on their individual analog soundtracks. In processing motion picture films, therefore, a special processing step for forming silver images, by applying a silver developer to the analog soundtrack regions alone, is still carried out after the process steps for processing the image regions. Such elaborate, troublesome processing is a considerable burden for processing laboratories.

Against this backdrop, the dye track system, in which sound information is recorded as developed cyan dye, but not developed silver, on an analog soundtrack, by use of a red LED as an exciter, was presented at the SMPTE Technical Conference and World Media Expo held in October 1996. This report described a soundtrack reading mechanism that used a red LED illumination source, and thereby made it possible to eliminate the need for the aforementioned special processing step for forming silver images through application of a developer. Up to the present, red LED analog readers have been aggressively sold. However, as is the case with digital formats, it is necessary to address a requirement that equipment, including red LEDs and electrical signal amplifiers to amplify sound that is converted into electronic signal, must be provided for projectors installed in individual theaters. Despite the necessity, the provision of such equipment in all theaters is making slow progress. With consideration given to theaters into which the equipment has not yet been introduced, a temporary changeover to a high-magenta soundtrack capable of sharing a sound negative with a cyan dye track is recommended and regarded as a preliminary stage of the changeover to cyan dye sound, and thus a silver-retaining processing (i.e. a processing to form silver soundtrack) is carried out even now.

With the intention to achieve simple processing of motion picture films in processing laboratories without requiring the introduction of equipment into theaters and enabling omission of the development of analog soundtracks by application of a developer thereto (hereinafter also referred to as "the application development of soundtracks"), arts of recording analog sound information with couplers capable of forming infrared-absorbing-dyes are disclosed in JP-A-63-143546 ("JP-A" means unexamined published Japanese patent application), JP-A-11-282106, JP-A-2003-228155, and U.S. Pat. No. 5,034,544. In addition, arts of enabling retention of sound information as silver images in a soundtrack region by incorporation of bleach inhibitors or bleach inhibitor-releasing couplers, thereby omitting the application development of soundtracks, are disclosed in U.S. Pat. Nos. 3,705,208, 3,705,799, 3,705,800, 3,705,801, 3,705,802, 3,705,803, 3,737,312, and 3,749,572, and in JP-A-49-103629, JP-A-51-077334, JP-A-51-151134, JP-A-53-125836, and JP-A-55-110242. These arts are very excellent arts for simplification of processing.

On the other hand, cinematographic positive films for screening, though they vary from theater to theater, are prepared in very large quantities by a processing laboratory and sent out to respective theaters, so it is required that the processing of motion picture films in a processing laboratory be performed not only in a simplified process but also in very large quantities within a short time period. Accordingly, in addition to the aforementioned arts of simplifying the processing process, there is a further need to develop the art of reducing the time for preparation of enormous numbers of motion picture films, by increasing hourly film production through reduction in the exposure and processing time of the films. To increase hourly film production, it is required that the linear speed in each processing step be improved, in addition to elimination of the need for the application development of analog soundtracks. In addition to the application development of analog soundtracks, the development process of positive cinematographic photosensitive materials is also a rate-determining step for the increase in processing speed, so improvements therein have been expected.

Cinematography, which is an application of silver halide photography, is a method of obtaining moving images by sequential 24-sheets-per-second projection of elaborate still images, and cinematography delivers overwhelmingly high-quality images, compared with other methods for reproducing moving images. By utilizing the high quality of cinematographic images as an asset, the images can be easily projected on a giant screen. As such, these moving images are suitable for simultaneous viewing by a large number of people. Under these circumstances, numerous theaters having motion picture projecting apparatus and large seating capacity have been built. On the other hand, explosive developments of electronic technology and information processing technology in recent years have enabled the advent of projectors using DMD devices of Texas Instrument Incorporated, D-ILA devices of Hughes-JVC Technology Corp., or high-definition liquid crystal devices of Sony Corporation, to provide more convenient tools for reproducing moving images of near-motion-picture quality. Therefore, it is also required that convenience and facilitation, especially simplification and time-reduction of operations in photo laboratories, be conferred upon motion picture films while maintaining their high image qualities.

As one factor responsible for the complexity and difficulty of developing operations of silver halide photosensitive materials for use in motion-picture projection (screening), the presence of development for sound can be cited.

In motion pictures, imagery and sound are required to be in synchrony. Since the invention of the motion picture, various attempts to accompany pictures with sound have been made. Study was especially made to combine motion pictures with the analog recording technology invented as a sound recording-and-reproduction method at the same period, but techniques in those days failed to provide satisfactory synchronization. As such, this combination has not been brought to commercialization. To achieve synchronization with simplicity and reliability, ideally, image information and sound information should be recorded concurrently on projection films. Against the backdrop as mentioned above, the technique of optically recording sound on projection films was developed in the 1920s. The dominant projection films in those days were black-and-white (B/W) photosensitive materials forming images of developed silver, and, on the apparatus part also, the reading of sound signals at the time of projection was made on the premise that the signals were recorded as silver images. The developed silver absorbs light in a wide wavelength region, from ultraviolet light to infrared light, so the reading apparatus has no particular restriction as to the wavelength region for reading. Therefore, the reading apparatus used was one having a maximum sensitivity in the region of 800 nm to 900 nm, which was easy to commercialize with the techniques of that time.

Color-developed dyes forming color images in silver halide color photosensitive materials for projection purpose, which material were commercialized from then on, have no absorption in the near infrared region of 800 to 900 nm utilized by sound-signal readers. However, no change was made to the systems for reading sound signals from the time of development to the present day, and sound signals are still recorded as silver images in the current silver halide color photosensitive materials for projection purposes. On the other hand, the developed silver in the image areas of silver halide color photosensitive materials for projection purposes is removed in a processing step, out of necessity to enhance color purity.

As mentioned above, dye images having no need for silver images and sound signals to be formed of silver images are both present on the same silver halide color photosensitive material for use in projection. Thus, the development-processing process of silver halide color photosensitive materials for projection purposes becomes complicated, because application of a special developer to the sound signal-recorded region (the so-called soundtrack) alone becomes necessary halfway through the processing, with the result that this operation becomes burdensome to photo laboratories.

On the other hand, simplification of the development-processing process is a very important problem from the viewpoint of environmental conservation by resource-savings, in addition to reduction of loads imposed on photo laboratories. Much research has therefore been conducted, and the fruits thereof have been introduced into the market. For instance, the standard development process of negative-positive silver halide color photosensitive materials for projection purposes, which in 1990 had 14 steps (the development process disclosed as ECP-2A by Eastman Kodak Company), was reduced to 12 steps at the end of the 1990s (the development process disclosed as ECP-2D by Eastman Kodak Company). However, the development process of silver halide color photographic printing paper, aiming to show pictures as in the case of silver halide color photosensitive materials for projection purposes, had only three steps. Viewed from this angle, it can be said that the current 12 steps are still too many.

One factor responsible for the high number of processing steps a silver halide color photosensitive material for use in projection is required to undergo is the aforementioned complex processing intended for the soundtrack formation with silver images. Therefore, methods of forming soundtracks through the same processing steps that are applied for the formation of dye images have been studied.

Examples of representative studies include methods of inhibiting, imagewise, the bleaching of silver images by use of bleach-inhibitor-releasing couplers to form silver-image soundtracks themselves, which are disclosed, e.g., in U.S. Pat. Nos. 3,705,208, 3,705,799, 3,705,800, 3,705,801, 3,705,802, 3,705,803, 3,737,312, and 3,749,572, and in JP-A-49-103629, JP-A-51-077334, JP-A-51-151134, JP-A-53-125836, and JP-A-55-110242.

Other cited examples are methods of using infrared-absorbing-dye-forming couplers, as disclosed, e.g., in U.S. Pat. Nos. 2,266,452, 3,458,315, 4,250,251, and 5,030,544, and in JP-A-63-143546, and JP-A-11-282106. These are the art of forming soundtracks from developed dyes whose absorption is in the near infrared region required by the available sound readers.

Known alternative measures include techniques for modifying sound-signal readers, but not on the photosensitive material part, so as to read sound signals recorded by a color-developed dye used for forming dye images. A representative example thereof is the technique of forming soundtracks from developed cyan dyes, which is referred to as "cyan dye sound" (details of which were presented in a paper entitled "Red LED Reproduction of Cyan Stereo Variable Area Dye Tracks" at the SMPTE Technical Conference and World Media Expo (1996)). This technique permits the use of pre-existing color photosensitive materials for projection purposes, and further, the adoption thereof requires photo laboratories to add almost no modifications to their existing facilities. However, such a technique requires the modification of sound readers. Although cyan-dye-sound adaptations of the sound readers attached to the projectors already on the market have been under way, the changeover from all silver-image soundtracks to cyan-dye soundtracks requires that modifications be made to all projectors, so it is far from practical. In fact, both traditional sound readers utilizing the infrared region and cyan-dye-sound-capable sound readers utilizing cyan dye images are present together on the current market.

The traditional sound readers differ from the cyan-dye-sound-capable readers in performance, so it is required to form soundtracks corresponding individually to these two types of readers. In each photo laboratory, therefore, photofinishing for supplying cyan-dye soundtracks to theaters having cyan-dye-sound-capable equipment, and photofinishing for supplying traditional soundtracks to theaters having conventional-type equipment, are required to be performed separately; as a result, the operations become more and more complicated. Aiming to solve such a problem, the method of making a change to the hue of traditional soundtracks, to support both types of readers (a high-magenta soundtrack method), was presented. Even when this method is adopted, however, the loads imposed on photo laboratories remain the same as heretofore, because the recording of sound information therein is performed with silver images.

DISCLOSURE OF INVENTION

According to the present invention, there are provided:

(1) A silver halide color photosensitive material, having, on a transparent support, at least one yellow-color-forming photosensitive silver halide emulsion layer, at least one cyan-color-forming photosensitive silver halide emulsion layer, at least one magenta-color-forming photosensitive silver halide emulsion layer, and at least one photosensitive silver halide emulsion layer containing a coupler capable of forming a dye having its absorption maximum at a wavelength longer than 730 nm upon reaction with an oxidized product of a developing agent, wherein the yellow-color-forming photosensitive silver halide emulsion layer contains photosensitive silver halide grains having an average grain size of 0.4 μm or below and having a silver chloride content of 95 mole % or above, based on total silver in the grains, and wherein the photosensitive silver halide grains include photosensitive silver halide grains whose iodide ion concentrations have their maxima at individual grain surfaces and decrease gradually toward the interior of the grains.

(2) A silver halide color photosensitive material, having, on a transparent support, at least one yellow-color-forming photosensitive silver halide emulsion layer, at least one cyan-color-forming photosensitive silver halide emulsion layer, at least one magenta-color-forming photosensitive silver halide emulsion layer, and at least one photosensitive silver halide emulsion layer containing a coupler capable of forming a dye having its absorption maximum at a wavelength longer than 730 nm upon reaction with an oxidized product of a developing agent, wherein the yellow-color-forming photosensitive silver halide emulsion layer contains photosensitive silver halide grains having a silver chloride content of 95 mol % or above, based on the total silver in the grains, and, wherein the photosensitive silver halide grains include tabular photosensitive silver halide grains having an aspect ratio of two or above.

(3) The silver halide color photosensitive material as described in (2), wherein the tabular photosensitive silver halide grains have {100} planes as their principal planes.

(4) A silver halide color photosensitive material, having, on a transparent support, at least one yellow-color-forming photosensitive silver halide emulsion layer, at least one cyan-color-forming photosensitive silver halide emulsion layer, and at least one magenta-color-forming photosensitive silver halide emulsion layer, wherein the silver halide color photosensitive material contains a compound capable of releasing a non-diffusible bleach inhibitor upon reaction with an oxidized product of a developing agent, wherein the yellow-color-forming photosensitive silver halide emulsion layer contains photosensitive silver halide grains having an average grain size of 0.4 μm or below and having a silver chloride content of 95 mole % or above based on total silver of the grains, and wherein the photosensitive silver halide grains include photosensitive silver halide grains whose iodide ion concentrations have their maxima at individual grain surfaces and decrease gradually towards the interior of the grains.

(5) A silver halide color photosensitive material, having, on a transparent support, at least one yellow-color-forming photosensitive silver halide emulsion layer, at least one cyan-color-forming photosensitive silver halide emulsion layer, and at least one magenta-color-forming photosensitive silver halide emulsion layer, wherein the silver halide color photosensitive material includes a compound capable of releasing a non-diffusible bleach inhibitor upon reaction with an oxidized product of a developing agent, wherein the yellow-color-forming photosensitive silver halide emulsion layer contains photosensitive silver halide grains having a silver chloride content of 95 mole % or above based on total silver of the grains, and, wherein the photosensitive silver halide grains include tabular photosensitive silver halide grains having an aspect ratio of 2 or above.

(6) The silver halide color photosensitive material as described in (5), wherein the tabular photosensitive silver halide grains have {100} planes as their principal planes.

(7) A silver halide color photosensitive material, which is for use as a silver halide color printing photosensitive material, having, on a transparent support, at least one yellow-color-forming photosensitive silver halide emulsion layer, at least one cyan-color-forming photosensitive silver halide emulsion layer, at least one magenta-color-forming photosensitive silver halide emulsion layer, and at least one non-photosensitive hydrophilic colloid layer, wherein the silver halide color photosensitive material contains a compound capable of forming a dye having absorption in the infrared region, upon reaction with an oxidized product of a developing agent, in one of the yellow-, cyan-, and magenta-color-forming photosensitive silver halide emulsion layers, or in a photosensitive silver halide emulsion layer having a color-sensitive region different from those of the yellow-, cyan-, and magenta-color-forming photosensitive silver halide emulsion layers, and wherein CTF of an infrared-absorbing-dye image formed, which is denoted by CI, and CTF of a cyan dye image formed from the cyan-color-forming photosensitive silver halide emulsion layer, which is denoted by CC, satisfy a relationship expressed by the following formula (1) in a spatial frequency range of 2 c/mm to 20 c/mm:

$$0.95 < CI/CC < 1.05. \quad \text{formula (1)}$$

(8) The silver halide color photosensitive material as described in (7), wherein the CTF of the infrared-absorbing-dye image formed, which is denoted by CI, and the CTF of the cyan dye image formed from the cyan-color-forming photosensitive silver halide emulsion layer, which is denoted by CC, satisfy a relationship expressed by the following formula (2) in a spatial frequency range of 2 c/mm to 20 c/mm:

$$0.98 < CI/CC < 1.02. \quad \text{formula (2)}$$

(9) A silver halide color photosensitive material, which is for use as a silver halide color printing photosensitive material, having, on a transparent support, at least one yellow-color-forming photosensitive silver halide emulsion layer, at least one cyan-color-forming photosensitive silver halide emulsion layer, at least one magenta-color-forming photosensitive silver halide emulsion layer, at least one silver halide emulsion layer having a fourth spectral sensitivity different from the spectral sensitivities of the yellow-, magenta-, and cyan-color-forming photosensitive silver halide emulsion layers; and at least one non-photosensitive hydrophilic colloid layer, wherein the silver halide emulsion layer having the fourth spectral sensitivity contains a compound capable of inhibiting bleaching of developed silver during development processing, and thereby forming a developed silver image after the development processing, and wherein CTF of the developed silver image formed, which is denoted by CI, and CTF of a cyan dye image formed from the cyan-color-forming photosensitive silver halide emulsion layer, which is denoted by CC, satisfy a relationship expressed by the following formula (1) in a spatial frequency range of 2 c/mm to 20 c/mm:

$$0.95<CI/CC<1.05. \quad \text{formula (1)}$$

(10) The silver halide color photosensitive material as described in (9), wherein the CTF of the silver image formed, which is denoted by CI, and the CTF of the cyan dye image formed from the cyan-color-forming photosensitive silver halide emulsion layer, which is denoted by CC, satisfy a relationship expressed by the following formula (2) in a spatial frequency range of 2 c/mm to 20 c/mm:

$$0.98<CI/CC<1.02. \quad \text{formula (2)}$$

(11) The silver halide color photosensitive material as described in any of (7) to (10), which is intended for use in film screening.

(12) The silver halide color photosensitive material as described in any of (7) to (11), which has an Fe content of $2\times10^{-5}$ mole/m$^2$ or below.

(13) The silver halide color photosensitive material as described in any of (7) to (11), which has an Fe content of $8\times10^{-6}$ mole/m$^2$ or below.

(14) A method of processing a silver halide color photosensitive material for use in film screening, wherein a silver halide color photosensitive material as described in any of (11) to (13) is subjected to exposure via images for formation of a soundtrack, and then to color-development processing without undergoing redevelopment for formation of the soundtrack at the time of execution of development processing.

Hereinafter, a first embodiment of the present invention means to include the silver halide color photosensitive materials described in the items (1) to (3) above.

A second embodiment of the present invention means to include the silver halide color photosensitive materials described in the items (4) to (6) above.

A third embodiment of the present invention means to include the silver halide color photosensitive materials and method of processing thereof described in the items (7) to (14) above.

Herein, the present invention means to include all of the above first, second, and third embodiments, unless otherwise specified.

According to the first and second embodiment of the present invention, it is possible to provide a photosensitive silver halide color cinematographic material endowed with the art of relieving the cinematographic sensitive materials of "application development of analog soundtrack information", in order to enhance the capacity of the cinematographic sensitive materials to be processed per hour, and further, the art of making substantial improvements in development speed of the layer for forming developed yellow images at the image region, which constitutes a rate-determining factor in the achievement of improved processing speed.

As a result of intensive studies made for solving the foregoing problems, the inventors have found that the formation of a certain relationship between the sharpness of infrared images forming traditional soundtracks having their absorption in the infrared region, and the sharpness of cyan dye images, in a specified spatial frequency range, was critical to reproducing sound with substantially the same quality irrespective of whether the reader adopted was a traditional sound reader or a cyan-dye-sound-capable reader. The third embodiment of the present invention can provide a silver halide color photosensitive material that can be processed in a simplified and shortened exposure-processing process and a processing method thereof, especially a silver halide color cinematographic photosensitive material and a processing method thereof. More specifically, the third embodiment of the present invention can provide a silver halide color cinematographic photosensitive material that requires no sound development process expressly meant for soundtrack formation (i.e. redevelopment), what is more that can form, from the same sound negative film, soundtracks ensuring sound of substantially the same quality in reproduction with either of two types of projectors, namely a cyan-dye-track-capable projector and a traditional-type projector, and a processing method thereof. In addition, the third embodiment of the present invention can provide a silver halide color cinematographic photosensitive material processable in a simplified processing process and a processing method thereof. Further, the third embodiment of the present invention can provide a silver halide color cinematographic photosensitive material capable of lightening loads on surroundings at processing time, and a processing method thereof.

Other and further features and advantages of the invention will appear more fully from the following description.

BEST MODE FOR CARRYING OUT INVENTION

The silver halide color photosensitive materials (also referred to as "silver halide color photographic photosensitive material") of the present invention are described below in detail.

In the present invention, in order to hold information in the infrared region, which is the detection-sensitive region of a phototube or a silicon-type photodiode used for detection of analog soundtrack information, without conducting application development of soundtracks, use is made of a compound that reacts with an oxidized product of a color-developing agent and forms a dye capable of making an infrared-absorbing soundtrack, or a compound that reacts with an oxidized product of a color-developing agent and releases a non-diffusible bleaching inhibitor.

The compound that reacts with an oxidized product of a color-developing agent and forms a dye capable of making an infrared-absorbing soundtrack can form a color-developed dye through usual image development, and the dye formed makes a soundtrack.

The compound capable of releasing a non-diffusible bleach inhibitor when it reacts with an oxidized product of a color-developing agent is a compound incorporated in an auxiliary layer and capable of releasing a bleach inhibitor from the layer, in a usual processing step, to form images in a yellow-dye-forming layer, a magenta-dye-forming layer and a cyan-dye-forming layer, and thereby capable of avoiding a silver image from being bleached in the bleach step subsequent to the development step, to retain a silver image and eventually enable the recording of sound by the silver image in a soundtrack layer.

The expression "can make a soundtrack" as used herein mean that the infrared density difference between the color-developed dye area and the white background area is at least 0.7, as measured with a Macbeth densitometer TD206A.

As "compounds capable of forming dyes having absorption maximum at a wavelength longer than 730 nm, upon reaction with an oxidized product of a developing agent" or "compounds capable of forming dyes having absorption in the infrared region, upon reaction with an oxidized product of a developing agent" (both are hereinafter referred to as infrared-absorbing-dye-forming couplers), couplers forming dyes having their absorption maxima in the wavelength region of 730 nm or longer, preferably 750 mm or longer, when undergo development, are suitably used in the present invention. Specifically, the wavelength range of absorption maxima is preferably from 750 nm to 1,200 nm, more preferably from 800 nm to 1,100 nm, most preferably from 800 nm to 1,000 nm.

Suitable examples of a coupler that forms a dye exhibiting its absorption maximum at a wavelength longer than 730 nm when it reacts with an oxidized product of a developing agent, which is preferably used in the present invention, especially in the first embodiment of the present invention, include the compounds represented by formula (I) in JP-A-63-143546 and compounds cited in this reference; the compounds represented by formula (XV) in JP-A-11-282106, the compounds represented by formula (I) in JP-A-2003-228155, and the compounds in U.S. Pat. No. 5,030,544.

Examples of such infrared-absorbing-dye-forming couplers that are preferably used in the present invention, especially in the third embodiment of the present invention, include cyan couplers whose absorption maxima are shifted to the long wavelength side by attaching thereto electron attractive groups, and couplers capable of forming dyes whose absorption maxima can vary by aggregation. Specific examples of these couplers are disclosed in U.S. Pat. Nos. 2,266,452, 3,458,315, 4,250,251, and 5,030,544, JP-A-63-143546, JP-A-11-282106, and JP-A-2003-22815.

In order to make any of these compounds be present in the silver halide photosensitive material of the present invention, the compound may be introduced into a photosensitive emulsion layer newly provided as an auxiliary layer, or may be introduced into another layer, such as a silver halide emulsion layer or a hydrophilic colloid layer. In the latter case, the compound may be introduced into an intermediate layer between color-image forming layers, for example, into an intermediate layer provided between a yellow-image-forming layer and a magenta-image-forming layer. In the case of another silver halide emulsion layer, the compound is preferably introduced into a cyan-color-forming red-sensitive emulsion layer.

The using amount of a coupler that forms an infrared-absorbing-dye when it reacts with an oxidized product of a developing agent, though not particularly limited so far as the dye formed can ensure satisfactory recording of analog soundtrack information, is preferably from $1\times10^{-7}$ mole/m$^2$ to $5\times10^{-1}$ mole/m$^2$, and more preferably from $1\times10^{-5}$ mole/m$^2$ to $1\times10^{-1}$ mole/m$^2$.

The compound capable of inhibiting the bleaching of developed silver during development processing (hereinafter referred to as the bleach inhibitor) that can be used in the present invention is a compound having a function of acting on developed silver at the bleaching step during the color development process and inhibiting rehalogenation of the developed silver. It is preferable that such a function emerges imagewise, so a compound releasing a non-diffusible bleach inhibitor upon reaction with an oxidized product of a color-developing agent is suitable.

Suitable examples of the compound releasing a non-diffusible bleach inhibitor upon reaction with an oxidized product of a color-developing agent include the couplers disclosed in U.S. Pat. Nos. 3,705,801 and 3,705,799, WO97/21147, and U.S. Pat. No. 4,248,962, and hydroquinones or naphthoquinones each capable of releasing non-diffusible bleach inhibitors. These compounds have hydrophobic groups bonded to aromatic nuclei via thio or seleno groups, and release the hydrophobic groups bonded to aromatic nuclei via thio or seleno groups, from the aromatic nuclei upon reaction with oxidized products of developing agents.

In general, the non-diffusible bleach inhibitor moieties of the above-recited couplers, hydroquinones and naphthoquinones can be replaced, so the generally known thio-substituted development-inhibitor-releasing compounds, such as the couplers from the compounds disclosed in U.S. Pat. Nos. 3,632,345, 3,705,799 and 3,705,803, and generally known mercapto compounds, such as the compounds disclosed in JP-A-2002-162707 and JP-A-2004-54025, can be preferably used.

As the non-diffusible bleach inhibitors released by reaction with oxidized product of color-developing agents, thiol compounds and selenol compounds are preferably used. The thiol compounds in particular can be used to advantage. Specifically, it is preferable in the present invention to use the compounds represented by the following formula I or II:

(Formula I)

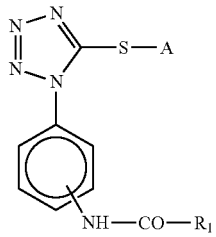

(Formula II)

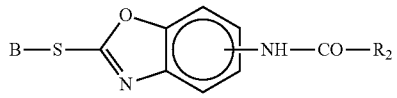

A in formula I or B in formula II represents a hydroquinone or naphthoquinone or a part of coupler, each releasing a thiol compound of formula I or II upon reaction with an oxidized product of a color-developing agent. $R_1$ in formula I or $R_2$ in formula II preferably represents a substituted or unsubstituted alkyl group, an aryl group, an aralkyl group, or a phenyl group, more preferably an alkyl group or an aryl group. It is appropriate that the number of carbon atoms contained in $R_1$ and $R_2$ each be great, and each group has preferably from 2 to 40 carbon atoms, more preferably from 5 to 40 carbon atoms. Specific examples of these compounds are illustrated below, but these examples should not be construed as limiting the scope of the present invention.

I-1
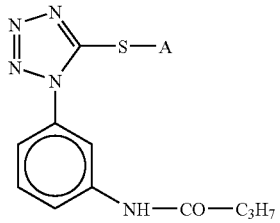
I-2
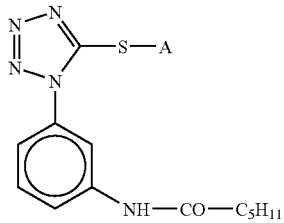
I-3
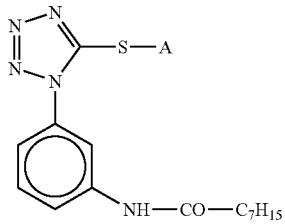
I-4
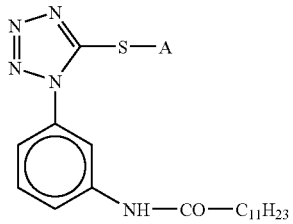
I-5
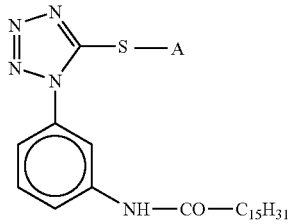
I-6
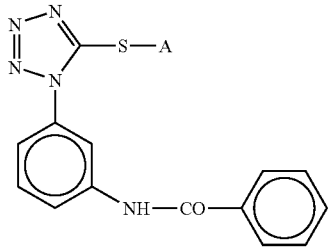
-continued
I-7
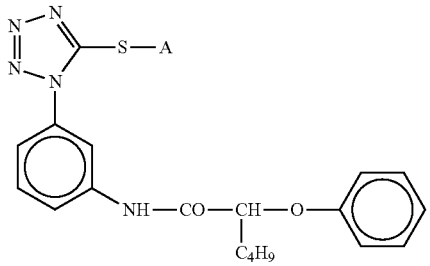
I-8
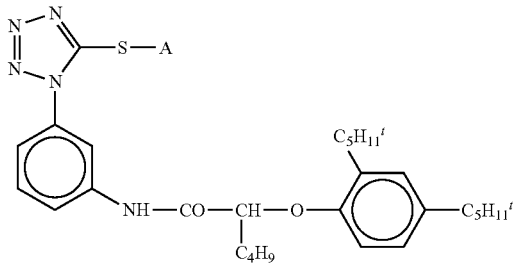
II-1
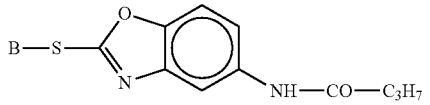
II-2
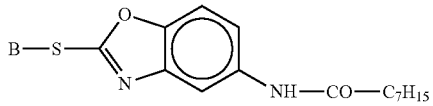
II-3
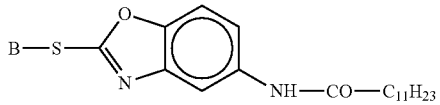
II-4
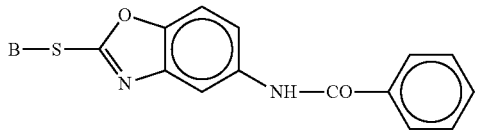
II-5
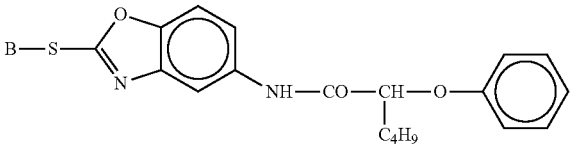
II-6
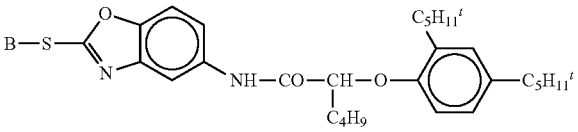
II-7
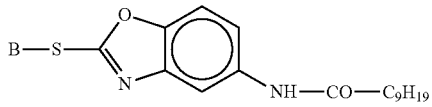
In order to make any of these compounds be present in the silver halide photosensitive material according to the second embodiment of the present invention, the compound may be introduced into a photosensitive emulsion layer newly provided as an auxiliary layer, or may be introduced into another layer, such as a silver halide emulsion layer or a hydrophilic colloid layer. In the latter case, the compound may be introduced into an intermediate layer between color-image forming layers, for example, into an intermediate layer provided between a yellow-image-forming layer and a magenta-image-forming layer.

The non-diffusible bleach inhibitors released from the compounds as recited above by reaction with oxidized products of developing agents, though not particularly restricted as to the amount to be used, are preferably used in an amount of $1\times10^{-7}$ mole/m$^2$ to $5\times10^{-1}$ mole/m$^2$, and more preferably in an amount of $1\times10^{-5}$ mole/m$^2$ to $1\times10^{-1}$ mole/m$^2$.

In the present invention, known dispersion methods such as oil-in-water dispersion method or latex dispersion method using a high-boiling organic solvent, can be used in order to introduce compounds such as the above-mentioned infrared-absorbing-dye-forming couplers, the above-mentioned bleach-inhibitor-releasing couplers, hydroquinones, and naphthoquinones into the silver halide photosensitive material. In the oil-in-water dispersion method, a cyan coupler or other photographically useful compounds are dissolved in a high-boiling organic solvent, and can be emulsified and dispersed along with a dispersant, such as surfactant, in a hydrophilic colloid, preferably in an aqueous solution of gelatin, by known apparatus such as sonicator, colloid mil, homogenizer, mantongorin (phonetic), and high-speed dissolver. Further, an auxiliary solvent can be used for dissolving couplers. The auxiliary solvent referred to here is an organic solvent useful at the time of emulsification and dispersion, and is substantially removed from the photosensitive material after a drying step at the time of coating. Examples of such auxiliary solvents include lower alcohol acetates such as ethyl acetate and butyl acetate; ethyl propionate, secondary butyl alcohol, methyl ethyl ketone, methyl isobutyl ketone, β-ethoxy ethyl acetate, methyl cellosolve acetate, methyl carbitol acetate, methyl carbitol propionate, and cyclohexane.

As necessary, an organic solvent completely miscible with water, for example, methyl alcohol, ethyl alcohol, acetone, tetrahydrofuran, dimethyl formamide, and the like can be partially used in combination. These organic solvents can also be used in combination thereof. From the viewpoint of improvement of stability with the lapse of time in an emulsified dispersion during storage, restriction of a change in photographic performance in the form of a final coating composition mixed with an emulsion, and improvement thereof in stability with the lapse of time, all or a part of the auxiliary solvent can be removed as necessary from the emulsified dispersion by a method such as distillation under reduced pressure, noodle water washing or ultrafiltration. The average particle size of the lipophilic fine particle dispersion thus obtained is preferably 0.04 to 0.50 μm, more preferably 0.05 to 0.30 μm, and most preferably 0.08 to 0.20 μm. The average particle size can be measured by use of, for example, Coulter submicron particle analyzer model N4 (Coulter Electronics Ltd.).

In the oil-in-water dispersion method using a high-boiling organic solvent, the ratio of the mass of the high boiling organic solvent to the total mass of cyan couplers used, though can be chosen arbitrarily, is preferably from 0.1 to 10.0, more preferably from 0.1 to 5.0, most preferably from 0.2 to 2.0. Alternatively, it is possible to use no high-boiling organic solvent at all.

As high-boiling organic solvents, known high-boiling organic solvents (e.g., those disclosed in JP-A-62-215272, JP-A-63-143546, JP-A-2-33144 and EP-A2-0355660) are suitably used.

Preferable examples of the color-developing agent that can be used in the present invention include known aromatic primary amine color-developing agents, particularly p-phenylenediamine derivatives. Typical examples are shown hereinbelow, but the present invention is not limited to these examples.

(1) N,N-diethyl-p-phenylenediamine,
(2) 4-amino-3-methyl-N,N-diethylaniline,
(3) 4-amino-N-(β-hydroxyethyl)-N-methylaniline,
(4) 4-amino-N-ethyl-N-(β-hydroxyethyl)aniline,
(5) 4-amino-3-methyl-N-ethyl-N-(β-hydroxyethyl)aniline,
(6) 4-amino-3-methyl-N-ethyl-N-(3-hydroxypropyl)aniline,
(7) 4-amino-3-methyl-N-ethyl-N-(4-hydroxybutyl)aniline,
(8) 4-amino-3-methyl-N-ethyl-N-(β-methanesulfoneamido ethyl)aniline,
(9) 4-amino-N,N-diethyl-3-(β-hydroxyethyl)aniline,
(10) 4-amino-3-methyl-N-ethyl-N-(β-methoxyethyl)aniline,
(11) 4-amino-3-methyl-N-(β-ethoxyethyl)-N-ethylaniline
(12) 4-amino-3-methyl-N-(3-carbamoylpropyl-N-n-propyl) aniline,
(13) 4-amino-N-(4-carbamoylbutyl-N-n-propyl-3-methyl) aniline,
(14) N-(4-amino-3-methylphenyl)-3-hydroxypyrrolidine,
(15) N-(4-amino-3-methylphenyl)-3-(hydroxymethyl)pyrrolidine,
(16) N-(4-amino-3-methylphenyl)-3-pyrrolidine carboxamide Among the aforementioned compounds, the exemplified compound (2) is preferable.

In the present invention, especially in the first and second embodiments of the present invention, it is possible to increase the development speed in color-development processing, which constitutes a rate-determining factor in the processing process of a color positive cinematographic photosensitive material. More specifically, the factor determining the rate of color development is the development speed of a yellow-color-forming layer, which is great in grain size and disposed as the lowermost layer. The halide composition of the yellow-color-forming photosensitive silver halide emulsion grains that can be used in the present invention is characterized by a high content of silver chloride which can ensure both high development-processing speed and high fixation speed. More specifically, a suitable halide composition of the entire silver halide grains is silver chloride, or silver chlorobromide, silver chloroiodide, or silver chloroiodobromide having a chloride content of 95 mole % or above, preferably 96 mole % or above, and more preferably 97 mole % or above.

Moreover, at least two types of silver halide grains, which differ in the size of a silver halide grain or light absorbance (sensitivity), are frequently contained in each color-forming layer, with the intention of obtaining a desirable gradation. It is unnecessary that the silver halide content of all of the silver halide grains, which differ in grain size or light absorbance (sensitivity), contained in the same color-forming layer, fall in the above range. However, it is more preferable that the silver chloride content of all silver halide grains having the same grain sizes or the same light absorbances (sensitivity) in the same color-forming layer fall in the above range.

As the halogen composition of the photosensitive silver halide grain that can be used in the present invention, preferably in the first and second embodiments of the present invention, silver chloride is preferable. However, silver chlorobromide, silver chloroiodide, or silver chloroiodobromide is acceptable insofar as its halogen composition falls in the range defined in the present invention, preferably in the first and second embodiments of the present invention. No particular limitation is imposed on the use of halides other than silver chloride. Such halides may be used during formation of silver halide grains, to obtain silver halide grains having so-called core/shell structure, and thus-obtained silver halide grains may be used. Also, such halides may be used during sedimentation coagulation, a dispersing step, or a chemical sensitization step, or during a period after completion of chemical sensitization but before an application step, to cause halogen conversion due to a difference in solubility product constant, whereby a phase having different halogen composition can be formed on the surface of the grain.

For increasing the development speed, it is favorable that an average grain size of the yellow-color-forming photosensitive silver halide emulsion grains that can be used in the present invention, preferably in the first and second embodiments of the present invention, be 0.4 μm or below, preferably from 0.38 μm to 0.05 μm. The term "average grain size" as used in the present invention refers to the value normalized by the silver ratio in a blend of silver halide grains different in size.

The silver halide emulsion that can be used in the present invention, preferably in the first and second embodiments of the present invention, preferably contains silver iodide. In particular, a yellow-color-forming photosensitive silver halide emulsion preferably contains silver iodide. In order to introduce iodide ions, an iodide salt solution may be added alone, or it may be added in combination with both a silver salt solution and a high chloride salt solution. In the latter case, the iodide salt solution and the high chloride salt solution may be added separately or as a mixture solution of these salts of iodide and high chloride. The iodide salt is generally added in the form of a soluble salt, such as an alkali or alkali earth iodide salt. Alternatively, iodide ions may be introduced by cleaving iodide ions from an organic molecule, as described in U.S. Pat. No. 5,389,508. As another source of iodide ion, fine silver iodide grains may be used.

The addition of an iodide salt solution may be concentrated at one time of grain formation process or may be performed over a certain period of time. For obtaining an emulsion with high sensitivity and low fog, the position of introducing an iodide ion to a high chloride emulsion is limited. The deeper in the emulsion grain the iodide ion is introduced, the smaller is the increment of sensitivity. Accordingly, the addition of an iodide salt solution is preferably started at 50% or outer side of the volume of a grain, more preferably 70% or outer side, and most preferably 80% or outer side. Moreover, the addition of an iodide salt solution is preferably finished at 98% or inner side of the volume of a grain, more preferably 96% or inner side. By finishing the addition of an iodide salt solution at a little inner side of the grain surface, an emulsion having higher sensitivity and lower fog can be obtained.

The distribution of an iodide ion concentration in the depth direction in a grain can be measured according to an etching/TOF-SIMS (Time of Flight-Secondary Ion Mass Spectrometry) method by means of, for example, a TRIFT II Model TOF-SIMS (trade name) manufactured by Phi Evans Co. A TOF-SIMS method is specifically described in Nippon Hyomen Kagakukai edited, *Hyomen Bunseki Gijutsu Sensho Niji Ion Shitsuryo Bunsekiho* (*Surface Analysis Technique Selection Secondary Ion Mass Spectrometry*), Maruzen Co., Ltd. (1999). When an emulsion grain is analyzed by the etching/TOF-SIMS method, it can be analyzed that there are iodide ions oozed toward the surface of the grain, even though the addition of an iodide salt solution is finished at an inner side of the grain. When an emulsion for use in the present invention contains silver iodide, it is preferred that the grain has the maximum concentration of iodide ion at the surface of the grain, and the iodide ion concentration decreases inwardly in the grain, by analysis with the etching/TOF-SIMS method.

Examples of the shape of the silver halide grain in the present invention, preferably in the first and the second embodiments of the present invention, may include a cubic, octahedron, tabular, sphere, bar-like form, potato-like form, and the like. In the present invention, preferably in the first and second embodiments of the present invention, a cubic grain and a tabular grain are preferable, and particularly, a tabular grain is preferably used with the intention of imparting properties of high sensitivity and excellent graininess.

In the present invention, the term "tabular grain" means a grain having an aspect ratio (diameter/thickness) of 1 or more, and the term "average aspect ratio" means an average of the aspect ratio of each tabular grain. The term "diameter" means a diameter of a circle having the same area as the projected area of a tabular grain, and the term "thickness" means a distance between two principal planes. It is to be noted that the term "principal plane" means the surface having a maximum area in a tabular grain. In the case of using the tabular silver halide grain, the average aspect ratio is preferably 2 or more, more preferably 2 or more but 100 or less, and further more preferably 3 or more but 50 or less. Also, a silver halide grain having rounded corners is preferably used. There is no particular limitation to the plane indices (Miller indices) of a surface of the photosensitive silver halide grain, but it is preferable that the ratio of the portion occupied by a {10} plane, which has a high spectral sensitizing efficiency when a spectral sensitizing dye adsorbs, is high. The ratio is preferably 50% or more, more preferably 65% or more, and still more preferably 80% or more but 100% or less. The ratio of Miller indices can be measured by a method described in T. Tani, Imaging Sci., 29, 165 (1985), which utilizes the adsorption dependency of a sensitizing dye on a {111} plane and a {100} plane, in the adsorption of a sensitizing dye.

The tabular grain that can be used in the present invention, preferably in the first and second embodiments of the present invention, is preferably a tabular grain having, as its principal plane, a {100} plane that exhibits a high spectral sensitizing efficiency. Examples of the shape of the tabular grain containing a {100} plane as its principal plane include a right-angled parallerogram, a 3- to 5-cornered shape formed by cutting off one of the corners of the right-angled parallerogram (the shape of the cut portion is a right-angled triangle formed of the corner as its vertex and sides forming the corner), or a 4- to 8-cornered shape, in which the cut portions present accounts for two or more and but four or less. If a right-angled parallerogram formed by compensating the cut portions is called a supplemented tetragon, the ratio of the neighboring sides (i.e. length of long side/length of short side) of the said parallerogram and the said supplemented tetragon is generally 1 to 6, preferably 1 to 4, and more preferably 1 to 2.

In a method of forming the tabular silver halide emulsion grain having the {100} principal plane, an aqueous silver salt solution and an aqueous halide solution are added to and mixed with a dispersion medium, such as an aqueous gelatin solution, with stirring. A method is disclosed, in which, during the formation, a silver iodide or iodide ion, or a silver bromide or bromide ion, is allowed to be present, to cause a strain in nuclei by a difference in the size of the crystal lattice with that of silver chloride, thereby introducing crystal defects imparting anisotropic growth characteristics, such as screw dislocation, in JP-A-6-301129, JP-A-6-347929, JP-A-9-34045, and JP-A-9-96881. When the screw dislocation is introduced to a plane, the formation of two-dimensional nuclei on the plane is no longer a rate-determining step in a low supersaturation condition, and hence crystallization on this plane progresses to form a tabular grain. Thus, the tabular grain is formed as a result of the introduction of the screw dislocation. Here, the low supersaturation condition shows a condition that above silver halide or halide ion is added in an amount of preferably 35% or less and more preferably 2 to 20% of the critical amount. Although the crystal defect have not been identified as the screw dislocation, it is considered that there is a high possibility that the crystal defect is the screw dislocation, in consideration of the direction in which the dislocation is introduced and the fact that anisotropic growth characteristics is imparted to the grain. The retention of the introduced dislocation is preferable to make the tabular grain thinner, as disclosed in JP-A-8-122954 and JP-A-9-189977.

There are also methods of forming tabular grains having {100} principal plane by adding a {100} plane-forming accelerator, using, for example, imidazoles or 3,5-diaminotriazoles (as disclosed in JP-A-6-347928) or using polyvinyl alcohols (as disclosed in JP-A-8-339044). Moreover, the tabular grains having {100} principal plane can be prepared using the methods disclosed, for example, in U.S. Pat. Nos. 5,320,935, 5,264,337, 5,292,632, 5,314,798, and 5,413,904 and WO94/22051. However, these methods are not intended to be limiting of the present invention.

The grain according to the present invention, preferably the first and second embodiments of the present invention, may have a so-called core/shell structure comprising a core portion and a shell portion surrounding the core portion. When the grain has the core/shell structure, the core portion preferably contains 90 mol % or more of silver chloride. The core portion may comprise two or more portions different in halogen composition. The shell portion preferably occupies 50% or less and particularly preferably 20% or less of the entire volume of an individual grain. The shell portion preferably comprises silver chloroiodide or silver chlorobromide. The shell portion contains silver bromide in an amount of preferably 0.5 mol % to 10 mol % and particularly preferably 1 mol % to 5 mol %. The content of silver bromide in all grains is preferably 5 mol % or less and particularly preferably 3 mol % or less.

In the present invention, preferably in the first and second embodiments of the present invention, although the photosensitive silver halide may be a fine grain having a grain size of 0.2 μm or less, or a large-sized grain having a diameter of its projected area up to 10 μm or more, it is preferably a fine grain in order to obtain better graininess. The dispersion may be in a polydispersed state or a monodispersed state, preferably in a monodispersed state.

The silver halide grains for use in the present invention, preferably in the third embodiment of the present invention, includes silver chloride, silver bromide, silver (iodo)chlorobromide, silver iodobromide, and the like. Particularly, in the present invention, preferably in the third embodiment of the present invention, in view of reducing development processing time, it is preferable to use silver chloride, silver chlorobromide, silver chloroiodide, silver chloroiodobromide, each having silver chloride content of 95 mol % or more. The silver halide grains in the emulsion may be those comprising regular crystals having, for example, a cubic, octahedron, or tetradecahedron form, those comprising irregular crystals having, for example, a spherical or plate form, those having crystal defects such as a twin plane, or complex systems of these crystals. Also, use of a tabular grain having a (111) plane or a (100) plane as its principal plane, is preferable in view of achieving rapid color development processing and decreasing color contamination in the processing. The tabular high-silver-chloride emulsion grains having a (111) plane or a (100) plane as its principal plane may be prepared by the methods disclosed in JP-A-6-138619, U.S. Pat. Nos. 4,399,215, 5,061,617, 5,320,938, 5,264,337, 5,292,632, 5,314,798, and 5,413,904, WO94/22051, and the like.

As a silver halide emulsion which can be used in combination with the above emulsions, in the present invention, preferably in the third embodiment of the present invention, any silver halide emulsion having an arbitrary halogen composition may be used. However, in view of rapid processability, silver (iodo)chloride and silver chloro(iodo)bromide, each having 95 mol % or more of silver chloride are preferable, and further, a silver halide emulsion having 98 mol % or more of silver chloride is preferable.

In the present invention, preferably in the third embodiment of the present invention, silver halide grain in the photographic emulsion may be one having a regular crystal form such as a cubic, octahedron or tetradecahedron form; one having crystal defects such as a twin plane, or complex system thereof. As to the grain diameter of the silver halide, either fine grains having a grain diameter of about 0.2 μm or less, or large-size grains whose projected-area-equivalent diameter is up to about 10 μm, may be adopted, and further it may be a polydisperse emulsion or monodisperse emulsion. The silver halide grains for use in the present invention, preferably in the third embodiment of the present invention, are preferably monodispersion for the purpose of accelerating the development progress. A coefficient of variation in the grain size of each silver halide grain is preferably 0.3 or less (more preferably 0.3 to 0.05) and more preferably 0.25 or less (more preferably 0.25 to 0.05). The coefficient of variation so-called here is expressed by the ratio (s/d) of the statistical standard deviation (s) to the average grain size (d).

The silver halide photographic emulsions that can be used in the present invention, preferably in the third embodiment of the present invention, may be prepared, for example, by the methods described in Research Disclosure (hereinafter abbreviated to as RD) No. 17643 (December 1978), pp. 22-23, "I. Emulsion preparation and types", and ibid. No. 18716 (November 1979), p. 648, and ibid. No. 307105 (November, 1989), pp. 863-865; the methods described by P. Glafkides, in Chemie et Phisique Photographique, Paul Montel (1967); by G. F. Duffin, in Photographic Emulsion Chemistry, Focal Press (1966); and by V. L. Zelikman et al., in Making and Coating of Photographic Emulsion, Focal Press (1964).

Monodispersed emulsions described in U.S. Pat. Nos. 3,574,628, and 3,655,394, and U.K. Patent No. 1,413,748 are also preferable. Tabular grains having an aspect ratio of about 3 or more can also be used in the present invention, preferably in the third embodiment of the present invention. Such tabular grains may be prepared easily, according to the methods described by Gutoff, in Photographic Science and Engineering, Vol. 14, pp. 248-257 (1970); U.S. Pat. Nos. 4,434,226, 4,414,310, 4,433,048, and 4,439,520, and U.K. Patent No. 2,112,157.

As to the crystal structure in the present invention, preferably in the third embodiment of the present invention, a uniform structure, a structure in which the internal part and the external part have different halogen compositions, and a layered structure may be acceptable. Silver halides differing in composition may be joined with each other by epitaxial junction, and, for example, a silver halide may be joined with a compound other than silver halides, such as, silver rhodanate and lead oxide. Also, a mixture of grains having various crystal forms may be used.

Although the aforementioned emulsion for use in the present invention, preferably in the third embodiment of the present invention, can be any one of a surface latent image-type that forms a latent image primarily on the grain surface, an internal latent image-type that forms a latent image inside the grain, and another type of emulsion that forms a latent image both on the surface and inside the grain; but it must be a negative type emulsion in any case. Among the internal latent image type emulsions, an emulsion of a core/shell type internal latent image type emulsion, as described in JP-A-63-264740 may be used, and the preparation method of this emulsion is described in JP-A-59-133542. The thickness of the shell of this emulsion is preferably 3 to 40 nm, and particularly preferably 5 to 20 nm, though it differs depending on development process or the like.

As the silver halide emulsion, generally, those subjected to physical ripening, chemical ripening, and spectral sensitization are used. Additives to be used in these steps are described in RD Nos. 17643, 18716, and 307105. Their relevant parts are listed in a table described later.

In the photosensitive material of the present invention, two or more types of emulsions differing in at least one feature among the grain size, the distribution of grain size, the halogen composition, the shape of grain, and the sensitivity of photosensitive silver halide emulsion, may be mixed and used in one layer.

The amount of silver to be applied in the silver halide color photosensitive material of the present invention, preferably in the third embodiment of the present invention, is preferably 6.0 g/m$^2$ or less, more preferably 4.5 g/m$^2$ or less, and particularly preferably 2.0 g/m$^2$ or less. Further, the amount of silver to be applied is generally 0.01 g/m$^2$ or more, preferably 0.02 g/m$^2$ or more, and more preferably 0.5 g/m$^2$ or more.

In the present invention, preferably in the first and second embodiments of the present invention, an iridium compound, specifically, an iridium complex or an iridium ion-containing compound can be preferably used. The iridium ion-containing compound is a trivalent or tetravalent salt or complex salt, and it is particularly preferably a complex salt. Preferable examples of the iridium compound include halogens, amines, and oxalate complex salts of such as iridous (III) chloride, iridous (III) bromide, iridic (IV) chloride, sodium hexachloroiridate (III), potassium hexachloroiridate (IV), hexaanamineiridate (IV), trioxalatoiridate (III), and trioxalatoiridate (IV). The amount of the iridium complex or the iridium ion-containing compound to be used is preferably $1.0\times10^{-8}$ mol/mol-silver or more and $5.0\times10^{-6}$ mol/mol-silver or less, and more preferably $2.0\times10^{-8}$ mol/mol-silver or more and $2.5\times10^{-6}$ mol/mol-silver or less, to the amount of silver halide.

The iridium complex or the iridium ion-containing compound may be contained in the core portion or the shell portion, or may be contained uniformly, in a silver halide grain. Also, a portion differing in halogen composition may be grown in the corner portion by means of heterojunction, thereby containing the iridium complex or the iridium ion-containing compound selectively in said portion; but the present invention is not particularly limited to these.

The photosensitive silver halide grain of the present invention, preferably in the first and second embodiments of the present invention, may contain at least one complex of a metal selected from rhodium, rhenium, ruthenium, osmium, cobalt, mercury and iron, in addition to the iridium complex or the iridium ion-containing compound. These metal complexes may be used singly or in combinations of two or more of the same or different metal types. A preferable content of the metal is in a range from preferably $1\times10^{-9}$ mol/mol silver to $1\times10^{-3}$ mol/mol silver, and more preferably $1\times10^{-9}$ mol/mol silver to $1\times10^{-4}$ mol/mol silver. As a specific structure of the metal complex, for example, metal complexes having a structure described in JP-A-7-225449 may be used. For complexes of cobalt or iron, 6-cyano metal complexes can be preferably used.

It is preferable that the photosensitive silver halide grain according to the present invention, preferably the first and second embodiments of the present invention, be chemically sensitized. As preferable chemical sensitization method, as is well-known in the art, a sensitization method using a chalcogen compound (a sulfur compound, a selenium compound, or a tellurium compound), a sensitization method using a noble metal, such as a gold compound, platinum, palladium, or an iridium compound, and a reduction sensitization method may be used. Further, spectral sensitization may be used. As additives used in this step, compounds described in RD No. 17643, RD No. 18716 and RD No. 307105 may preferably be used.

The silver halide color photosensitive material of the present invention preferably contains a dispersion of solid fine particle of a dye. As a method adopted for preparing such a dispersion and compounds used in the method, those disclosed in JP-A-2004-37534 are suitable.

The term "CTF" (which stands for Contrast Transfer Function) as used in the third embodiment of the present invention is a value giving an indication of image sharpness. More specifically, it is a value measured in accordance with the following method: Rectangular patterns formed on a glass substrate by evaporation so as to vary in spatial frequency and to have a density differential of 0.5 are brought into contact with each photosensitive material sample, and exposed in such an amount of light exposure as to provide a background density of 0.3. Herein, the wavelength (range) of light used for exposure may be set to an arbitrary value or range according to the intended purpose. The thus-exposed photosensitive material is subjected to general color development processing. The densities of the rectangular images thus formed are measured precisely with a microdensitometer, and the CTF value is calculated from the density differential between the rectangular images at each spatial frequency. In these measurements, the wavelength (range) of light used in the measurement can also be set to an arbitrary value or range according to the intended purpose. If desired, the so-called white light may be used in the measurement.

Next, the photographic layers of the silver halide color photosensitive material for use in motion-picture projection, according to the third embodiment of the present invention, are described below.

The silver halide color photosensitive material of the third embodiment of the present invention is a silver halide color photographic printing material having a transparent support; which has, on the support, at least one non-photosensitive hydrophilic colloid layer as well as at least one yellow-color-forming photosensitive silver halide emulsion layer, at least one cyan-color-forming photosensitive silver halide emulsion layer, and at least one magenta-color-forming photosensitive silver halide emulsion layer. The third embodiment of the present invention can be applied to color photosensitive materials for motion-picture use and ordinary use, such as color positive films and cinematographic positive films. Of these applications, the application to cinematographic color positive photosensitive materials is especially preferable.

The third embodiment of the present invention has no particular restrictions as to the number of photosensitive silver halide emulsion layers, the number of non-photosensitive hydrophilic colloid layers, and the arranging order of these layers, so far as the silver halide color photosensitive material has, on a transparent support, at least one yellow-color-forming photosensitive silver halide emulsion layer, at least one cyan-color-forming photosensitive silver halide emulsion layer, at least one magenta-color-forming photosensitive silver halide emulsion layer, and at least one non-photosensitive hydrophilic colloid layer.

Further, in the third embodiment of the present invention, each of the color-forming photosensitive silver halide emulsion layers has no particular restrictions as to the relationship between the color formability and the spectral sensitivity. For instance, a photosensitive silver halide emulsion layer capable of forming a certain color may have spectral sensitivity in the infrared region. The spectral sensitivity of the photosensitive silver halide emulsion layer containing an infrared-absorbing-dye-forming coupler, according to the third embodiment of the present invention, may be the same as or different from the spectral sensitivity of any of the color-forming layers. When the spectral sensitivity of the layer containing an infrared-absorbing-dye-forming coupler is the same as that of a certain color-forming layer, it is preferable that the colored dye-forming layer be a cyan-color-forming layer. When the spectral sensitivity of the layer containing an infrared-absorbing-dye-forming coupler is different from those of the color-forming layers, on the other hand, it is preferably in the ultraviolet region or in the infrared region, more preferably in the ultraviolet region.

Herein, the CTF of an infrared-absorbing-dye image formed (which is denoted by CI) and the CTF of a cyan-dye image formed from the cyan-color-forming photosensitive silver halide emulsion layer (which is denoted by CC) preferably satisfy a relationship expressed by the following formula (1) in a spatial frequency range of 2 c/mm to 20 c/mm:

$$0.95<CI/CC<1.05 \quad \text{formula (1)}$$

It is more preferable that they satisfy a relationship expressed by the following formula (2) in a spatial frequency range of 2 c/mm to 20 c/mm;

$$0.98<CI/CC<1.02 \quad \text{formula (2)}$$

When the CI/CC ratio falls outside the foregoing range, it becomes difficult to produce a sound negative film that can record sound of satisfactory quality on both of the traditional soundtrack and cyan-dye soundtrack in the photosensitive material of the third embodiment of the present invention. More specifically, when a photosensitive material has a CI/CC ratio falls outside the range, a negative film that can record sound with high S/N ratio on one of the two types of soundtracks of the photosensitive film, in a cross-modulation test, cannot record sound with a satisfactory S/N ratio on the other soundtrack.

The bleach-inhibitor-containing silver halide emulsion layer according to the third embodiment of the present invention is required to be a fourth silver halide emulsion layer differing in spectral sensitivity from any of the color-forming layers. It is preferable that such a layer has spectral sensitivity in the ultraviolet region or in the infrared region as far as the spectral sensitivity is different from those of the color-forming layers, and more preferably in the ultraviolet region.

In this case, the fourth silver halide emulsion layer is required to contain a compound inhibiting bleaching of developed silver during the development processing and form a developed silver image after the development processing, and what is more, CTF (CI) of the developed silver image and CTF (CC) of the cyan dye image formed from the cyan-dye-forming photosensitive silver halide emulsion layer satisfy a relationship of formula (1) in the spatial frequency range of 2 c/mm to 20 c/mm:

$$0.95<CI/CC<1.05 \quad \text{formula (1)}$$

Herein, it is more preferable that the relationship expressed by the following formula (2) be satisfied;

$$0.98<CI/CC<1.02 \quad \text{formula (2)}$$

When the CI/CC ratio falls outside the foregoing range, production of sound negative films becomes difficult for the reason mentioned above.

In the third embodiment of the present invention, a typical example of the arranging order of constituent layers is, in increasing order of distance from the support, a non-photosensitive hydrophilic colloid layer containing a dispersion of solid fine particles of dye and/or black colloidal silver, a yellow-color-forming photosensitive silver halide emulsion layer, a non-photosensitive hydrophilic colloid layer (color-mixing-preventing layer), a cyan-color-forming photosensitive silver halide emulsion layer that contains an infrared-absorbing-dye-forming coupler according to the third embodiment of the present invention, a non-photosensitive hydrophilic colloid layer (color-mixing-preventing layer), a magenta-color-forming photosensitive silver halide emulsion layer, and a non-photosensitive hydrophilic colloid layer (protective layer).

Another typical example of the arranging order of constituent layers is, in increasing order of distance from the support, a non-photosensitive hydrophilic colloid layer containing a dispersion of solid fine particles of dye and/or black colloidal silver, a yellow-color-forming photosensitive silver halide emulsion layer, a non-photosensitive hydrophilic colloid layer (color-mixing-preventing layer), a cyan-color-forming photosensitive silver halide emulsion layer, a non-photosensitive hydrophilic colloid layer (color-mixing-preventing layer), a photosensitive silver halide emulsion layer that contains an infrared-absorbing-dye-forming coupler or a bleach-inhibitor according to the third embodiment of the present invention; a non-photosensitive hydrophilic colloid layer (color-mixing-preventing layer), a magenta-color-forming photosensitive silver halide emulsion layer, and a non-photosensitive hydrophilic colloid layer (protective layer).

Still another typical example of the arranging order of constituent layers is, in increasing order of distance from the support, a non-photosensitive hydrophilic colloid layer containing a dispersion of solid fine particles of dye and/or black colloidal silver, a yellow-color-forming photosensitive silver halide emulsion layer, a photosensitive silver halide emulsion layer that contains an infrared-absorbing-dye-forming coupler or bleach inhibitor according to the third embodiment of the present invention (also serves as a color-mixing-preventing layer); a cyan-color-forming photosensitive silver halide emulsion layer, a non-photosensitive hydrophilic colloid layer (color-mixing-preventing layer), a photosensitive silver halide emulsion layer that contains an infrared-absorbing-dye-forming coupler or a bleach inhibitor according to the third embodiment of the present invention (also serves as a color-mixing-preventing layer); a magenta-color-forming photosensitive silver halide emulsion layer, and a non-photosensitive hydrophilic colloid layer (protective layer).

Depending on the intended purposes, however, changes may be made in the above-mentioned arranging orders, or in the number of photosensitive silver halide emulsion layers or non-photosensitive hydrophilic colloid layers.

In the case of variable-area soundtracks generally used in the sound recording for motion pictures, sound is recorded as a wavy image of a constant density. Herein, the frequency of the wave on the image is proportional to the frequency of the sound recorded, and the spatial frequencies of 2 to 20 c/mm correspond to the region of 900 to 9 kHz. This region is an important region (overtone region) to the formation of sound of a human voice and tones of various musical instruments. Therefore, such a region is very critical to these sound recordings.

In the third embodiment of the present invention, in order that the sharpness of the cyan-dye image and the sharpness of the infrared-absorbing-dye image or the silver image for soundtrack use are adjusted so as to satisfy the range specified by the third embodiment of the present invention, either one or both of the sharpness of the images are required to be controlled. From the viewpoint of exerting no influence on pictures to be viewed, it is preferable to control the sharpness of the infrared-absorbing-dye image or the silver image for soundtrack use. The sharpness control can be achieved by use of known sharpness-improving methods. For instance, the method of using an irradiation-preventing dye and the method of providing an antihalation layer can be adopted. In addition, the sharpness control by adjustment of coupler's activity through structural design or dispersant selection is also an effective method. Further, depending on the spectral sensitivity of an emulsion used in the layer for forming a soundtrack image, it is also advantageous to use an oil-soluble substance that can be remained after the development processing, to the extent of exerting no influence on the visual angle. For instance, as mentioned above, when the spectral sensitivity of a silver halide emulsion used in the soundtrack layer is in the ultraviolet region, it is possible to emulsify an infrared-absorbing-dye-forming coupler, a bleach-inhibitor-releasing coupler, hydroquinones, and naphthoquinones together with an oil-soluble ultraviolet absorbent, and to use the oil-soluble ultraviolet absorbent as an irradiation-preventing dye. This method is favorable, because the irradiation-preventing dye can be used only in the layer requiring the prevention of irradiation, as contrasted with the case using water-soluble irradiation-preventing dyes that diffuse throughout the photosensitive material. Examples of an oil-soluble ultraviolet absorbent suitable for the foregoing purpose include benzophenones, benzotriazoles, and triazines.

In the silver halide color photosensitive material of the present invention, Fe is brought mainly from gelatin, dyes, and emulsion grains intentionally doped with Fe. The Fe content in the present invention, preferably in the third embodiment of the present invention, is desirably $2\times10^{-5}$ mol/m$^2$ or below (preferably from $1\times10^{-8}$ to $2\times10^{-5}$ mol/m$^2$), more desirably $8\times10^{-6}$ mol/m$^2$ or below (preferably from $1\times10^{-8}$ to $8\times10^{-6}$ mol/m$^2$), most desirably $3\times10^{-6}$ mol/m$^2$ or below (preferably from $1\times10^{-8}$ to $3\times10^{-6}$ mol/m$^2$). In the third embodiment of the present invention, it is important to limit the Fe content (from the viewpoint of storability), and remarkable effect of Fe in such a content range has been ascertained in the third embodiment of the present invention.

In the present invention, gelatin is preferably used as hydrophilic colloid. Other hydrophilic colloids also can be used in arbitrary proportions as substitutes for gelatin, if needed. Use can be made of, for example, a gelatin derivative, a graft polymer of gelatin with another polymer, a protein, such as albumin and casein; a cellulose derivative, such as hydroxyethyl cellulose, carboxymethyl cellulose, and cellulose sulfates; a saccharide derivative, such as sodium alginate, and a starch derivative; and many synthetic hydrophilic polymers, including homopolymers and copolymers, such as a polyvinyl alcohol, a polyvinyl alcohol partial acetal, a poly-N-vinylpyrrolidone, a polyacrylic acid, a polymethacrylic acid, a polyacrylamide, a polyvinylimidazole, and a polyvinylpyrazole.

In the present invention, a 1-aryl-5-mercaptotetrazole compound, in an amount of preferably $1.0\times10^{-5}$ to $5.0\times10^{-2}$ mol, and more preferably $1.0\times10^{-4}$ to $1.0\times10^{-2}$ mol, per mol of silver halide, is preferably added to any one layer of the photographic structural layers: the photosensitive silver halide emulsion layers and non-photosensitive hydrophilic colloidal layers (intermediate layers and protective layers) disposed on the support; and the compound is preferably added to a silver halide emulsion layer. The addition of this compound in an amount falling in the above range further reduces stains to the surface of a processed color photograph after continuous processing.

As the 1-aryl-5-mercaptotetrazole compound, preferred is one in which the aryl group at the 1-position is an unsubstituted or substituted phenyl group. Preferable specific examples of the substituent include an acylamino group (e.g., an acetylamino group and —$NHCOC_5H_{11}$(n)), a ureido group (e.g., a methylureido group), an alkoxy group (e.g., a methoxy group), a carboxylic acid group, an amino group, and a sulfamoyl group. A plurality of groups (e.g. two to three groups) selected from these groups may be bonded with the phenyl group. Also, the position of the substituent is preferably the meta or para position. Specific examples of the compound include 1-(m-methylureidophenyl)-5-mercaptotetrazole and 1-(m-acetylaminophenyl)-5-mercaptotetrazole.

The photographic additives that can be used in the present invention are described in the following Research Disclosures (RD), whose particular parts are given in the following table.

| Kind of Additive | RD 17643 | RD 18716 | RD 307105 |
|---|---|---|---|
| 1 Chemical sensitizers | p. 23 | p. 648 (right column) | p. 866 |
| 2 Sensitivity-enhancing agents | | p. 648 (right column) | |
| 3 Spectral sensitizers and Supersensitizers | pp. 23-24 | pp. 648 (right column)-649 (right column) | pp. 866-868 |
| 4 Brightening agents | p. 24 | pp. 647 (right column) | p. 868 |
| 5 Light absorbers, Filter dyes, and UV Absorbers | pp. 25-26 | pp. 649 (right column)-650 (left column) | p. 873 |
| 6 Binders | p. 26 | p. 651 (left column) | pp. 873-874 |
| 7 Plasticizers and Lubricants | p. 27 | p. 650 (right column) | p. 876 |
| 8 Coating aids and Surfactants | pp. 26-27 | p. 650 (right column) | pp. 875-876 |
| 9 Antistatic agents | p. 27 | p. 650 (right column) | pp. 876-877 |
| 10 Matting agents | | | pp. 878-879 |

In the silver halide color photosensitive material of the present invention, the following couplers are particularly preferably used, though various dye-forming couplers may be used:

Yellow couplers: couplers represented by the formula (I) or (II) in EP 502,424A; couplers represented by the formula (1) or (2) in EP513,496A (particularly, Y-28 on page 18); couplers represented by the formula (I) in claim 1 in JP-A-5-

307248; couplers represented by the formula (I) in U.S. Pat. No. 5,066,576, column 1, line 45 to line 55; couplers represented by the formula (I) in JP-A-4-274425, paragraph 0008; couplers described in claim 1 in EP 498,381A1, page 40 (particularly, D-35 on page 18); couplers represented by the formula (Y) in EP 447,969A1, page 4 (particularly Y-1 (page 17) and Y-54 (page 41)); and couplers represented by one of the formulae (II) to (IV) in U.S. Pat. No. 4,476,219, column 7, line 36 to line 58 (particularly, II-17 and -19 (column 17) and II-24 (column 19)).

Magenta couplers: JP-A-3-39737 (L-57 (page 11, lower right), L-68 (page 12, lower right), L-77 (page 13, lower right)); A-4-63 (page 134), A-4-73 and -75 (page 139) in EP 456,257; M-4, M-6 (page 26) and M-7 (page 27) in EP 486,965; M-45 in JP-A-6-43611, paragraph 0024; M-1 in JP-A-5-204106, paragraph 0036; M-22 in JP-A-4-362631, paragraph 0237.

Cyan couplers CX-1,3,4,5, 11, 12, 14, and 15 (page 14 to page 16) in JP-A-4-204843; C-7, 10 (page 35), 34, 35 (page 37), (I-1), (I-17) (page 42 to page 43) in JP-A-4-43345; and couplers represented by the formula (Ia) or (Ib) in claim 1 in JP-A-6-67385.

The cyan couplers CX-1,3,4,5, 11, 12, 14 and 15 in JP-A-4-204843 are shown below.

CX-1

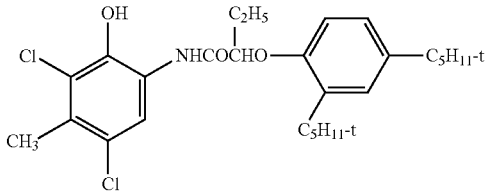

CX-4

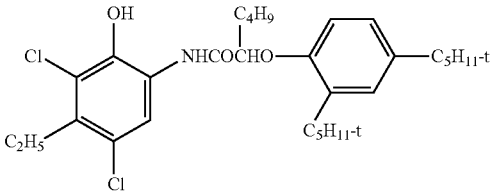

CX-3

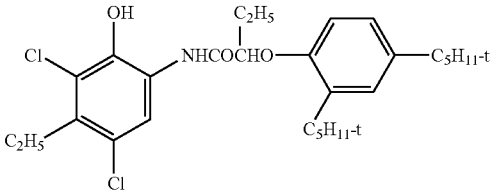

CX-5

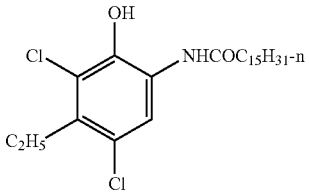

-continued

CX-11

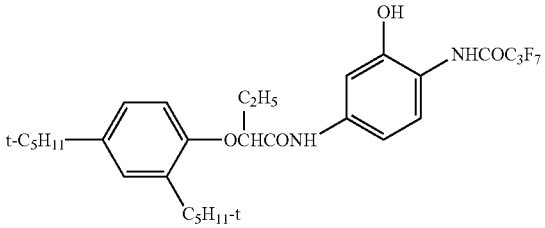

CX-14

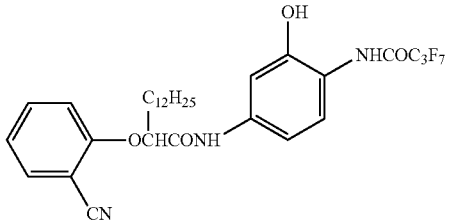

CX-12

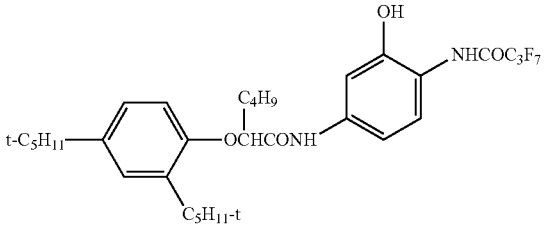

CX-15

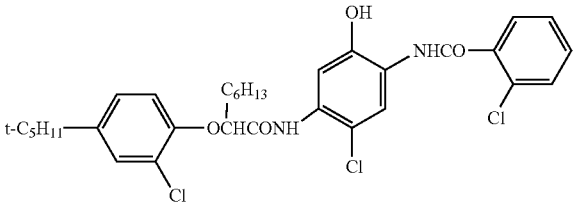

The couplers represented by the formula (Ia) or (Ib) in claim 1 in JP-A-6-67385 are as follows.

formula (Ia)

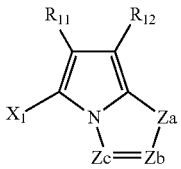

formula (Ib)

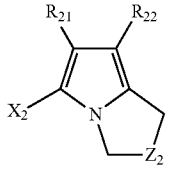

wherein Za represents —NH or $CH(R_{13})$—; Zb and Zc each independently represent —$C(R_{14})$= or —N=; $R_{11}$, $R_{12}$, and $R_{13}$ each independently represent an electron-withdrawing group having a Hammet's substitution constant σp of 0.20 or more, and the sum of op values of $R_{11}$ and $R_{12}$ is 0.65 or more; $R_{14}$ and $R_{21}$ each independently represent a hydrogen atom or a substituent, and when two $R_{14}$ exist, $R_{14}$s may the same or different from each other; $R_{22}$ represents a substituent; $Z_2$ represents a group of non-metallic atoms necessary to form a nitrogen-containing 6-membered heterocycle, and the heterocycle has at least one dissociation group; $X_1$ and $X_2$ each independently represent a hydrogen atom or a group capable of being split-off upon a coupling reaction with an oxidized aromatic primary amine color-developing agent; and wherein the compound capable of forming a dye having absorption in the infrared region is selected from the group consisting of a 2-arylureido-5-acylaminophenol-type cyan coupler capable of forming a dye which causes association or aggregation, and a 1-hydroxy-2-N-(5-alkylthiazol-2-yl)-naphthamide coupler capable of forming an infrared-absorbing quinone imine dye by reaction with an oxidized aromatic primary amino developing agent, wherein said naphthamide coupler bears on the thiazol-2-yl group a 4-para-$C_1$-$C_4$alkoxyphenyl group or a 4-para-$C_1$-$C_4$-alkylphenyl group, the hydrogen atoms of said $C_1$-$C_4$alkoxy or $C_1$-$C_4$alkyl being unsubstituted or at least one of them having been substituted by a halogen atom.

Polymer couplers: P-1 and P-5 (page 11) in JP-A-2-44345.

Soundtrack-forming infrared couplers: couplers described in JP-A-63-143546 and the publications referred to therein.

As couplers allowing the color developed dye to have moderate diffusibility, those described in U.S. Pat. No. 4,366,237, GB 2,125,570, EP 96,873B and DE 3,234,533 are preferable.

As couplers for compensating unnecessary absorption of a color developed dye, preferred are yellow-colored cyan couplers represented by the formula (CI), (CII), (CIII), or (CIV) described on page 5 in EP 456,257A1 (particularly YC-86, on page 84), yellow-colored magenta couplers ExM-7 (page 202), EX-1 (page 249) and Ex-7 (page 251) described in the same EP publication; magenta-colored cyan couplers CC-9 (column 8) and CC-13 (column 10) described in U.S. Pat. No. 4,833,069; (2) (on column 8) of U.S. Pat. No. 4,837,136; and uncolored masking couplers represented by the formula (C-1) described in claim 1 in WO92/11575 (particularly, the exemplified compounds on page 36 to page 45).

As examples of the compound (including a dye-forming coupler) which reacts with an oxidized product of a developing agent to release a photographically useful compound residue, the following compounds are given.

Developing restrainer-releasing compounds: compounds represented by the formula (I), (II), (III), or (IV) described in EP 378,236A1, page 11 (particularly T-101 (page 30), T-104 (page 31), T-113 (page 36), T-131 (page 45), T-144 (page 51) and T-158 (page 58)); compounds represented by the formula (I) in EP 436,938A2, page 7 (particularly, D-49 (page 51)); compounds represented by the formula (1) in JP-A-5-307248 (particularly, (23) in paragraph 0027)); and compounds represented by the formula (I), (II), or (III) in EP 440,195A2, page 5 to page 6 (particularly, 1-(1) on page 29)). Bleaching-accelerator-releasing compounds: compounds represented by the formula (I) or (I') described in EP 310,125A2, page 5 (particularly (60) and (61) on page 61)); and compounds represented by the formula (I) in claim 1 in JP-A-6-59411 (particularly, (7) in paragraph 0022). Ligand-releasing compounds: the compounds represented by the formula LIG-X described in claim 1 in U.S. Pat. No. 4,555,478 (particularly, compounds described in column 12, line 21 to line 41). Leuco dye-releasing compounds: the compounds 1 to 6 in U.S. Pat. No. 4,749,641, columns 3 to 8. Fluorescent dye-releasing compounds: compounds represented by COUP-DYE in claim 1 in U.S. Pat. No. 4,774,181 (particularly compounds 1 to 11 in columns 7 to 10). Development-accelerator- or fogging-agent-releasing compounds: compounds represented by the formula (1), (2) or (3) in U.S. Pat. No. 4,656,123, column 3 (particularly, (1-22) in column 25) and ExZK-2 in EP 450, 637A2, page 75, line 36 to line 38. Compounds releasing a group which becomes a dye for the first time when it is spilt-off: compounds represented by the formula (I) in claim 1 in U.S. Pat. No. 4,857,447 (particularly, Y-1 to Y-19 in columns 25 to 36).

As additives other than the dye-forming couplers, the following ones are preferable.

Dispersion media for an oil-soluble organic compound: P-3, 5, 16, 19, 25, 30, 42, 49, 54, 55, 66, 81, 85, 86 and 93 (page 140 to page 144) in JP-A-62-215272. Latex for impregnation with the oil-soluble organic compound: latex described in U.S. Pat. No. 4,199,363. Scavengers for an oxidized product of a developing agent: compounds represented by the formula (I) in U.S. Pat. No. 4,978,606, column 2, line 54 to line 62 (particularly I-, (1), (2), (6), (12) (columns 4 to 5)), and compounds represented by the formula in U.S. Pat. No. 4,923,787, column 2, line 5 to line 10 (particularly Compound 1 (column 3). Stain preventive agents: compounds represented by one of the formulae (1) to (III) in EP 298321A, page 4, line 30 to line 33 particularly, I-47, 72, III-1, 27 (page 24 to page 48)). Anti-fading agents: A-6, 7, 20, 21, 23, 24, 25, 26, 30, 37, 40, 42, 48, 63, 90, 92, 94, and 164 (page 69 to page 118) in EP298321A, and II-1 to III-23 in U.S. Pat. No. 5,122, 444, columns 25 to 38 (particularly, III-10); I-1 to III-4 in EP 471347A, page 8 to page 12 (particularly, II-2); and A-1 to 48 in U.S. Pat. No. 5,139,931, columns 32 to 40 (particularly A-39 and 42). Materials reducing the amount of a color development-enhancing agent or a color contamination preventive agent to be used: I-1 to II-15 in EP 411324A, page 5 to page 24 (particularly, I-46). Formalin scavengers: SCV-1 to 28 in EP 477932A, page 24 to page 29 (particularly SCV-8). Hardener: H-1, 4, 6, 8, and 14 in JP-A-1-214845 in page 17; compounds (H-1 to H-54) represented by one of the formulae (VII) to (XII) in U.S. Pat. No. 4,618,573, columns 13 to 23; compounds (H-1 to 76) represented by the formula (6) in JP-A-2-214852, page 8, the lower right (particularly, H-14); and compounds described in claim 1 in U.S. Pat. No. 3,325, 287. Precursors of developing restrainers: P-24, 37, 39 (page 6 to page 7) in JP-A-62-168139; and compounds described in claim 1 of U.S. Pat. No. 5,019,492 (particularly 28 to 29 in column 7). Antiseptics and mildew-proofing agents: I-1 to III-43 in U.S. Pat. No. 4,923,790, columns 3 to 15 (particularly II-1, 9, 10, and 18 and III-25). Stabilizers and antifoggants: I-1 to (14) in U.S. Pat. No. 4,923,793, columns 6 to 16 (particularly, I-1, 60, (2) and (13)); and compounds 1 to 65 in U.S. Pat. No. 4,952,483, columns 25 to 32 (particularly, 36). Chemical sensitizers: triphenylphosphine selenide; and compound 50 in JP-A-5-40324. Dyes: a-1 to b-20 in JP-A-3-156450, page 15 to page 18 (particularly, a-1, 12, 18, 27, 35, 36, b-5, and V-1 to 23 on pages 27 to 29, particularly, V-1); F-I-1 to F-II-43 in EP 445627A, page 33 to page 55 (particularly F-I-11 and F-II-8); III-1 to 36 in EP 457153A, page 17 to page 28 (particularly III-1 and 3); microcrystal dispersions represented by Dye-1 to 124 in WO88/04794, 8 to 26; microcrystal dispersions of compounds (I-1) to (IV-51) described in JP-A-2004-37534 (particularly, microcrystal dispersions in which any of these compounds are dispersed by the method described on pages 31 to 35); compounds 1 to 22 in EP319999A, page 6 to page 11 (particularly, compound 1); compounds D-1 to 87 (page 3 to page 28) represented by one of the formulae (1) to (3) in EP 519306A; compounds 1 to 22 (columns 3 to 10) represented by the formula (I) in U.S. Pat. No. 4,268,622; compounds (1) to (31) (columns 2 to 9) represented by the formula (I) in U.S. Pat. No. 4,923,788. UV absorbers: compound (18b) to (18r) and 101 to 427 (page 6 to page 9) represented by the formula (1) in JP-A-46-3335; compounds (3) to (66) (page 10 to page 44) represented by the formula (I) and compounds HBT-1 to HBT-10 (page 14) represented by the formula (III) in EP 520938A; and compounds (1) to (31) (columns 2 to 9) represented by the formula (1) in EP 521823A.

The silver halide color photosensitive material of the present invention can preferably contain a compound having a fluorine atom, in a layer situated farthest from the support on the side having emulsion layers, or in a layer situated farthest from the support on the side having no emulsion layer, or both sides. As the compound used therein, the compounds disclosed in JP-A-2003-114503 are especially suitable.

In the silver halide color photosensitive material of the present invention, the sum of the film thicknesses of all hydrophilic colloidal layers on the side provided with emulsion layers is preferably 28 μm or less, more preferably 23 μm or less, still more preferably 18 μm or less, and particularly preferably 16 μm or less. Additionally, the sum of the film thicknesses is at least 0.1 μm, preferably 1 μm or above, more preferably 5 μm or above.

The film swelling rate $T_{1/2}$ is preferably 60 seconds or less and more preferably 30 seconds or less. $T_{1/2}$ is defined as the time required until the film thickness reaches ½ the saturated film thickness which is 90% of the maximum swelled film thickness attained when the film is processed with a color-developer at 35° C. for 3 minutes. The film thickness means a film thickness measured at 25° C. and a relative humidity of 55% under controlled humid condition (2 days). $T_{1/2}$ can be measured using a swellometer of the type described by A. Green et al. in Photogr. Sci. Eng., Vol. 19, 2, page 124 to page 129. $T_{1/2}$ can be regulated by adding a hardener to a gelatin as a binder, or by changing the condition for the lapse of time after application.

The rate of swelling is preferably 180 to 280% and more preferably 200 to 250%. Here, the rate of swelling means a standard showing the magnitude of equilibrium swelling when the silver halide photosensitive material of the present invention is immersed in 35° C. distilled water to swell the material, and it is given by the following equation:

Rate of swelling(unit:%)=Total film thickness when swelled/Total film thickness when dried×100.

The above rate of swelling can be made to fall in the above range by regulating the amount of a gelatin hardener to be added.

The silver halide color cinematographic photosensitive materials of the present invention can be processed by a simplified process made up of steps remaining after removal of the steps concerned with sound development from the usual development-processing steps as described below. More specifically, the steps of (4) first fixing bath, (5) washing bath, (9) sound development, and (10) washing can be removed from the following process steps. When usual silver halide color cinematographic photosensitive materials undergo such a simplified processing, soundtracks cannot be formed, while the silver halide color cinematographic photosensitive materials of the present invention can form soundtracks by such a simplified process.

Conventional standard processing steps for a positive photosensitive material for cinema (except for a drying process)

(1) Color developing bath
(2) Stop bath
(3) Wash bath
(4) First fixing bath
(5) Wash bath
(6) Bleach-accelerating bath
(7) Bleaching bath
(8) Wash bath
(9) Sound development (coating development)
(10) Wash bath
(11) Second fixing bath
(12) Wash bath
(13) Stabilizing bath In the present invention, preferably in the third embodiment of the present invention, when, among the above process steps, color developing time (the above step (1)) is 2 minutes and 30 seconds or less (the lower limit is preferably 6 seconds or more, more preferably 10 seconds or more, further more preferably 20 seconds or more, and most preferably 30 seconds or more), and more preferably 2 minutes or less (the preferable lower limits are as same as those mentioned for the developing time of 2 minutes and 30 seconds or less), the effects of the present invention are remarkable, and therefore such a developing time is preferable.

The support will be hereinafter explained.

In the present invention, as the support, a transparent support is preferable and a plastic film support is more preferable. Examples of the plastic film support include films, for example, of a polyethylene terephthalate, polyethylene naphthalate, cellulose triacetate, cellulose acetate butylate, cellulose acetate propionate, polycarbonate, polystyrene, or polyethylene.

Among these films, polyethylene terephthalate films are preferable and biaxially oriented (stretched) and thermally fixed polyethylene terephthalate films are particularly preferable in view of stability, toughness, and the like.

The thickness of the support is generally 15 to 500 μm, particularly preferably 40 to 200 μm, in view of handling ability and usability for general purposes, and most preferably 85 to 150 μm, though no particular limitation is imposed on the thickness of the above support.

The transmission type support (transparent support) means those through which 90% or more visible light preferably transmits, and the support may contain silicon, alumina sol, chrome salt, or zirconium salt which are made into a dye, to an extent that it does not substantially inhibit the transmission of light.

The following surface treatment is generally carried out on the surface of the plastic film support, to bond photosensitive layers firmly with the surface. The surface on the side where an antistatic layer (backing layer) is formed is likewise surface-treated in general. Specifically, there are the following two methods:

(1) A method, in which surface activating treatment, such as chemical treatment, mechanical treatment, corona discharge treatment, flame treatment, ultraviolet treatment, high-frequency treatment, glow discharge treatment, activated plasma treatment, laser treatment, mixed acid treatment, or ozone oxygen treatment, is carried out, and then a photographic emulsion (coating solution for the formation of a photosensitive layer) is directly applied, to obtain adhesive force; and (2) A method, in which after the above surface treatment is once carried out, an undercoating layer is formed, and then a photographic emulsion layer is applied onto the undercoating layer.

Among these methods, the method (2) is more effective and hence widely used. These surface treatments each are assumed to have the effects of: forming a polar group in some degree on the surface of the support which is originally hydrophobic, removing a thin layer which gives an adverse effect on the adhesion of the surface, and increasing the crosslinking density of the surface, thereby increasing the adhesive force.

As a result, it is assumed that, for example, the affinity of components contained in a solution of the undercoating layer to the polar group is increased and the fastness of the adhering surface is increased, thereby improving adhesion between the undercoating layer and the surface of the support.

It is preferable that a non-photosensitive layer containing conductive metal oxide particles be formed, on the surface of the above plastic film support on the side provided with no photosensitive layers.

As the binder for the above non-photosensitive layer, an acrylic resin, vinyl resin, polyurethane resin, or polyester resin is preferably used. This non-photosensitive layer is preferably film-hardened. As the hardener, an aziridine-series, triazine-series, vinylsulfone-series, aldehyde-series, cyanoacrylate-series, peptide-series, epoxy-series, or melamine-series compound, or the like is used. Among these, a melamine-series compound is particularly preferable with the view of fixing the conductive metal oxide particles firmly.

Examples of materials used for the conductive metal oxide particles may include ZnO, $TiO_2$, $SnO_2$, $Al_2O_3$, $In_2O_3$, MgO, BaO, $MoO_3$, and $V_2O_5$, composite oxides of these oxides, and metal oxides obtained by adding a different type of atom to each of these metal oxides.

As the metal oxide, $SnO_2$, ZnO, $Al_2O_3$, $TiO_2$, $In_2O_3$, MgO, and $V_2O_5$ are preferable; $SnO_2$, ZnO, $In_2O_3$, $TiO_2$ and $V_2O_5$ are more preferable; and $SnO_2$ and $V_2O_5$ are most preferable.

Examples of the metal oxide containing a small amount of a different type of atom may include those obtained by doping each of these metal oxides with generally 0.01 to 30 mol % (preferably 0.1 to 10 mol %) of a different element, specifically, by doping ZnO with Al or In, $TiO_2$ with Nb or Ta, $In_2O_3$ with Sn, and $SnO_2$ with Sb, Nb, or a halogen atom. When the amount of the different type of element to be added is too small, only insufficient conductivity can be imparted to the oxide or the composite oxide, whereas when the amount is too large, the blackening of the particle is increased, leading to the formation of a blackish antistatic layer. This shows that the oxides containing a different type of element in the amount out of the above range are unsuitable for the photosensitive material. Therefore, as materials of the conductive metal oxide particle, metal oxides or composite oxides containing a mall amount of a different type of element are preferable. Those having an oxygen defect in their respective crystal structure are also preferable.

The conductive metal oxide particles generally have a ratio by volume of 50% or less to the non-photosensitive layer as a whole, and preferably 3 to 30%. The amount of the conductive metal oxide particles to be applied preferably follows the condition described in JP-A-10-62905. When the volume ratio is too large, the surface of the processed color photograph is easily contaminated, whereas when the ratio is too small, the antistatic function is insufficiently performed.

It is more preferable that the particle diameter of the conductive metal oxide particle be as small as possible, to decrease light scattering. However, it must be determined based on, as a parameter, the ratio of the refractive index of the particle to that of the binder, and it can be determined using the Mie's theory. The average particle diameter is generally 0.001 to 0.5 μm and preferably 0.003 to 0.2 μm. The average particle diameter so-called here is a value including not only a primary particle diameter but also a particle diameter of higher-order structure of the conductive metal oxide particles.

When the fine particle of the aforementioned metal oxide is added to a coating solution for forming an antistatic layer, it may be added as it is and then dispersed therein. It is also preferable to add the fine particle in the form of a dispersion solution in which the fine particle is dispersed in a solvent such as water (a dispersant and a binder may be added according to the need).

The non-photosensitive layer preferably contains the above hardened product of the above binder and a hardener, which product functions as the binder agent used to disperse and support the conductive metal oxide particle. In the present invention, it is preferable that both of the binder and the hardener which are soluble in water or in the state of an aqueous dispersion, such as an emulsion, be used with the view of maintaining a better working environment and preventing air pollution. Also, the binder preferably has any group among a methylol group, hydroxyl group, carboxyl group, and glycidyl group, to enable a crosslinking reaction with the hardener. A hydroxyl group and carboxyl group are preferable and a carboxyl group is particularly preferable. The content of the hydroxyl or carboxyl group in the binder is preferably 0.0001 to 1 equivalent/1 kg and particularly preferably 0.001 to 1 equivalent/1 kg.

Preferable resins usable as the binder will be hereinafter explained.

Examples of acrylic resins may include homopolymers of any one monomer of acrylic acids, acrylates (such as alkyl acrylates), acrylamides, acrylonitriles, methacrylic acids, methacrylates (such as alkyl methacrylates), methacrylamides, and methacrylonitriles; and copolymers obtained by polymerizing two or more of these monomers. Among these polymers or copolymers, preferred are homopolymers of any one monomer of acrylates, such as alkyl acrylates, and methacrylates, such as alkyl methacrylates, or copolymers obtained by polymerization of two or more of these monomers. Examples of these homopolymers or copolymers may include homopolymers of any one monomer of acrylates and methacrylates having an alkyl group having 1 to 6 carbon atoms, or copolymers obtained by the polymerization of two or more of these monomers.

The above acrylic resin is preferably a polymer obtained by using the above composition as its major components and by partially using a monomer having any group of, for example, a methylol group, hydroxyl group, carboxyl group, and glycidyl group, so as to enable a crosslinking reaction with the hardener.

Preferable examples of the above vinyl resin include a polyvinyl alcohol, acid-denatured polyvinyl alcohol, polyvinyl formal, polyvinyl butyral, polyvinyl methyl ether, polyolefin, ethylene/butadiene copolymer, polyvinyl acetate, vinyl chloride/vinyl acetate copolymer, vinyl chloride/(meth) acrylate copolymer, and ethylene/vinyl acetate-series copolymer (preferably an ethylene/vinyl acetate/(meth)acrylate copolymer). Among these, a polyvinyl alcohol, acid-denatured polyvinyl alcohol, polyvinyl formal, polyolefin, ethylene/butadiene copolymer and ethylene/vinyl acetate-series copolymer (preferably an ethylene/vinyl acetate/acrylate copolymer) are preferable.

Generally, in order for the above vinyl resin to be able to crosslink with the hardener, a polyvinyl alcohol, acid-denatured polyvinyl alcohol, polyvinyl formal, polyvinyl butyral, polyvinyl methyl ether, and polyvinyl acetate are respectively formed as a polymer having a hydroxyl group by, for example, leaving a vinyl alcohol unit in the polymer; and other polymers are respectively formed by partially using a monomer having any one group, for example, of a methylol group, hydroxyl group, carboxyl group, and glycidyl group.

Examples of the above polyurethane resin may include polyurethanes derived from any one of a polyhydroxy compound (e.g., ethylene glycol, propylene glycol, glycerol and trimethylol propane); an aliphatic polyester-series polyol obtained by a reaction between a polyhydroxy compound and a polybasic acid; a polyether polyol (e.g., poly(oxypropylene ether)polyol, poly(oxyethylene-propylene ether) polyol); a polycarbonate-series polyol, and a polyethylene terephthalate polyol; or those derived from a polyisocyanate and a mixture of the above. In the case of the above polyurethane resin, for instance, a hydroxyl group that is left unreacted after the reaction between the polyol and the polyisocyanate is completed, may be utilized as a functional group which can run a crosslinking reaction with the hardener.

As the above polyester resin, polymers obtained by a reaction between a polyhydroxy compound (e.g., ethylene glycol, propylene glycol, glycerol and trimethylolpropane) and a polybasic acid are generally used. In the case of the above polyester resin, for instance, a hydroxyl group or carboxyl group that is left unreacted after the reaction between the polyol and the polybasic acid is completed, may be utilized as a functional group which can run a crosslinking reaction with the hardener. Of course, a third component having a functional group such as a hydroxyl group may be added.

Among the above polymers, acrylic resins and polyurethane resins are preferable and acrylic resins are particularly preferable.

Examples of the melamine compound preferably used as the hardener include compounds having two or more (preferably three or more) methylol groups and/or alkoxymethyl groups in a melamine molecule, melamine resins which are condensation polymers of the above compounds, and melamine/urea resins. Examples of initial condensation products of melamine and formalin include, though not limited to, dimethylolmelamine, trimethylolmelamine, tetramethylolmelamine, pentamethylolmelamine, and hexamethylolmelamine. Specific examples of commercially available products of these compounds may include, though not limited to, Sumitex Resins M-3, MW, MK, and MC (trade names, manufactured by Sumitomo Chemical Co., Ltd.).

Examples of the above condensation polymer may include, though not limited to, a hexamethylolmelamine resin, trimethylolmelamine resin, and trimethyloltrimethoxymethylmelamine resin. Examples of commercially available products may include, though not limited to, MA-1 and MA-204 (trade names, manufactured by Sumitomo Bakelite), BECKAMINE MA-S, BECKAMINE APM, and BECKAMINE J-101 (trade names, manufactured by Dainippon Ink and Chemicals Inc.), Yuroid 344 (trade name, manufactured by Mitsui Toatsu Chemicals) and Oshika Resin M31 and Oshika Resin PWP-8 (trade names, manufactured by Oshika Shinko Co., Ltd.).

As the melamine compound, it is preferable that the functional group equivalence given by a value obtained by dividing its molecular weight by the number of functional groups in one molecule be 50 or more and 300 or less. Here, the functional group indicates a methylol group and/or an alkoxymethyl group. If this functional group equivalence is too large, only small cured density is obtained and hence high mechanical strength is not obtained in some cases. Then, if the amount of the melamine compound is increased, the coatability is reduced. When the cured density is small, scratches tend to be caused. Also, if the level of curing is low, the force supporting the conductive metal oxide is also reduced. When the functional group equivalence is too small, the cured density is increased but the transparency is impaired and even if the amount of the melamine compound is reduced, the condition is not bettered in some cases. The amount of an aqueous melamine compound to be added is generally 0.1 to 100 mass % and preferably 10 to 90 mass %, to the aforementioned polymer.

Matt agents, surfactants, lubricants, and the like may further be used in the antistatic layer, according to the need.

Examples of the matt agent include oxides, such as silicon oxide, aluminum oxide, and magnesium oxide, and polymers and copolymers, such as a poly(methyl methacrylate) and polystyrene, each having a particle diameter of 0.001 to 10 μm.

Given as examples of the surfactant are known surfactants, such as anionic surfactants, cationic surfactants, amphoteric surfactants, and nonionic surfactants.

Examples of the lubricants may include phosphates of higher alcohols having 8 to 22 carbon atoms or their amino salts; palmitic acid, stearic acid and behenic acid, and their esters; and silicone-series compounds.

The thickness of the aforementioned antistatic layer is preferably 0.01 to 1 μm and more preferably 0.01 to 0.2 μm. When the thickness is too thin, coating unevenness tends to be caused on the resultant product since it is hard to apply a coating material uniformly. On the other hand, when the thickness is too thick, there is the case where inferior antistatic ability and resistance to scratching are obtained. It is preferable to dispose a surface layer on the above antistatic layer. The surface layer is provided primarily to improve lubricity and resistance to scratching, as well as to aid the ability to prevent the conductive metal oxide particles of the antistatic layer from desorbing.

Examples of materials for the above surface layer include (1) waxes, resins and rubber-like products, comprising homopolymers or copolymers of 1-olefin-series unsaturated hydrocarbons, such as ethylene, propylene, 1-butene and 4-methyl-1-pentene (e.g., a polyethylene, polypropylene, poly-1-butene, poly-4-methyl-1-pentene, ethylene/propylene copolymer, ethylene/1-butene copolymer and propylene/1-butene copolymer); (2) rubber-like copolymers of two or more types of the above 1-olefin and a conjugated or non-conjugated diene (e.g., an ethylene/propylene/ethylidene norbornane copolymer, ethylene/propylene/1,5-hexadiene copolymer and isobutene/isoprene copolymer); (3) copolymers of a 1-olefin and a conjugated or non-conjugated diene (e.g., an ethylene/butadiene copolymer and ethylene/ethylidene norbornane copolymer); (4) copolymers of a 1-olefin, particularly, ethylene and vinyl acetate; and completely or partly saponified products of these copolymers; and (5) graft polymers obtained by grafting the above conjugated or non-conjugated diene or vinyl acetate on a homopolymer or copolymer of a 1-olefin; and completely or partly saponified products of these graft polymers. However, the materials for the surface layer are not limited to these compounds. The aforementioned compounds are described in JP-B-5-41656 ("JP-B" means examined Japanese patent publication).

Among these compounds, those which are polyolefins and having a carboxyl group and/or a carboxylate group are preferable. These compounds are generally used in the form of an aqueous solution or a water dispersion solution.

A water-soluble methyl cellulose of which the degree of methyl group substitution is 2.5 or less may be added in the surface layer, and the amount of the methyl cellulose to be added is preferably 0.1 to 40 mass % to the total binding agents forming the surface layer. The above water-soluble methyl cellulose is described in JP-A-1-210947.

The above surface layer may be formed by applying a coating solution (aqueous dispersion or aqueous solution) containing the aforementioned binder and the like, onto the antistatic layer, by using a generally well-known coating method, such as a dip coating method, air knife coating method, curtain coating method, wire bar coating method, gravure coating method or extrusion coating method.

The thickness of the above surface layer is preferably 0.01 to 1 μm and more preferably 0.01 to 0.2 μm. When the thickness is too thin, coating unevenness of the product tends to be caused because it is hard to apply the coating material uniformly. When the thickness is too thick, there is the case where the antistatic ability and resistance to scratching are inferior.

The pH of a coating in the silver halide color photosensitive material of the present invention is preferably 4.6 to 6.4 and more preferably 5.5 to 6.5. When the pH of the coating is too high, in a sample long under the lapse of time, a cyan image and a magenta image are greatly sensitized by irradiation with safelight. On the contrary, when the pH of the coating is too low, the density of a yellow image largely changes with a change in the time elapsing since the photosensitive material is exposed until it is developed. Either of the cases poses practical problems.

The pH of the coating in the silver halide color photosensitive material of the present invention means the pH of all photographic layers obtained by applying respective coating solutions to the support, and it does not always coincide with the pH of the individual coating solution. The pH of the coating can be measured by the following method as described in JP-A-61-245153. Specifically, (1) 0.05 ml of pure water is added dropwise to the surface of the photosensitive material on the side to which silver halide emulsions are applied, and then (2) after the coating is allowed to stand for 3 minutes, the pH of the coating is measured using a surface pH measuring electrode (GS-165F, trade name, manufactured by Towa Denpa). The pH of the coating can be adjusted using an acid (e.g., sulfuric acid or citric acid) or an alkali (e.g., sodium hydroxide or potassium hydroxide), if necessary.

The present invention will be described in more detail based on the following examples, but the invention is not intended to be limited thereto.

EXAMPLES

Example 1-1

Preparation of Blue-Sensitive Layer Emulsion BH-1

Using a method of simultaneously adding silver nitrate, sodium chloride, and potassium bromide (0.5 mol % per mol of the finished silver halide) mixed into stirring deionized distilled water containing deionized gelatin, high silver chloride cubic grains were prepared. In this preparation, at the step of from 65% to 80% addition of the entire silver nitrate amount, $K_2[IrCl_5(5\text{-methylthiazole})]$ was added. At the step of from 82% to 90% addition of the entire silver nitrate amount, $K_4[Fe(CN)_6]$ was added. Further, $K_2[IrCl_5(H_2O)]$ and $K[IrCl_4(H_2O)_2]$ were added at the step of from 83% to 89% addition of the entire silver nitrate amount. Potassium iodide (0.27 mol % per mol of the finished silver halide) was added, with vigorous stirring, at the step of completion of 94% addition of the entire silver nitrate amount. The thus-obtained emulsion grains were monodisperse cubic silver bromochloride grains having a side length of 0.50 μm, a variation coefficient of 8.6%, and silver chloride content of 97 mol %. After being subjected to a sedimentation desalting treatment, the following were added to the resulting emulsion: gelatin, Compounds Ab-1, Ab-2, and Ab-3, and calcium nitrate, and then the emulsion was re-dispersed.

The re-dispersed emulsion was dissolved at 45° C., and Sensitizing dye S-1, Sensitizing dye S-2, and Sensitizing dye S-3 were added for optimal spectral sensitization. Then, the resulting emulsion was ripened by adding sodium benzene thiosulfate, triethylthiourea as a sulfur sensitizer, and Compound-1 as a gold sensitizer, for optimal chemical sensitization. Further, 1-(5-acetamidophenyl)-5-mercaptotetrazole; a mixture whose major components are compounds represented by Compound 2 in which the repeating unit (n) is 2 or 3 (both ends $X_1$ and $X_2$ are each a hydroxyl group); Compound 3; and potassium bromide were added, to finalize chemical sensitization. The thus-obtained emulsion was referred to as Emulsion BH-1.

(Ab-1)

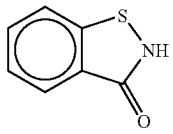

Antiseptic (Ab-2)

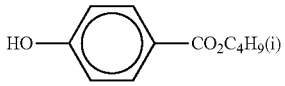

Antiseptic (Ab-3)

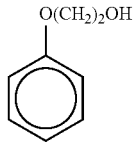

Antiseptic (Ab-4)

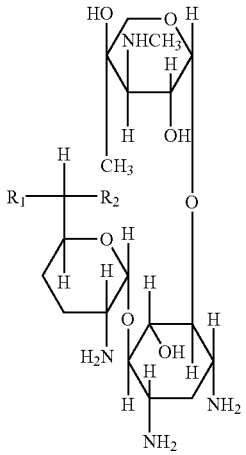

Antiseptic

A mixture in 1:1:1:1 (mol ratio) of a, b, c, and d

| | $R_1$ | $R_2$ |
|---|---|---|
| a | —$CH_3$ | —$NHCH_3$ |
| b | —$CH_3$ | —$NH_2$ |

-continued

| | | |
|---|---|---|
| c | —H | —$NH_2$ |
| d | —H | —$NHCH_3$ |

Sensitizing dye S-1

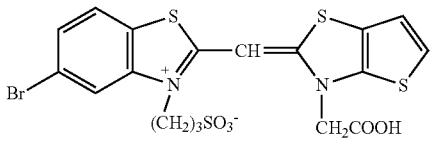

Sensitizing dye S-2

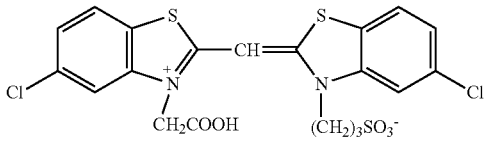

Sensitizing dye S-3

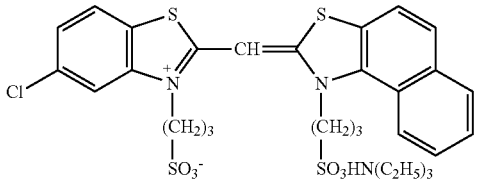

Compound-1

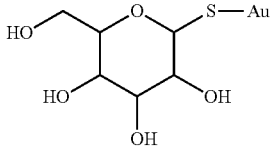

Compound-2

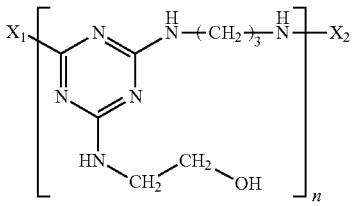

Compound-3

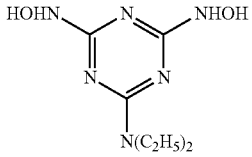

(Preparation of Blue-Sensitive Layer Emulsion BM-1)

Emulsion grains were prepared in the same manner as in the preparation of Emulsion BH-1, except that the temperature and the addition rate at the step of mixing the silver nitrate, sodium chloride, and potassium bromide (0.5 mol % per mol of the finished silver halide) by simultaneous addition were changed, and the amounts of respective metal complexes that were to be added during the addition of silver nitrate, sodium chloride, and potassium bromide were changed. The thus-obtained emulsion grains were monodisperse cubic silver iodobromochloride grains having a side length of 0.41 μm, a variation coefficient of 9.7% and silver chloride content of 97 mol %. After re-dispersion of this emulsion, Emulsion BM-1 was prepared in the same manner as Emulsion BH-1, except that the amounts of the compounds added in the preparation of BH-1 were changed so as to become the same amounts per unit area as those in Emulsion BH-1.

(Preparation of Blue-Sensitive Emulsion BL-1)

Emulsion grains were prepared in the same manner as in the preparation of Emulsion BH-1, except that the temperature and the addition rate at the step of mixing the silver nitrate, sodium chloride, and potassium bromide (0.5 mol % per mol of the finished silver halide) by simultaneous addition were changed, and the amounts of respective metal complexes that were to be added during the addition of silver nitrate, sodium chloride, and potassium bromide were changed. The thus-obtained emulsion grains were monodisperse cubic silver iodobromochloride grains having a side length of 0.29 μm, a variation coefficient of 9.4% and silver chloride content of 97 mol %. After re-dispersion of this emulsion, Emulsion BL-1 was prepared in the same manner as Emulsion BH-1, except that the amounts of the compounds added in the preparation of BH-1 were changed so as to become the same amounts per unit area as those in Emulsion BH-1.

When Emulsions BH-1, BM-1, and BL-1 were each checked on the in-grain iodide profile in accordance with the method described in "DISCLOSURE OF INVENTION" section, it was verified that the iodide ion concentrations thereof had their maxima at individual grain surfaces and decreased gradually towards the interior of the grains.

(Preparation of Blue-Sensitive-Layer Emulsions BH-2, BM-2, and BL-2 for Comparison)

Blue-sensitive-layer emulsions BH-2, BM-2, and BL-2 were prepared in the same manners as Emulsions BH-1, BM-1, and BL-1, respectively, except that the potassium iodide used at the time of grain formation was replaced with the equimolar amount of sodium chloride. The grain size, the variation coefficient, and the silver chloride content of the resultant emulsions were equivalent to those of BH-1, BM-1, and BL-1, respectively.

(Preparation of Blue-Sensitive-Layer Emulsion BH-3 for Comparison)

To 1.08 liter of deionized distilled water containing 5.6 mass % of deionized gelatin placed in a reaction vessel, 46.4 mL of a 10% NaCl solution was added, and further 46.4 mL of $H_2SO_4$ (1N) was added, and then 0.0125 g of Compound X was added. The temperature of the admixture obtained was adjusted to 62° C., and immediately thereafter 0.1 mole of silver nitrate and 0.1 mole of NaCl were added to the reaction vessel over a 14-minute period with stirring at a high speed. Subsequently thereto, 1.5 moles of silver nitrate and a NaCl solution were further added over a 55-minute period at a flow rate increased so that the final addition speed reached 4 times larger than the initial addition speed. Then, 0.2 mole % of silver nitrate and a NaCl solution were added at a constant flow rate over a 7-minute period. To the NaCl solution used herein, $K_3IrCl_5(H_2O)$ was added in an amount corresponding to $8\times10^{-7}$ mole on a basis of the total silver amount, thereby doping grains with aquated iridium.

Further, 0.2 mole of silver nitrate, a solution containing 0.18 mole of NaCl, and 0.02 mole of KBr were added over a 12-minute period. At that time, $K_4Ru(CN)_6$ and $K_4Fe(CN)_6$ were each dissolved into the aqueous halide solution in an amount corresponding to $0.65\times10^{-5}$ mole on a basis of the total silver amount, and thereby they were added to silver halide grains. Thereafter, the reaction vessel was adjusted to 40° C., and thereto Compound Y as a precipitant was added.

Then the pH of the resulting emulsion was adjusted to around 3.5, followed by desalting and washing.

Compound X

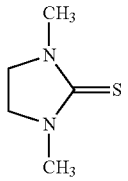

Compound Y

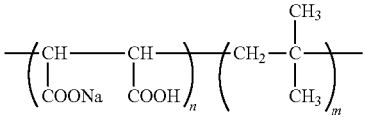

n and m each are an integer.

To the thus-desalted-and-washed emulsion, deionized gelatin, an aqueous NaCl solution, and an aqueous NaOH solution were added. The resultant mixture was heated up to 50° C. and adjusted to pAg 7.6 and pH 5.7. Thus was obtained silver halide cubic grains having a halide composition composed of 98.9 mole % silver chloride, 1 mole % silver bromide, and 0.1 mole % silver iodide; an average side length of 0.80 μm, and a variation coefficient of 10% with respect to the side length.

The emulsion grains thus formed was kept at 60° C., and, thereto, the following Spectral sensitizing dye-1 and Spectral sensitizing dye-2 were added in amounts of $2.5\times10^{-4}$ mole/mole silver and $2.3\times10^{-4}$ mole/mole silver, respectively. Further thereto, the following Thiosulfonic acid compound 1 was added in an amount of $1.6\times10^{-5}$ mole/mole silver, and further was added a fine-grain emulsion doped with iridium hexachloride, having an average grain diameter of 0.05 μm and a halide composition composed of 90 mole % silver bromide and 10 mole % silver chloride. The resulting emulsion was ripened for 15 minutes. Further, fine grains having an average grain diameter of 0.05 μm and a halide composition composed of 40 mole % silver bromide and 60 mole % silver chloride were added thereto, and the resulting emulsion was ripened for 15 minutes. Thus, the fine grains were dissolved, and the silver bromide content in the host cubic grains was increased to 0.013 mole/mole silver. Also, the resulting emulsion was doped with $1\times10^{-7}$ mole/mole silver of iridium hexachloride.

Subsequently, the emulsion was admixed with $1\times10^{-5}$ mole/mole silver of sodium thiosulfate and $2\times10^{-5}$ mole/mole silver of Gold sensitizer-1, and immediately thereafter the mixture was heated up to 60° C., followed by 40-minute ripening. Then, the temperature of the resulting emulsion was lowered to 50° C., and immediately thereafter Mercapto compound 1 and Mercapto compound 2 were each added in an amount of $6.2\times10^{-4}$ mole/mole silver. Then, after ripening for 10 minutes, a KBr aqueous solution was added in an amount of 0.009 mole on a basis of the total silver amount, and then, the mixture was ripened for 10 minutes, and cooled. The emulsion thus obtained was stored. In the manner described above, an emulsion on the high-speed layer side (high-sensitivity emulsion), Emulsion BH-3, having silver chloride content of 97.8 mol %, was prepared.

Spectral sensitizing dye-1

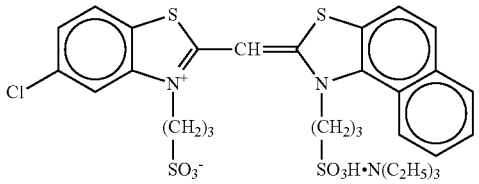

Spectral sensitizing dye-2

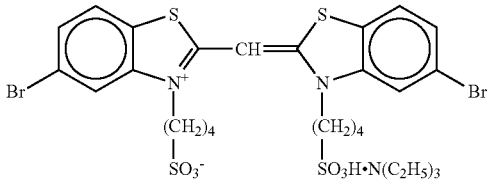

Thiosulfonic acid compound-1

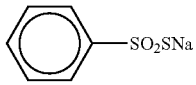

Mercapto compound-1

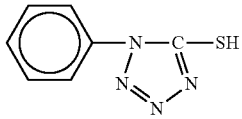

Mercapto compound-2

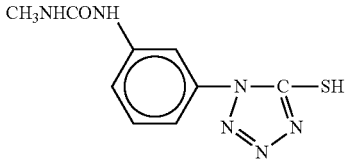

Gold sensitizer-1

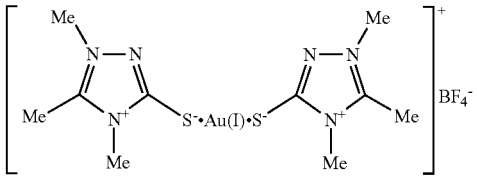

(Preparation of Blue-Sensitive Layer Emulsion BL-3 for Comparison)

Cubic grains having an average side length of 0.52 μm and a variation coefficient of 9.5% with respect to the side length were formed in the same manner as the preparation method of Emulsion BH-3, except that the temperature during the grain formation was changed to 55° C. Spectral sensitization and chemical sensitization of the cubic grains obtained were carried out using the same sensitizers in amounts corrected for specific area (from the side length ratio of 0.8/0.52=1.54). Thus, an emulsion on the low-speed layer side (low-sensitivity emulsion), Emulsion BL-3, having a silver halide content of 97.8 mol % was prepared.

(Preparation of Red-Sensitive Silver Halide Emulsion Grains)

Three types of cubic emulsion grains of silver chlorobromide emulsions (Br/Cl ratio=8/92), namely large-size emulsion grains R11 having an average grain size of 0.23 μm and a variation coefficient of 0.11 with respect to grain size distribution, medium-size emulsion grains R21 having an average grain size of 0.173 μm and a variation coefficient of 0.12 with respect to the grain size distribution, and small-size emulsion grains R31 having an average grain size of 0.120 μm and a variation coefficient of 0.13 with respect to the grain size distribution, were prepared by adding a mixture of silver nitrate, sodium chloride, and potassium bromide in accordance with the controlled-double-jet method well known in the art. Further, each of these emulsions was adjusted so as to have an iridium content of $3\times10^{-7}$ mole per silver. To the large-size emulsion grains R11, the medium-size emulsion grains R21, and the small-size emulsion grains R31, Red-sensitive sensitizing dye (D) illustrated below was added in the amounts of $2.2\times10^{-5}$ mole/mole silver, $3.1\times10^{-5}$ mole/mole silver and $4.2\times10^{-5}$ mole/mole silver, respectively; and Sensitizing dye E) illustrated below was further added in the amounts of $1.8\times10^{-5}$ mole/mole silver, $2.3\times10^{-5}$ mole/mole silver, and $3.6\times10^{-5}$ mole/mole silver, respectively; Sensitizing dye (F) illustrated below was further added in the amounts of $0.9\times10^{-5}$ mole/mole silver, $1.5\times10^{-5}$ mole/mole silver, and $2.0\times10^{-5}$ mole/mole silver, respectively. These emulsions were each chemically ripened to the optimum by addition of a sulfur sensitizer and a gold sensitizer. Furthermore, Compound 1 illustrated below was added to the silver halide emulsion grains R11, the silver halide emulsion grains R21, and the silver halide emulsion grains R31 in the amounts of $9.0\times10^{-4}$ mole, $1.0\times10^{-3}$ mole, and $1.4\times10^{-3}$ mole, respectively, per mole of silver.

Sensitizing dye (D)

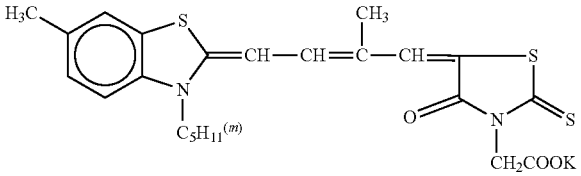

Sensitizing dye (E)

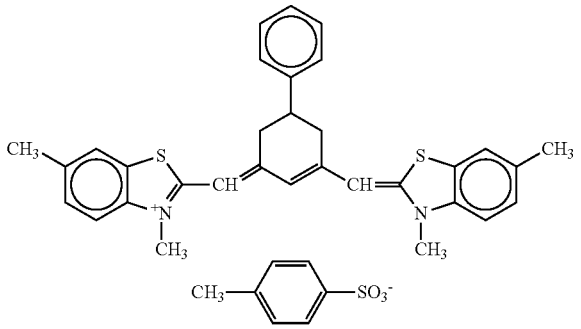

Sensitizing dye (F)

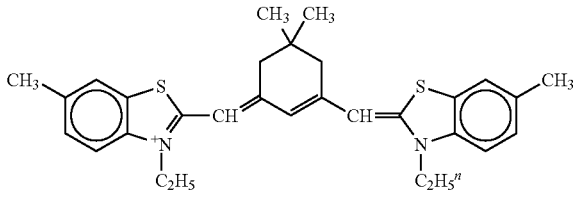

-continued (Compound 1)

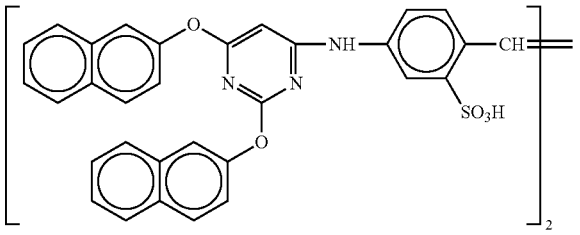

(Preparation of Green-Sensitive Silver Halide Emulsion Grains)

Three types of cubic emulsion grains of silver chlorobromide emulsions (Br/Cl ratio=3/97) were prepared, which were specifically large-size emulsion grains G11 having an average grain size of 0.20 μm and a variation coefficient of 0.12 with respect to grain size distribution, medium-size emulsion grains G21 having an average grain size of 0.144 μm and a variation coefficient of 0.12 with respect to the grain size distribution, and small-size emulsion grains G31 having an average grain size of 0.104 μm and a variation coefficient of 0.11 with respect to the grain size distribution. Further, each of these emulsions was adjusted so as to have an iridium content of $3.3\times10^{-7}$ mole per silver. To G11, G21, and G31, Green-sensitive sensitizing dye (G) illustrated below was added in the amounts of $2.2\times10^{-4}$ mole/mole silver, $3.1\times10^{-4}$ mole/mole silver, and $3.3\times10^{-4}$ mole/mole silver, respectively; Sensitizing dye (H) illustrated below was added in the amounts of $0.9\times10^{-4}$ mole/mole silver, $1.35\times10^{-4}$ mole/mole silver, and $1.75\times10^{-4}$ mole/mole silver, respectively; Sensitizing dye (I) illustrated below was added in the amounts of $1.3\times10^{-4}$ mole/mole silver, $1.4\times10^{-4}$ mole/mole silver, and $1.8\times10^{-4}$ mole/mole silver, respectively; and Sensitizing dye (J) illustrated below was added in the amounts of $0.35\times10^{-4}$ mole/mole silver, $0.65\times10^{-4}$ mole/mole silver, and $0.88\times10^{-4}$ mole/mole silver, respectively. These emulsions were each chemically ripened to the optimum by addition of a sulfur sensitizer and a gold sensitizer.

Sensitizing dye (G)

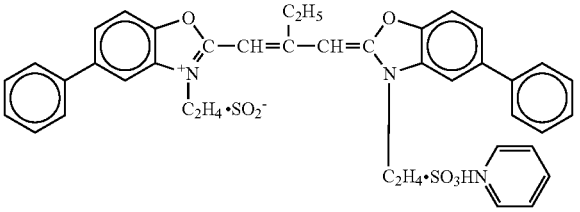

Sensitizing dye (H)

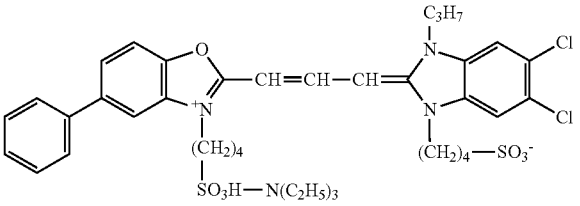

-continued

Sensitizing dye (I)

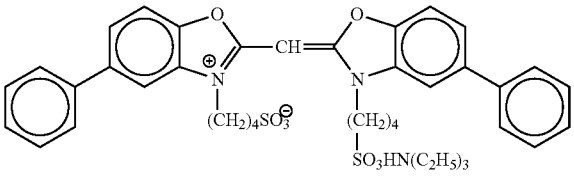

Sensitizing dye (J)

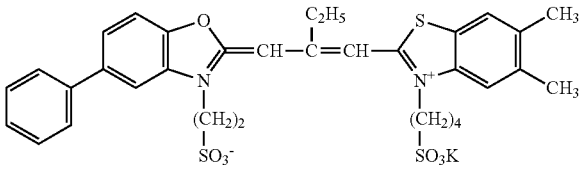

(Preparation of Silver Halide Emulsion Grains for Layer Containing Infrared-Absorbing-Dye-Forming Coupler)

Three types of cubic emulsion grains of silver chlorobromide emulsions (Br/Cl ratio=10/90), namely large-size emulsion grains SH-1 having an average grain size of 0.30 μm and a variation coefficient of 0.09 with respect to grain size distribution, medium-size emulsion grains SM-1 having an average grain size of 0.23 μm and a variation coefficient of 0.10 with respect to the grain size distribution, and small-size emulsion grains SL-1 having an average grain size of 0.15 μm and a variation coefficient of 0.12 with respect to the grain size distribution, were prepared by adding a mixture of silver nitrate, sodium chloride, and potassium bromide in accordance with the controlled-double-jet method well known in the art. Further, each of these emulsions was adjusted so as to have an iridium content of $3.5\times10^{-7}$ mole per silver. These emulsion grains were chemically ripened to the optimum by addition of a sulfur sensitizer and a gold sensitizer. Further, Compound 1 illustrated above was added to the silver halide emulsion grains SH-1, SM-1, and SL-1 in the amounts of $9.2\times10^{-4}$ mole, $1.1\times10^{-3}$ mole, and $1.35\times10^{-3}$ mole, respectively, per mole of silver.

(Preparation of Emulsified Dispersion Y for a Yellow-Color-Forming Layer)

Materials of the following formulation were dissolved and mixed together, and the resultant mixture was then emulsified and dispersed in 1000 g of an aqueous 10% gelatin solution containing 80 ml of 10% sodium dodecylbenzenesulfonate, to prepare Emulsified dispersion Y.

| | |
|---|---|
| Yellow coupler (ExY) | 116.0 g |
| Additive 1 | 8.9 g |
| Additive 2 | 9.5 g |
| Additive 3 | 4.8 g |
| Additive 4 | 11.0 g |
| Solvent 1 | 74.0 g |
| Solvent 2 | 43.0 g |
| Solvent 3 | 8.0 g |
| Solvent 4 | 5.0 g |
| Ethyl acetate | 150.0 ml |

ExY A mixture in 80:10:10 (mol ratio) of (1)/(2)/(3)

(1)

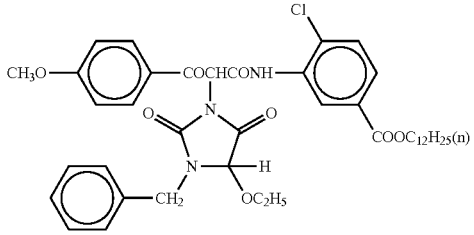

(2)

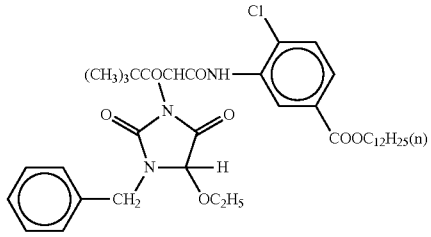

(3)

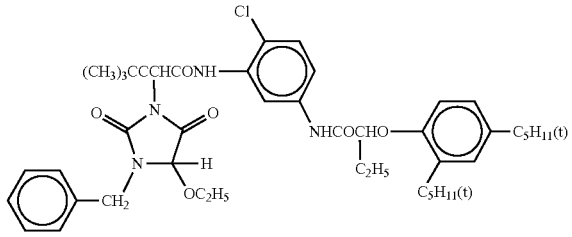

(Additive 1) A mixture in 2:1:7 (Mass ratio) of (1)/(2)/(3)

(1)

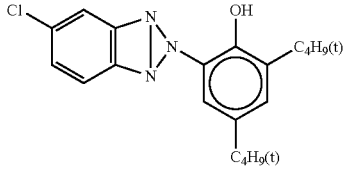

(2)

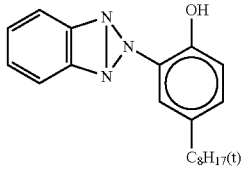

(3)

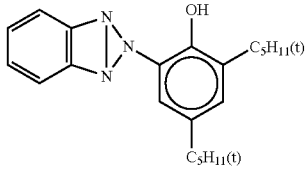

(Additive 2)

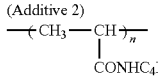

Average molecular weight about 60,000

-continued (Additive 3)

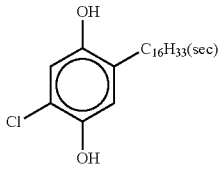

(Additive 4)

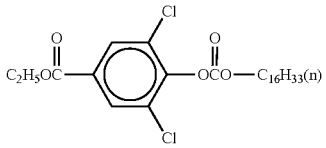

(Solvent 1)

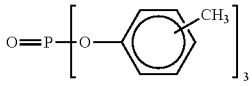

(Solvent 2)

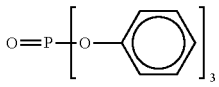

(Solvent 3)

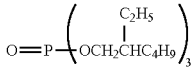

(Solvent 4)

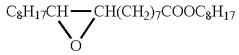

(Preparation of Emulsified Dispersion M for Magenta-Color-Forming Layer, and an Emulsified Dispersion C for Cyan-Color-Forming Layer)

Emulsified dispersion M for magenta-color-forming layer and Emulsified dispersion C for cyan-color-forming layer were prepared in the same manner as in the preparation of Emulsified dispersion Y, except that the aforementioned yellow coupler (E×Y) was changed to the magenta coupler (E×M) and the cyan coupler (E×C), respectively.

(ExM)

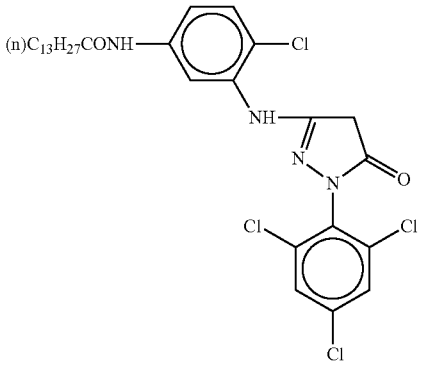

(ExC) A mixture in 40:40:20 (mol ratio) of (1)/(2)/(3)

(1)

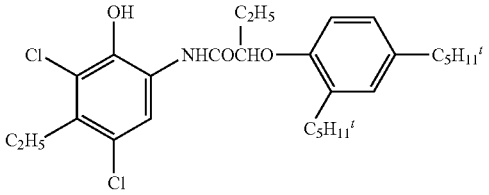

-continued (2)

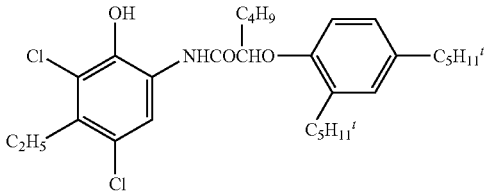

(3)

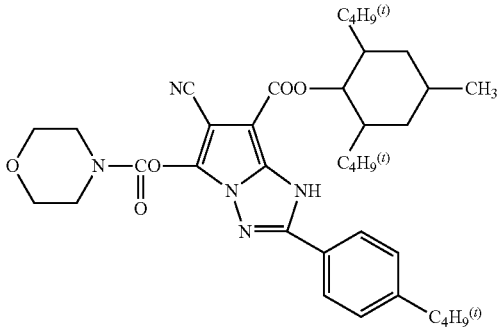

(Preparation of Emulsified Dispersion S for Photosensitive Layer Containing Infrared-Absorbing-Dye-Forming Coupler)

Materials of the following formulation were dissolved and mixed together, and the resultant mixture was then emulsified and dispersed in 1000 g of an aqueous 10% gelatin solution containing 40 ml of 10% sodium dodecylbenzenesulfonate, to prepare Emulsified dispersion S.

| | |
|---|---|
| Infrared-absorbing-dye-forming coupler (ExIR-1) | 81 g |
| Solvent 1 (Solv-23) | 10 g |
| Solvent 2 (Solv-25) | 40 g |
| Ethyl acetate | 100 ml |

(ExIR-1)

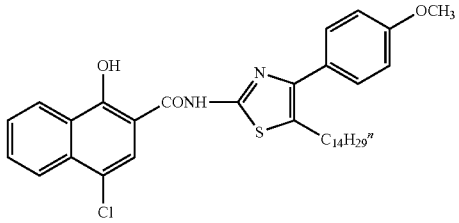

(Solv-23)

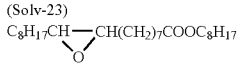

(Solv-25)

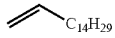

(Preparation of Dispersion a of Solid Fine Particles of Dye)

A methanol wet cake of Dye 1 shown below was weighed such that the net amount of the compound was 240 g, and 48 g of the compound 2 shown below, as a dispersing aid, was weighed. To the mixture of both compounds was added water such that the total amount was 4000 g. The resultant mixture was crushed, by using "a flow system sand grinder mill (UVM-2)" (trade name, manufactured by AIMEX K.K.) filled with 1.71 of zirconia beads (diameter: 0.5 mm) at a discharge rate of 0.5 l/min and a peripheral velocity of 10 m/s for 2 hours. Then, the dispersion was diluted such that the concentration of the compound was 3 mass %. After that, heat treatment was performed at 90° C. for 10 hours. Thus the preparation of Dispersion A was finished in this manner. The average particle size of this dispersion was 0.45 μm.

Dye 1

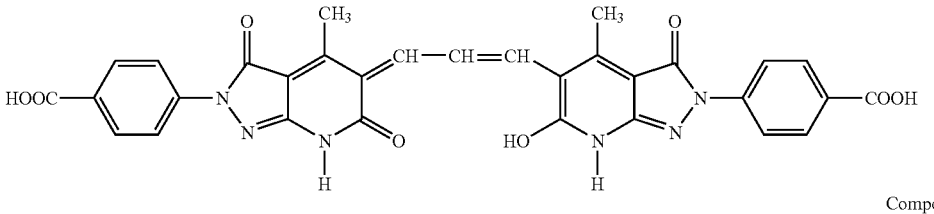

Compound 2

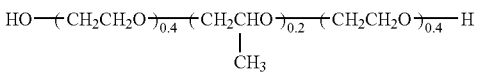

Average molecular weight 11400

(Preparation of Coating Solution for Yellow-Color-Forming Emulsion Layer)

Coating solutions for yellow-color-forming emulsion layers were prepared using the three types of blue-sensitive emulsions at blending ratios expressed in terms of silver content by mole, which are shown in Table 1, and adding thereto other ingredients mixed and dissolved in the proportions described below. The unit of each figure shown below is $g/m^2$. The coating amount of each emulsion is expressed on a silver basis. The yellow coupler was used in the form of Dispersion Y, and the figure corresponding thereto designates the using amount of the coupler.

| | |
|---|---|
| Silver halide emulsion | 0.49 |
| Yellow coupler (ExY) | 1.16 |
| Gelatin | 2.00 |
| Compound 3 | 0.0005 |
| Compound 4 | 0.04 |
| Compound 5 | 0.07 |

(Compound 3)

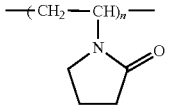

(Compound 4)

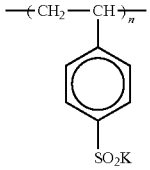

(Compound 5)

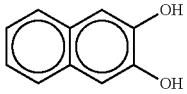

(Preparation of Coating Solution for Magenta-Color-Forming Emulsion) Layer

As in the case of each coating solutions for yellow-color-forming emulsion layer, a magenta-color-forming emulsion layer was formed from the composition in which the following emulsions and the ingredients were mixed and dissolved. The mixing ratio of the green-sensitive silver halide emulsions was 1:3:6 based on silver by mole. The magenta coupler was used in the form of Dispersion M, and the figure corresponding thereto designates the using amount the coupler.

| | |
|---|---|
| Green-sensitive silver halide emulsions G11:G21:G31 | 0.55 |
| Magenta coupler | 0.69 |
| Gelatin | 1.18 |

(Preparation of Coating Solution for Cyan-Color-Forming Emulsion Layer)

As in the case of each coating solutions for yellow-color-forming emulsion layer, a cyan-color-forming emulsion layer was formed from the composition in which the following emulsions and the ingredients were mixed and dissolved. The mixing ratio of the red-sensitive silver halide emulsions was 2:3:5 based on silver by mole. The cyan coupler was used in the form of Dispersion C, and the figure corresponding thereto designates the using amount the coupler.

| | |
|---|---|
| Red-sensitive silver halide emulsions R11:R21:R31 | 0.43 |
| Cyan coupler | 0.71 |
| Dye 1-1 | 0.02 |
| Gelatin | 2.55 |

Dye 1-1

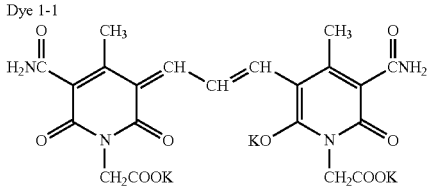

(Production of Halation Preventive Layer)

The solid fine-particle dispersion of dye A prepared in the above manner and a gelatin were mixed and dissolved in such amounts that the dispersion A and the gelatin were applied in amounts of 0.11 $g/m^2$ and 0.70 $g/m^2$, respectively, to produce a coating solution for a halation preventive layer.

(Production of Intermediate Layer)

The following gelatin and chemicals were dissolved and mixed, to produce a coating solution for an intermediate layer.

| | |
|---|---|
| Gelatin | 0.65 |
| Compound 6 | 0.04 |
| Compound 7 | 0.03 |
| Solvent 5 | 0.01 |

(Compound 6)

-continued

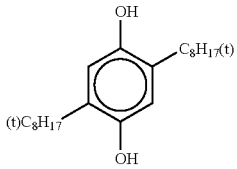

(Compound 7)

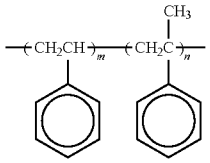

Number-average molecular weight 600 m/n = 10/90

(Solvent 5)

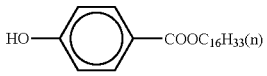

(Production of Protective Layer)

The following gelatin and chemicals were dissolved and mixed, to produce a coating solution for a protective layer.

| | |
|---|---|
| Gelatin | 0.97 |
| Acryl modified copolymer of polyvinyl alcohol (degree of modification: 17%) | 0.02 |
| Compound 8 | 0.05 |
| Compound 9 | 0.011 |

(Compound 8)

A mixture in 7:1 (Mass ratio) of

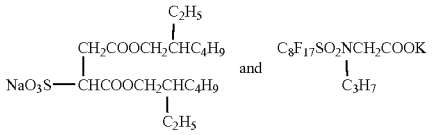

(Compound 9)

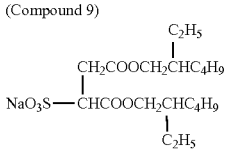

(Preparation of a Layer Containing Infrared-Absorbing-Dye-Forming Coupler)

As in the case of yellow-color-forming layer, an infrared-absorbing-dye-forming coupler-1-containing layer was formed from the composition in which the following emulsions and the ingredients were mixed and dissolved. The mixing ratio of the photosensitive silver halide emulsions was 2:3:5 based on silver by mole. The infrared-absorbing-dye-forming coupler was used in the form of Dispersion S, and the figure corresponding thereto designates the using amount the coupler.

| | |
|---|---|
| Photosensitive silver halide emulsions SH-1:SM-1:SL-1 | 0.13 |
| Gelatin | 1.10 |
| Infrared-absorbing-dye-forming coupler (ExIR-1) | 0.23 |

The hardener used in each layer was sodium salt of 1-oxy-3,5-dichloro-s-triazine, and the using amount thereof was adjusted so that the swelling rate determined by the following equation reached 210%.

Swelling rate=100×(Maximum swollen layer thickness−Layer thickness)÷Layer thickness(%)

Also, the following dyes 2 to 5 were added to each of the emulsion layers for the purpose of preventing irradiation.

(Dye 2)

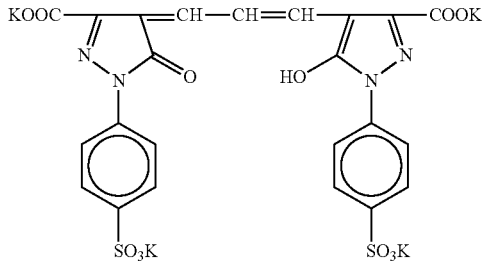

(0.060 g/m$^2$)

(Dye 3)

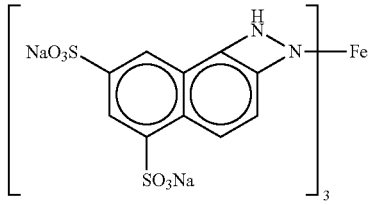

(0.094 g/m$^2$)

(Dye 4)

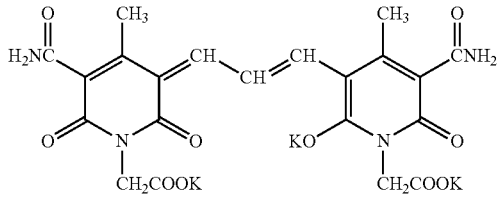

(0.018 g/m$^2$)

(Dye 5)

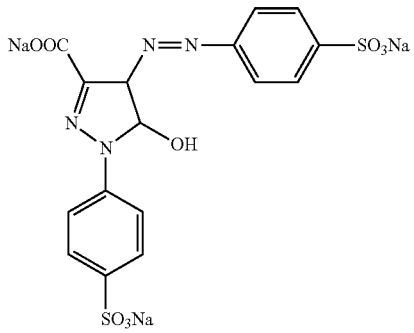

(0.015 g/m$^2$)

(Production of Support)

An acrylic resin layer containing the following electrically conductive polymer (0.05 g/m$^2$) and tin oxide fine particles (0.20 g/m$^2$) was applied to one surface of a biaxially oriented (stretched) polyethylene terephthalate support with a thickness of 120 μm.

Electrically Conductive Polymer

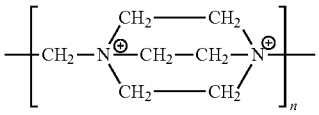

(Preparation of Coating Sample 1)

The coating solutions prepared as aforementioned were applied, with a co-extrusion manner, onto the polyethylene terephthalate support, on the side opposite to the surface to which the acrylic layer resin was applied, so as to provide the following layer structure, with a halation preventive layer being disposed as the lowest layer, and then the resultant coated support was dried, to produce Coating sample 1. Further, Coating sample 2 was prepared in the same manner as Coating sample 1, except that a change was made to the silver halide grains in the yellow-color-forming layer.

Protective layer
Magenta-color-forming layer
Intermediate layer
Cyan-color-forming layer
Intermediate layer
Yellow-color-forming layer
Halation preventive layer
Polyethylene terephthalate support (Preparation of Coating Sample 3)

Coating sample 3 was prepared in the same manner as Coating sample 1, except that the layer containing an infrared-absorbing-dye-forming coupler as mentioned above was interposed between the protective layer and the magenta-color-forming layer. The layer structure is described below.

Protective layer
Layer containing Infrared-absorbing-dye-forming coupler
Intermediate layer
Magenta-color-forming layer
Intermediate layer
Cyan-color-forming layer
Intermediate layer
Yellow-color-forming layer
Halation preventive layer
Polyethylene terephthalate support Coating samples 1 to 5 were prepared as shown in the following Table 1.

TABLE 1

| Coating sample | Infrared-absorbing-dye-forming coupler-containing layer | Blue-sensitive silver halide: Kind | Mixing ratio | Average grain size | Iodide profile |
|---|---|---|---|---|---|
| 1 | Absent | BH-3:BL-3 | 1:1 | 0.66 μm | Free of iodide |
| 2 | Absent | BH-1:BM-1:BL-1 | 1:2:3 | 0.365 μm | Decrease from grain surface toward interior |
| 3 | Present | BH-3:BL-3 | 1:1 | 0.66 μm | Free of iodide |
| 4 | Present | BH-1:BM-1:BL-1 | 1:2:3 | 0.365 μm | Decrease from grain surface toward interior |
| 5 | Present | BH-2:BM-2:BL-2 | 1:2:3 | 0.365 μm | Free of iodide |

(Preparation of Processing Solutions)

As a standard processing process for motion picture films, ECP-2 process released by Eastman Kodak Company was prepared.

All samples produced as above were respectively exposed to such an image that about 30% of the amount of the applied silver would be developed. Each sample which had been exposed was subjected to continuous processing (running test) performed according to the following processing process until the amount of the replenisher to a color-developing bath reached twice the tank volume, thereby preparing the development processing condition in a running equilibrium.

ECP-2 Process

<Step>

| Name of step | Process temperature (° C.) | Process time (sec) | Replenisher amount (ml per 35 mm × 30.48 m) |
|---|---|---|---|
| 1. Pre-bath | 27 ± 1 | 10 to 20 | 400 |
| 2. Washing | 27 ± 1 | Jet water washing | — |
| 3. Developing | 36.7 ± 0.1 | 180 | 690 |
| 4. Stop | 27 ± 1 | 40 | 770 |
| 5. Washing | 27 ± 3 | 40 | 1200 |
| 6. 1st fixing | 27 ± 1 | 40 | 200 |
| 7. Washing | 27 ± 3 | 40 | 1200 |
| 8. Bleach accelerating | 27 ± 1 | 20 | 200 |
| 9. Bleaching | 27 ± 1 | 40 | 200 |
| 10. Washing | 27 ± 3 | 40 | 1200 |
| 11. Drying | | | |
| 12. Sound development | Room temperature | 10 to 20 | — (Application) |
| 13. Washing | 27 ± 3 | 1 to 2 | — (Spray) |
| 14. 2nd fixing | 27 ± 1 | 40 | 200 |
| 15. Washing | 27 ± 3 | 60 | 1200 |
| 16. Rinsing | 27 ± 3 | 10 | 400 |

<Formulation of Process Solutions>

Composition per liter is shown.

| Name of steps | Name of Chemicals | Tank solution | Replenishing solution |
|---|---|---|---|
| Pre-bath | VOLAX (trade name) | 20 g | 20 g |
| | Sodium sulfate | 100 g | 100 g |
| | Sodium hydroxide | 1.0 g | 1.5 g |
| Developing | Kodak Anti-calcium No. 4 (trade name) | 1.0 ml | 1.4 ml |
| | Sodium sulfite | 4.35 g | 4.50 g |
| | CD-2 | 2.95 g | 6.00 g |
| | Sodium carbonate | 17.1 g | 18.0 g |
| | Sodium bromide | 1.72 g | 1.60 g |

-continued

| Name of steps | Name of Chemicals | Tank solution | Replenishing solution |
|---|---|---|---|
| | Sodium hydroxide | — | 0.6 g |
| | Sulfuric acid (7 N) | 0.62 ml | — |

-continued

| Name of steps | Name of Chemicals | Tank solution | Replenishing solution |
|---|---|---|---|
| Stop | Sulfuric acid (7 N) | 50 ml | 50 ml |
| | Fixing (common to the first fixing and the second fixing) | | |
| | Ammonium thiosulfate (58%) | 100 ml | 170 ml |
| | Sodium sulfite | 2.5 g | 16.0 g |
| | Sodium hydrogen sulfite | 10.3 g | 5.8 g |
| | Potassium iodide | 0.5 g | 0.7 g |
| Bleach-accelerating | Sodium hydrogen metasulfite | 3.3 g | 5.6 g |
| | Acetic acid | 5.0 ml | 7.0 ml |
| | Bleach accelerator (PBA-1) (Kodak Persulfate Bleach Accelerator (trade name)) | 3.3 g | 4.9 g |
| | EDTA-4Na | 0.5 g | 0.7 g |
| Bleaching | Gelatin | 0.35 g | 0.50 g |
| | Sodium persulfate | 33 g | 52 g |
| | Sodium chloride | 15 g | 20 g |
| | Sodium dihydrogen phosphate | 7.0 g | 10.0 g |
| | Phosphoric acid (85%) | 2.5 ml | 2.5 ml |
| Sound developing | Natrosa 1250HR | 2.0 g | |
| | Sodium hydroxide | 80 g | |
| | Hexyl glycol | 2.0 ml | |
| | Sodium sulfite | 60 g | |
| | Hydroquinone | 60 g | |
| | Ethylene diamine (98%) | 13 ml | |
| Rinsing | Stabilizer | 0.14 ml | 0.17 ml |
| | Rinsing assistant (Dearcide 702) | 0.7 ml | 0.7 ml |

In the above, CD-2 used in the developing step is a developing agent (4-amino-3-methyl-N,N-dimethylaniline), and Dearcide 702 used in the rinsing step is a mildewproof agent.

Further, the dye formed by reaction between the developing agent CD-2 and the infrared-absorbing-dye-forming coupler (Ex1R-1) had its absorption maximum at the wavelength of 870 nm.

(Performance of Cross-Modulation Test)

Aiming to use a sound negative of the appropriate density, a cross-modulation test was conducted for each coating sample. The cross-modulation signal used herein was a signal of 7 kHz modulated with a frequency of 400 Hz. The sound printing density of each sample was adjusted to 1.3, expressed in terms of the infrared absorption density measured with a Macbeth densitometer TD206A. In the processing of Coating samples 3 to 5, the sound development step (application of the sound developer) and the subsequent washing step were omitted from the processing steps using processing solutions prepared in the foregoing manners. Under these conditions, the optimum sound negative density for each coating sample was determined. Based on these testing results, sound signals were printed on each coating sample from the sound negative printed in the density optimized for each sample.

(Sound Test)

A filter cutting out light of wavelengths from 400 nm to 600 nm for making infrared soundtracks was prepared for the present photosensitive materials. The sound signals were printed on each of Coating samples 1 to 5, by bringing each sample into contact with the sound negative in which 7 kHz signals modulated with a frequency of 400 Hz were recorded under the condition optimized for each sample, and exposing the sample in such a contact state to white light passing through the filter prepared, and then each sample was processed with the processing solutions prepared as mentioned above. Whether the sound development step and the subsequent washing step were performed or omitted in that processing is shown in Table 2. The sound recorded in each coating sample thus processed was reproduced with a motion picture projector (CINEFORWARD FC-10 (trade name), manufactured by Fuji Photo Film Co., Ltd.). Relative evaluations were performed on the sound signals reproduced, with the result of Coating sample 1 obtained through the sound development step and the subsequent washing step being taken as ±0 dB. The sound reproduction was evaluated by reproduced-signal attenuation.

(Photographic Property Evaluation of Blue-Sensitive Layer)

Exposure was performed using a sensitometer (FW type, manufactured by Fuji Photo Film Co., Ltd.; color temperature of the light source, 3,200K) via yellow-color and magenta-color compensation filters and an optical wedge, so that neutral gray sensitometric images were formed, and then processing was carried out using the processing solutions prepared above, under the condition that the color development time was set at 180 seconds. The reciprocal value of the ratio among the exposure amounts required to be given to the samples to provide developed yellow color densities of 1.0 higher than their individual fog densities was multiplied by 100, and thereby relative evaluation of photographic sensitivities was made, with the Coating sample 1 being taken as 100.

(Development Progress Characteristics Evaluation of Blue-Sensitive Layer)

Subsequently, the same exposure as in the foregoing photographic property evaluation was performed, and color development was further carried out, for a processing time of 120 seconds, by use of the processing solutions prepared as mentioned above, and thereby photographic sensitivities under the condition of 120-second development time were evaluated in the same manner as the photographic sensitivities in the foregoing photographic property evaluation. On each sample, the exposure amount required to provide, under the condition of 180-second development time, the same photographic sensitivity as under the 120-second development time, was examined, and the reciprocal value of the ratio of the former exposure amount to the latter exposure amount was multiplied by 100. The development progress characteristics of each sample was evaluated by showing the thus obtained values as relative values, with Coating sample 1 being taken as 100.

The results obtained are shown in Table 2.

TABLE 2

| Coating sample | Sound development step | Sound signal | Photographic property of blue-sensitive layer | Development progress characteristics of blue-sensitive layer |
|---|---|---|---|---|
| 1 | Performed | ±0 dB | 100 | 100 |
| 1 | Omitted | −30 dB | 100 | 100 |
| 2 | Omitted | −30 dB | 104 | 41 |
| 3 | Omitted | ±0 dB | 100 | 100 |
| 4 | Omitted | ±0 dB | 104 | 41 |
| 5 | Omitted | −1 dB | 45 | 50 |

As can be seen from Table 2, the coating samples having the infrared-absorbing-dye-forming coupler-containing layers satisfactorily reproduced analog sound even when the application development step of soundtrack was omitted. Moreover, it was ascertained that high sensitivity, despite fine grains, and rapid progress of development were achieved by the use of blue-sensitive silver halide grains having an average grain size of 0.4 μm or below, a silver chloride content of 95 mole % or more, based on total silver, and an iodide profile in which the iodide ion concentration had its maximum at the surface of each grain and decreased gradually toward the interior of each grain. This result demonstrates reduction in processing time is feasible.

Example 1-2

Preparation of Blue-Sensitive Silver Halide Emulsion Grains BH-4

To a 2% aqueous solution of lime-processed gelatin, 1.2 g of sodium chloride was added and adjusted to pH 4.3 by addition of an acid. This aqueous solution was admixed with an aqueous solution containing 0.025 mole of silver nitrate and an aqueous solution containing sodium chloride and potassium bromide in the total amount of 0.025 mole at 41° C. with vigorous stirring. Subsequently thereto, an aqueous solution containing 0.005 mole of potassium bromide was added, and then an aqueous solution containing 0.125 mole of silver nitrate and an aqueous solution containing 0.12 mole of sodium chloride were added. The resulting solution was heated to the temperature of 71° C., and admixed with an aqueous solution containing 0.9 mole of silver nitrate, an aqueous solution containing 0.9 mole of sodium chloride, and an iridium compound, $K_2[IrCl_5(5\text{-methylthiazole})]$, in an amount of $2.5\times10^{-7}$ mole to the total amount of silver while maintaining the pAg to 7.3. After a lapse of 5 minutes, an aqueous solution containing 0.1 mole of silver nitrate and an aqueous solution containing 0.1 mole of sodium nitrate were further added and mixed. The emulsion thus obtained was allowed to stand for 50 minutes, and subjected to washing at 35° C. by sedimentation, to effect desalting. Thereafter, the desalted emulsion was admixed with 110 g of lime-processed gelatin, and adjusted to pH 5.9 and pAg 7.0. The thus-formed emulsion grains were tabular grains having {100} planes as their principal planes, a projected-area-equivalent diameter of 0.77 μm, an average thickness of 0.14 μm, an average aspect ratio of 4.8, a side length of 0.39 μm on a cube-equivalent basis, a variation coefficient of 0.19, and a silver chloride content of 96.5 mole %. To the emulsion grains, Sensitizing dyes (A), (B), and (C) illustrated below were added in the amounts of $3.2\times10^{-4}$ mole, $2.8\times10^{-5}$ mole, and $1.6\times10^{-5}$ mole, respectively. Thereafter, chemical ripening was performed to the optimum by addition of a sulfur sensitizer and a gold sensitizer. Thus, preparation of blue-sensitive silver halide emulsion grains BH-4 was completed.

Sensitizing dye (A)

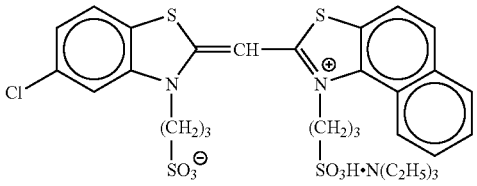

Sensitizing dye (B)

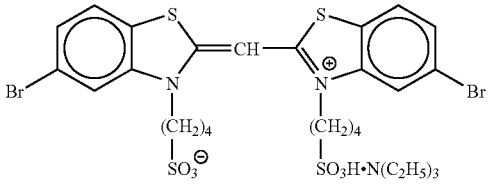

-continued

Sensitizing dye (C)

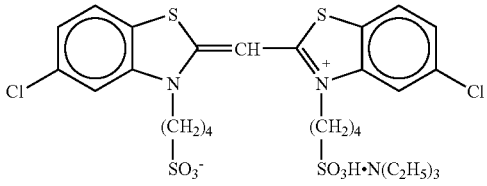

(Preparation of Blue-Sensitive Silver Halide Emulsion Grains BM-4)

Tabular grains having a projected-area-equivalent diameter of 0.60 μm, an average thickness of 0.13 μm, an average aspect ratio of 3.8, a variation coefficient of 0.21, and a silver chloride content of 96.5 mole % were formed in the same manner as in the preparation of the emulsion grains BH-4, except that the amount of potassium bromide in (X-1) was changed to 0.010 mole. To the grains thus formed, Sensitizing dyes (A), (B), and (C) were added in the amounts of $4.7\times10^{-4}$ mole, $4.4\times10^{-5}$ mole, and $2.3\times10^{-4}$ mole, respectively. Thereafter, chemical ripening was performed to the optimum in the same manner as in the case of BH-4. Thus, preparation of blue-sensitive silver halide emulsion grains BM-4 was completed.

(Preparation of Blue-Sensitive Silver Halide Emulsion Grains BL-4)

Tabular grains having a projected-area-equivalent diameter of 0.40 μm, an average thickness of 0.12 μm, an average aspect ratio of 3.3, a variation coefficient of 0.22, and a silver chloride content of 96.5 mole % were formed in the same manner as in the preparation of the emulsion grains BH-4, except that the amount of potassium bromide in (X-1) was changed to 0.014 mole. To the grains thus formed, Sensitizing dyes (A), (B), and (C) were added in the amounts of $5.9\times10^{-4}$ mole, $6.0\times10^{-5}$ mole, and $3.1\times10^{-4}$ mole, respectively. Thereafter, chemical ripening was performed to the optimum in the same manner as in the case of BH-4. Thus, preparation of blue-sensitive silver halide emulsion grains BL-4 was completed.

Coating sample 6 was prepared in the same manner as Coating sample 3 prepared in Example 1-1, except that the emulsion prepared by mixing BH-4, BM-4, and BL-4 at the ratio of 1:3:6 was used in place of the mixture of the blue-sensitive silver halide emulsions BH-3 and BL-3 (which both had the aspect ratio of 1). The coating amount of the emulsion was the same as in Coating sample 3.

The same cross-modulation test, sound test, photographic property evaluation, and development progress characteristics evaluation as performed on Coating sample 3 in Example 1-1 were performed also on Coating sample 6. The results obtained are shown in Table 3.

TABLE 3

| Coating sample | Sound development step | Sound signal | Photographic property of blue-sensitive layer | Development progress characteristics of blue-sensitive layer |
|---|---|---|---|---|
| 3 | Omitted | ±0 dB | 100 | 100 |
| 6 | Omitted | ±0 dB | 110 | 46 |

As can be seen from Table 3, the photographic sensitivity was enhanced and the progress of development was expedited in the case of using tabular silver halide grains. This result shows that reduction in processing time is feasible.

Example 2-1

Preparation of Blue-Sensitive Layer Emulsion BH-11

Using a method of simultaneously adding silver nitrate, sodium chloride, and potassium bromide (0.5 mol % per mol of the finished silver halide) mixed into stirring deionized distilled water containing deionized gelatin, high silver chloride cubic grains were prepared. In this preparation, at the step of from 60% to 80% addition of the entire silver nitrate amount, $K_2[IrCl_5(5\text{-methylthiazole})]$ was added. At the step of from 80% to 90% addition of the entire silver nitrate amount, $K_4[Fe(CN)_6]$ was added. Further, $K_2[IrCl_5(H_2O)]$ and $K[IrCl_4(H_2O)_2]$ were added at the step of from 83% to 88% addition of the entire silver nitrate amount. Potassium iodide (0.27 mol % per mol of the finished silver halide) was added, with vigorous stirring, at the step of completion of 94% addition of the entire silver nitrate amount. The thus-obtained emulsion grains were monodisperse cubic silver bromochloride grains having a side length of 0.50 μm, a variation coefficient of 8.5%, and silver chloride content of 97 mol %. After being subjected to a sedimentation desalting treatment, the following were added to the resulting emulsion: gelatin, Compounds Ab-1, Ab-2, and Ab-3, and calcium nitrate, and the emulsion was re-dispersed.

The re-dispersed emulsion was dissolved at 40° C., and Sensitizing dye S-1, Sensitizing dye S-2, and Sensitizing dye S-3 were added for optimal spectral sensitization. Then, the resulting emulsion was ripened by adding sodium benzene thiosulfate, triethylthiourea as a sulfur sensitizer, and Compound-1 as a gold sensitizer, for optimal chemical sensitization. Further, 1-(5-acetamidophenyl)-5-mercaptotetrazole; a mixture whose major components are compounds represented by Compound 2 in which the repeating unit (n) is 2 or 3 (both ends $X_1$ and $X_2$ are each a hydroxyl group); Compound 3; and potassium bromide were added, to finalize chemical sensitization. The thus-obtained emulsion was referred to as Emulsion BH-11.

(Preparation of Blue-Sensitive-Layer Emulsion BM-11)

Emulsion grains were prepared in the same manner as in the preparation of Emulsion BH-11, except that the temperature and the addition rate at the step of mixing the silver nitrate, sodium chloride, and potassium bromide (0.5 mol % per mol of the finished silver halide) by simultaneous addition were changed, and the amounts of respective metal complexes that were to be added during the addition of silver nitrate, sodium chloride, and potassium bromide were changed. The thus-obtained emulsion grains were monodisperse cubic silver iodobromochloride grains having a side length of 0.41 μm, a variation coefficient of 9.5%, and silver chloride content of 97 mol %. After re-dispersion of this emulsion, Emulsion BM-11 was prepared in the same manner as Emulsion BH-11, except that the amounts of the compounds added in the preparation of BH-11 were changed so as to become the same amounts per unit area as those in Emulsion BH-11.

(Preparation of Blue-Sensitive-Layer Emulsion BL-11)

Emulsion grains were prepared in the same manner as in the preparation of Emulsion BH-11, except that the temperature and the addition rate at the step of mixing the silver nitrate, sodium chloride, and potassium bromide (0.5 mol % per mol of the finished silver halide) by simultaneous addition were changed, and the amounts of respective metal complexes that were to be added during the addition of silver nitrate, sodium chloride, and potassium bromide were changed. The thus-obtained emulsion grains were monodisperse cubic silver iodobromochloride grains having a side length of 0.29 μm, a variation coefficient of 9.7%, and silver chloride content of 97 mol %. After re-dispersion of this emulsion, Emulsion BL-11 was prepared in the same manner as Emulsion BH-11, except that the amounts of the compounds in the preparation of BH-11 were changed so as to become the same amounts per unit area as those in Emulsion BH-11.

When Emulsions BH-11, BM-11, and BL-11 were each checked on the in-grain iodide profile in accordance with the method described in "DISCLOSURE OF INVENTION" section, it was verified that the iodide ion concentrations thereof had their maxima at individual grain surfaces and decreased gradually towards the interior of the grains.

(Preparation of Blue-Sensitive Layer Emulsions BH-12, BM-12, and BL-12 for Comparison)

Emulsions BH-12, BM-12, and BL-12 for blue-sensitive layers were prepared in the same manners as Emulsions BH-11, BM-11, and BL-11, respectively, except that the potassium iodide used at the time of grain formation was replaced with the equimolar amount of sodium chloride. The grain size, the variation coefficient, and the silver chloride content of emulsions prepared herein were equivalent to those of BH-1, BM-1, and BL-11, respectively.

(Preparation of Blue-Sensitive Layer Emulsion BH-13 for Comparison)

To 1.08 liter of deionized distilled water containing 5.7 mass % of deionized gelatin placed in a reaction vessel, 46.4 mL of a 10% NaCl solution was added, and further 46.4 mL of $H_2SO_4$ (1N) was added, and then 0.013 g of Compound X was added. The temperature of the admixture obtained was adjusted to 62° C., and immediately thereafter 0.1 mole of silver nitrate and 0.1 mole of NaCl were added to the reaction vessel over a 15-minute period with stirring at a high speed. Subsequently thereto, 1.5 moles of silver nitrate and a NaCl solution were further added over a 50-minute period at a flow rate increased so that the final addition speed reached 4 times larger than the initial addition speed. Then, 0.2 mole % of silver nitrate and a NaCl solution were added at a constant flow rate over a 6-minute period. To the NaCl solution used herein, $K_3IrCl_5(H_2O)$ was added in an amount corresponding to $9\times10^{-7}$ mole on a basis of the total silver amount, thereby doping grains with aquated iridium.

Further, 0.2 mole of silver nitrate, a solution containing 0.18 mole of NaCl, and 0.02 mole of KBr were added over a 10-minute period. At that time, $K_4Ru(CN)_6$ and $K_4Fe(CN)_6$ were each dissolved into the aqueous halide solution in an amount corresponding to $0.7\times10^{-5}$ mole on a basis of the total silver amount, and thereby they were added to silver halide grains.

Thereafter, the reaction vessel was adjusted to 40° C., and thereto Compound Y as a precipitant was added. Then, the pH of the resulting emulsion was adjusted to around 3.5, followed by desalting and washing.

To the thus-desalted-and-washed emulsion, deionized gelatin, an aqueous NaCl solution, and an aqueous NaOH solution were added. The resultant mixture was heated up to 50° C. and adjusted to pAg 7.6 and pH 5.6. Thus was obtained silver halide cubic grains having a halide composition composed of 98.9 mole % silver chloride, 1 mole % silver bromide, and 0.1 mole % silver iodide; an average side length of 0.80 μm, and a variation coefficient of 9% with respect to the side length.

The emulsion grains thus formed was kept at 60° C., and thereto Spectral sensitizing dye-1 and Spectral sensitizing dye-2 were added in amounts of $2.4\times10^{-4}$ mole/mole silver and $2.2\times10^{-4}$ mole/mole silver, respectively. Further thereto, Thiosulfonic acid compound 1 was added in an amount of $1.5\times10^{-5}$ mole/mole silver, and further was added a fine-grain emulsion doped with iridium hexachloride, having an average grain diameter of 0.05 μm and a halide composition composed of 90 mole % silver bromide and 10 mole % silver chloride. The resulting emulsion was ripened for 10 minutes. Further, fine grains having an average grain diameter of 0.05 μm and a halide composition composed of 40 mole % silver bromide and 60 mole % silver chloride were added thereto, and the resulting emulsion was ripened for 10 minutes. Thus, the fine grains were dissolved, and the silver bromide content in the host cubic grains was increased to 0.013 mole per mole of silver. Also, the resulting emulsion was doped with $1\times10^{-7}$ mole/mole silver of iridium hexachloride.

Subsequently, the emulsion was admixed with $1\times10^{-5}$ mole/mole silver of sodium thiosulfate and $2\times10^{-5}$ mole/mole silver of Gold sensitizer-1, and immediately thereafter the mixture was heated up to 60° C., followed by 40-minute ripening. Then, the temperature of the resulting emulsion was lowered to 50° C., and immediately thereafter Mercapto compound 1 and Mercapto compound 2 were each added in an amount of $6.3\times10^{-4}$ mole/mole silver. Then, after ripening for 10 minutes, a KBr aqueous solution was added in an amount of 0.008 mole on a basis of the total silver amount, and then, the mixture was ripened for 10 minutes, and cooled. The emulsion thus obtained was stored. In the manner described above, an emulsion on the high-speed layer side (high-sensitivity emulsion), Emulsion BH-13 containing silver chloride content of 97.8 mol %, was prepared.

(Preparation of Blue-Sensitive Layer Emulsion BL-13 for Comparison)

Cubic grains having an average side length of 0.52 μm and a variation coefficient of 9% with respect to the side length were formed in the same manner as the preparation method of the emulsion BH-13, except that the temperature throughout the grain formation was changed to 55° C.

Spectral sensitization and chemical sensitization of the cubic grains obtained were carried out using the same sensitizers in amounts corrected for specific area (from the side length ratio of 0.8/0.52=1.54 times). Thus, an emulsion on the low-speed layer side (low-sensitivity emulsion), Emulsion BL-13, having a silver halide content of 97.8% was prepared.

(Preparation of Red-Sensitive Silver Halide Emulsion Grains)

Three types of cubic emulsion grains of silver chlorobromide emulsions (Br/Cl ratio=8/92), namely large-size emulsion grains R111 having an average grain size of 0.23 μm and a variation coefficient of 0.11 with respect to grain size distribution, medium-size emulsion grains R121 having an average grain size of 0.174 μm and a variation coefficient of 0.12 with respect to the grain size distribution, and small-size emulsion grains R131 having an average grain size of 0.121 μm and a variation coefficient of 0.13 with respect to the grain size distribution, were prepared by adding a mixture of silver nitrate, sodium chloride, and potassium bromide in accordance with the controlled-double-jet method well known in the art. Further, each of these emulsions was adjusted so as to have an iridium content of $3\times10^{-7}$ mole per silver. To the large-size emulsion grains R111, the medium-size emulsion grains R121, and the small-size emulsion grains R131, Red-sensitive sensitizing dye A) was added in the amounts of $2.1\times10^{-5}$ mole/mole silver, $3.3\times10^{-5}$ mole/mole silver, and $4.5\times10^{-5}$ mole/mole silver, respectively; Sensitizing dye (E) was added in the amounts of $1.8\times10^{-5}$ mole/mole silver, $2.3\times10^{-5}$ mole/mole silver, and $3.6\times10^{-5}$ mole/mole silver, respectively; Sensitizing dye (F) was added in the amounts of $0.8\times10^{-5}$ mole/mole silver, $1.4\times10^{-5}$ mole/mole silver, and $2.1\times10^{-5}$ mole/mole silver, respectively. These emulsions were each chemically ripened to the optimum by addition of a sulfur sensitizer and a gold sensitizer. Furthermore, Compound 1 was added to the silver halide emulsion grains R111, R121, and R131 in the amounts of $9.0\times10^{-4}$ mole, $1.0\times10^{-3}$ mole, and $1.4\times10^{-3}$ mole, respectively, per mole of silver.

(Preparation of Green-Sensitive Silver Halide Emulsion Grains)

Three types of cubic emulsion grains of silver chlorobromide emulsions (Br/Cl ratio=3/97) were prepared, which were specifically large-size emulsion grains G111 having an average grain size of 0.20 μm and a variation coefficient of 0.11 with respect to grain size distribution, medium-size emulsion grains G121 having an average grain size of 0.146 μm and a variation coefficient of 0.12 with respect to the grain size distribution, and small-size emulsion grains G131 having an average grain size of 0.102 μm and a variation coefficient of 0.10 with respect to the grain size distribution. Further, each of these emulsions was adjusted so as to have an iridium content of $3\times10^{-7}$ mole per silver. To the large-size emulsion grains G111, G121, and G131, Green-sensitive sensitizing dye (G) was added in the amounts of $2.1\times10^{-4}$ mole/mole silver, $3.0\times10^{-4}$ mole/mole silver, and $3.5\times10^{-4}$ mole/mole silver, respectively; Sensitizing dye (H) was added in the amounts of $0.8\times10^{-4}$ mole/mole silver, $1.3\times10^{-4}$ mole/mole silver, and $1.7\times10^{-4}$ mole/mole silver, respectively; Sensitizing dye (I) was added in the amounts of $1.2\times10^{-4}$ mole/mole silver, $1.4\times10^{-4}$ mole/mole silver, and $1.9\times10^{-4}$ mole/mole silver, respectively; and Sensitizing dye (I) was added in the amounts of $0.3\times10^{-4}$ mole/mole silver, $0.6\times10^{-4}$ mole/mole silver, and $0.9\times10^{-4}$ mole/mole silver, respectively. These emulsions were each chemically ripened to the optimum by addition of a sulfur sensitizer and a gold sensitizer.

(Preparation of Photosensitive Silver Halide Emulsion Grains for Bleach-Inhibitor-Releasing Coupler-Containing Layer)

Three types of cubic emulsion grains of silver chlorobromide emulsions (Br/Cl ratio=10/90), namely large-size emulsion grains HH-1 having an average grain size of 0.30 μm and a variation coefficient of 0.09 with respect to grain size distribution, medium-size emulsion grains HM-1 having an average grain size of 0.23 μm and a variation coefficient of 0.10 with respect to the grain size distribution, and small-size emulsion grains HL-1 having an average grain size of 0.15 μm and a variation coefficient of 0.12 with respect to the grain size distribution, were prepared by adding a mixture of silver nitrate, sodium chloride, and potassium bromide in accordance with the controlled-double-jet method well known in the art. Further, each of these emulsions was adjusted so as to have an iridium content of $3\times10^{-7}$ mole per silver. These emulsion grains were chemically ripened to the optimum by addition of a sulfur sensitizer and a gold sensitizer. Further, Compound 1 illustrated above was added to the silver halide emulsion grains HH-1, HM-1, and HL-1 in the amounts of $9.0\times10^{-4}$ mole, $1.0\times10^{-3}$ mole and $1.4\times10^{-3}$ mole, respectively, per mole of silver.

(Preparation of Emulsified Dispersion Y1 for Yellow-Color-Forming Layer)

Materials having the following components were dissolved and mixed together, and the resultant mixture was then emulsified and dispersed in 1000 g of an aqueous 10% gelatin solution containing 80 ml of 10% sodium dodecylbenzenesulfonate, to prepare Emulsified dispersion Y1.

| | |
|---|---|
| Yellow coupler (ExY) | 116.0 g |
| Additive 1 | 8.8 g |
| Additive 2 | 9.0 g |
| Additive 3 | 4.8 g |
| Additive 4 | 10.0 g |
| Solvent 1 | 79.0 g |
| Solvent 2 | 44.0 g |
| Solvent 3 | 9.0 g |
| Solvent 4 | 4.0 g |
| Ethyl acetate | 150.0 ml |

(Preparation of Emulsified Dispersion M1 for Magenta-Color-Forming Layer, and Emulsified Dispersion C1 for Cyan-Color-Forming Layer)

Emulsified dispersion M1 for a magenta-color-forming layer and Emulsified dispersion C1 for a cyan-color-forming layer were prepared in the same manner as in the preparation of the emulsified dispersion Y1, except that the aforementioned yellow coupler (ExY) was changed to the magenta coupler (ExM) and the cyan coupler (ExC), respectively.

(Preparation of Bleach-Inhibitor-Releasing Coupler-Containing Dispersion S1)

Dispersion S1 containing a bleach-inhibitor-releasing coupler was prepared using the following bleach inhibitor-releasing coupler (ExB) in the same manner as Dispersion Y1.

| | |
|---|---|
| Bleach inhibitor-releasing coupler (ExB) | 55.0 g |
| Additive 2 | 9.0 g |
| Additive 3 | 4.8 g |
| Additive 4 | 10.0 g |
| Solvent 1 | 79.0 g |
| Solvent 2 | 44.0 g |
| Solvent 3 | 9.0 g |
| Solvent 4 | 4.0 g |
| Ethyl acetate | 150.0 ml |

Bleach inihibitor-releasing coupler (ExB)

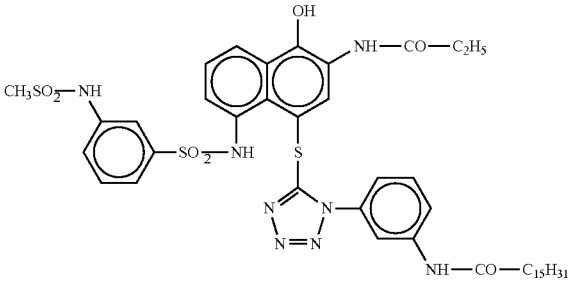

(Preparation of Coating Solutions for Yellow-Color-Forming Emulsion Layers)

Coating solutions for yellow-color-forming emulsion layers were prepared using the three types of blue-sensitive emulsions at blending ratios expressed in terms of silver content by mole, which are shown in Table 4, and adding thereto other ingredients mixed and dissolved in the proportions described below. The unit of each figure shown below is g/m$^2$. The coating amount of each emulsion is expressed on a silver basis. The yellow coupler was used in the form of Dispersion Y1, and the figure corresponding thereto designates the using amount of the coupler.

| | |
|---|---|
| Silver halide emulsion | 0.49 |
| Yellow coupler (ExY) | 1.18 |
| Gelatin | 2.10 |

-continued

| | |
|---|---|
| Compound 3 | 0.0005 |
| Compound 4 | 0.03 |
| Compound 5 | 0.04 |

(Preparation of Coating Solution for Magenta-Color-Forming Emulsion Layer)

As in the case of each coating solutions for yellow-color-forming emulsion layer, a magenta-color-forming emulsion layer was formed from the composition in which the following emulsions and the ingredients were mixed and dissolved. The coating amount of each emulsion is expressed in terms of silver. The mixing ratio of the green-sensitive silver halide emulsions was 1:3:6 based on silver by mole. The magenta coupler was used in the form of Dispersion M1, and the figure corresponding thereto designates the using amount of the coupler.

| | |
|---|---|
| Green-sensitive silver halide emulsions G111:G121:G131 | 0.55 |
| Magenta coupler (ExM) | 0.68 |
| Gelatin | 1.28 |

(Preparation of Coating Solution for Cyan-Color-Forming Emulsion Layer)

As in the case of each coating solutions for yellow-color-forming emulsion layer, a cyan-color-forming emulsion layer was formed from the composition in which the following emulsions and the ingredients were mixed and dissolved. The coating amount of each emulsion is expressed in terms of silver. The mixing ratio of the red-sensitive silver halide emulsions was 2:3:5 based on silver by mole. The cyan coupler was used in the form of Dispersion C1, and the figure corresponding thereto designates the using amount of the coupler.

| | |
|---|---|
| Red-sensitive silver halide emulsions R111:R121:R131 | 0.46 |
| Cyan coupler (ExC) | 0.72 |
| Dye 1-1 | 0.02 |
| Gelatin | 2.45 |

(Production of a Halation Preventive Layer)

A solution for a halation preventive layer was prepared in the same manner as in Example 1-1.

(Production of an Intermediate Layer)

The following gelatin and chemicals were dissolved and mixed, to produce a coating solution for an intermediate layer.

| | |
|---|---|
| Gelatin | 0.67 |
| Compound 6 | 0.04 |
| Compound 7 | 0.02 |
| Solvent 5 | 0.01 |

(Preparation of Protective Layer)

The following gelatin and chemicals were dissolved and mixed, to prepare a costing solution for a protective layer.

| | |
|---|---|
| Gelatin | 0.96 |
| Acryl modified copolymer of polyvinyl alcohol (Degree of modification: 17%) | 0.02 |
| Compound 8 | 0.04 |
| Compound 9 | 0.013 |

(Preparation of Layer Containing Bleach-Inhibitor-Releasing Coupler)

As was the case with the coating solution for yellow-color-forming layer, the emulsions and the ingredients were mixed and dissolved according to the following composition and formed into a layer containing the bleach-inhibitor-releasing coupler. The coating amounts of the emulsions are the coating amounts based on silver. The mixing ratio between the silver halide emulsions for the bleach-inhibitor-releasing coupler-containing layer was 2:3:5 based on silver by mole. The bleach-inhibitor-releasing coupler was used in the form of Dispersion S1, and the figure corresponding thereto represents the coating amount based on the coupler.

| | |
|---|---|
| Photosensitive silver halide emulsion grains for the bleach-inhibitor-releasing coupler-containing layer HH-1:HM-1:HL-1 | 0.97 |
| Bleach-inhibitor-releasing coupler (ExB) | 0.13 |
| Gelatin | 2.45 |

12 was prepared in the same manner as Coating sample 11, except that a change was made to the silver halide grains in the yellow-color-forming layer.

Protective layer
Magenta-color-forming layer
Intermediate layer
Cyan-color-forming layer
Intermediate layer
Yellow-color-forming layer
Halation preventive layer
Polyethylene terephthalate support (Preparation of Coating Sample 13)

Coating sample 13 was prepared in the same manner as Coating sample 11, except that the bleach-inhibitor-releasing coupler-containing layer as mentioned above was interposed between the protective layer and the magenta-color-forming layer. The layer structure is described below.

Protective layer
Bleach-inhibitor-releasing-coupler-containing layer
Intermediate layer
Magenta-color-forming layer
Intermediate layer
Cyan-color-forming layer
Intermediate layer
Yellow-color-forming layer
Halation preventive layer
Polyethylene terephthalate support Coating samples 11 to 15 were prepared as shown in the following Table 4.

TABLE 4

| Coating sample | Bleach-inhibitor-releasing coupler-containing layer | Blue-sensitive silver halide: Kind | Mixing ratio | Average grain size | Iodide profile |
|---|---|---|---|---|---|
| 11 | Absent | BH-13:BL-13 | 1:1 | 0.66 μm | Free of iodide |
| 12 | Absent | BH-11:BM-11:BL-11 | 1:2:3 | 0.365 μm | Decrease from grain surface toward interior |
| 13 | Present | BH-13:BL-13 | 1:1 | 0.66 μm | Free of iodide |
| 14 | Present | BH-11:BM-11:BL-11 | 1:2:3 | 0.365 μm | Decrease from grain surface toward interior |
| 15 | Present | BH-12:BM-12:BL-12 | 1:2:3 | 0.365 μm | Free of iodide |

The hardener used in each layer was sodium salt of 1-oxy-3,5-dichloro-s-triazine, and the using amount thereof was adjusted so that the swelling rate determined by the following equation reached 200%.

Swelling rate=100×(Maximum swollen layer thickness−Layer thickness)÷layer thickness(%)

Also, Dyes 2 to 5 were added to each of the emulsion layers for the purpose of preventing irradiation.

(Production of a Support)

A support was prepared in the same manner as in Example 1-1.

(Preparation of Coating Sample 13)

The coating solutions prepared as aforementioned were applied, with a co-extrusion manner, onto the polyethylene terephthalate support on the side opposite to the surface to which the acrylic layer resin was applied, so as to provide the following layer structure, with a halation preventive structure being disposed as the lowest layer, and then the resultant was dried, to produce Coating sample 11. Further, Coating sample Cross-modulation test, Sound test, Photographic property evaluation of blue-sensitive layer, and Development progress characteristics evaluation of blue-sensitive layer were carried out in the same manner as in Example 1-1. When conducting the evaluations, Coating samples 13 to 15 were treated in the same manner as Coating samples 3 to 5 in Example 1-1.

The results obtained are shown Table 5.

TABLE 5

| Coating sample | Sound development step | Sound signal | Photographic property of blue-sensitive layer | Development progress characteristics of blue-sensitive layer |
|---|---|---|---|---|
| 11 | Performed | ±0 dB | 100 | 100 |
| 11 | Omitted | −13 dB | 100 | 100 |
| 12 | Omitted | −13 dB | 101 | 40 |
| 13 | Omitted | −1 dB | 100 | 100 |

TABLE 5-continued

| Coating sample | Sound development step | Sound signal | Photographic property of blue-sensitive layer | Development progress characteristics of blue-sensitive layer |
|---|---|---|---|---|
| 14 | Omitted | ±0 dB | 102 | 42 |
| 15 | Omitted | ±0 dB | 41 | 52 |

As can be seen from Table 5, the coating samples having the bleach-inhibitor-releasing-coupler-containing layers satisfactorily reproduced analog sound even when the application development step of soundtrack was omitted. Moreover, it was ascertained that high sensitivity, despite fine grains, and rapid progress of development were achieved by the use of blue-sensitive silver halide grains having an average grain size of 0.4 μm or below, a silver chloride content of 95 mole % or more, based on total silver, and an iodide profile in which the iodide ion concentration had its maximum at the surface of each grain and decreased gradually toward the interior of each grain. This result demonstrates reduction in processing time is feasible.

Example 2-2

Preparation of Blue-Sensitive Silver Halide Emulsion Grains BH-14

To a 2% aqueous solution of lime-processed gelatin, 1.3 g of sodium chloride was added and adjusted to pH 4.3 by addition of an acid. This aqueous solution was admixed with an aqueous solution containing 0.03 mole of silver nitrate and an aqueous solution containing sodium chloride and potassium bromide in the total amount of 0.03 mole at 41° C. with vigorous stirring. Subsequently thereto, an aqueous solution containing 0.005 mole of potassium bromide was added, and then an aqueous solution containing 0.13 mole of silver nitrate, and an aqueous solution containing 0.12 mole of sodium chloride were added. The resulting solution was heated to the temperature of 72° C., and admixed with an aqueous solution containing 0.9 mole of silver nitrate, an aqueous solution containing 0.9 mole of sodium chloride, and an iridium compound, $K_2[IrCl_5(5\text{-methylthiazole})]$, in an amount of $3\times10^{-7}$ mole to the total amount of silver, while maintaining the pAg to 7.2. After a lapse of 5 minutes, an aqueous solution containing 0.1 mole of silver nitrate and an aqueous solution containing 0.1 mole of sodium nitrate were further added and mixed. The emulsion thus obtained was allowed to stand for 40 minutes, and subjected to washing by sedimentation at 35° C., to effect desalting. Thereafter, the desalted emulsion was admixed with 110 g of lime-processed gelatin, and adjusted to pH 5.9 and pAg 7.1. The thus-formed emulsion grains were tabular grains having {100} planes as their principal planes, a projected-area-equivalent diameter of 0.78 μm, an average thickness of 0.14 μm, an average aspect ratio of 4.7, a side length of 0.39 μm on a cube-equivalent basis, a variation coefficient of 0.20, and a silver chloride content of 96.5 mole %. To these emulsion grains, Sensitizing dyes (A), (B), and (C) were added in the amounts of $3.3\times10^{-4}$ mole, $2.6\times10^{-5}$ mole, and $1.5\times10^{-5}$ mole, respectively. Thereafter, chemical ripening was performed to the optimum by addition of a sulfur sensitizer and a gold sensitizer. Thus, preparation of blue-sensitive silver halide emulsion grains BH-14 was completed.

(Preparation of Blue-Sensitive Silver Halide Emulsion Grains BM-14)

Tabular grains having a projected-area-equivalent diameter of 0.60 μm, an average thickness of 0.13 μm, an average aspect ratio of 3.8, a variation coefficient of 0.22, and a silver chloride content of 96.5 mole % were formed in the same manner as in the preparation of the emulsion grains BH-14, except that the amount of potassium bromide in (X-1) was changed to 0.010 mole. To the grains thus formed, Sensitizing dyes (A), (B), and (C) were added in the amounts of $4.8\times10^{-4}$ mole, $4.5\times10^{-5}$ mole, and $2.5\times10^{-4}$ mole, respectively. Thereafter, chemical ripening was performed to the optimum in the same manner as in the case of BH-14. Thus, preparation of blue-sensitive silver halide emulsion grains BM-14 was completed.

(Preparation of Blue-Sensitive Silver Halide Emulsion Grains BL-14)

Tabular grains having a projected-area-equivalent diameter of 0.40 μm, an average thickness of 0.12 μm, an average aspect ratio of 3.3, a variation coefficient of 0.19, and a silver chloride content of 96.5 mole % were formed in the same manner as in the preparation of the emulsion grains BH-14, except that the amount of potassium bromide in (X-1) was changed to 0.014 mole. To the grains thus formed, Sensitizing dyes (A), (B), and (C) were added in the amounts of $5.7\times10^{-4}$ mole, $6.1\times10^{-5}$ mole, and $3.3\times10^{-4}$ mole, respectively. Thereafter, chemical ripening was performed to the optimum in the same manner as in the case of BH-14. Thus, preparation of blue-sensitive silver halide emulsion grains BL-14 was completed.

Coating sample 16 was prepared in the same manner as Coating sample 13 prepared in Example 2-1, except that the emulsion prepared by mixing BH-14, BM-14, and BL-14 at the ratio of 1:3:6 was used in place of the mixture of the blue-sensitive silver halide emulsions BH-13 and BL-13 (which both had the aspect ratio of 1). The coating amount of the emulsion was the same as in Coating sample 13.

The same cross-modulation test, Sound test, Photographic property evaluation, and Development progress characteristics evaluation as performed on Coating sample 13 were performed also on Coating sample 16. The results obtained are shown in Table 6.

TABLE 6

| Coating sample | Sound development step | Sound signal | Photographic property of blue-sensitive layer | Development progress characteristics of blue-sensitive layer |
|---|---|---|---|---|
| 13 | Omitted | ±0 dB | 100 | 100 |
| 16 | Omitted | ±0 dB | 111 | 43 |

As can be seen from Table 6, the photographic sensitivity was enhanced and the progress of development was expedited in the case of using tabular silver halide grains. This result shows that reduction in processing time is feasible.

Example 3-1

Preparation of Support

A polyethylene terephthalate film support (thickness: 120 μm), provided with an undercoat on the side of the surface to which an emulsion was to be applied, and also provided with an acrylic resin layer which contained the conductive polymer (0.05 g/m$^2$) as used in Example 1-1 and tin oxide fine particles (0.20 g/m$^2$) and which was applied to the side opposite to the surface to which the emulsion was to be applied, was prepared.

(Preparation of Silver Halide Emulsions)

—Preparation of Blue-Sensitive Silver Halide Emulsion—

A large-sized grain emulsion (BO-01) (grain shape: cube, grain size: 0.71 μm, grain size distribution: 0.09, halide composition: Br/Cl=3/97) was prepared by admixing an aqueous silver nitrate solution with an aqueous solution of sodium chloride-potassium bromide mixture in accordance with the controlled-double-jet method well known in the art. The iridium content therein was adjusted to $4\times10^{-7}$ mole/mole silver. To this emulsion, Sensitizing dyes (A') to (C') of the structural formulae illustrated below were added in the following amounts:

Blue sensitizing dye (A'): $3.5\times10^{--5}$ mole/mole silver

Blue sensitizing dye (B'): $1.9\times10^{-4}$ mole/mole silver

Blue sensitizing dye (C'): $1.8\times10^{-5}$ mole/mole silver

Further, the resulting emulsion was subjected to optimal gold-sulfur sensitization by use of chloroauric acid and triethylthiourea.

A medium-sized emulsion (BM-01) (grain shape: cube, grain size: 0.52 μm, grain size distribution: 0.09, halide composition: Br/Cl=3/97) was prepared by admixing an aqueous silver nitrate solution with an aqueous solution of sodium chloride-potassium bromide mixture in accordance with the controlled-double-jet method well known in the art. The iridium content therein was adjusted to $6\times10^{-7}$ mole/mole silver. To this emulsion, Sensitizing dyes (A') to (C') of the structural formulae illustrated below were added in the following amounts:

Blue sensitizing dye (A'): $6.9\times10^{-5}$ mole/mole silver

Blue sensitizing dye (B'): $2.3\times10^{-4}$ mole/mole silver

Blue sensitizing dye (C'): $2.7\times10^{-5}$ mole/mole silver

Further, the resulting emulsion was subjected to optimal gold-sulfur sensitization by use of chloroauric acid and triethylthiourea.

A small-sized emulsion (BU-01) (grain shape: cube, grain size: 0.31 μm, grain size distribution: 0.08, halide composition: Br/Cl=3/97) was prepared in the same manner as Emulsion BM-01, except that the grain-formation temperature was lowered.

Sensitizing dyes (A') to (C') of structural formulae illustrated below were further added as follows:

Blue sensitizing dye (A'): $8.5\times10^{-4}$ mole/mole silver

Blue sensitizing dye (B'): $4.1\times10^{-4}$ mole/mole silver

Blue sensitizing dye (C'): $3.7\times10^{-5}$ mole/mole silver

—Preparation of Red-Sensitive Silver Halide Emulsion—

A large-sized grain emulsion (RO-01) (grain shape: cube, grain size: 0.23 μm, grain size distribution: 0.11, halide composition: Br/Cl=25/75) was prepared by admixing an aqueous silver nitrate solution with an aqueous solution of sodium chloride-potassium bromide mixture in accordance with the controlled-double-jet method well known in the art. The iridium content therein was adjusted to $2\times10^{-7}$ mole/mole silver. To this emulsion, Sensitizing dyes (D') to (F') of the structural formulae illustrated below were added in the following amounts:

Red sensitizing dye (D'): $4.5\times10^{-5}$ mole/mole silver

Red sensitizing dye (E'): $0.2\times10^{-5}$ mole/mole silver

Red sensitizing dye (F'): $0.2\times10^{-5}$ mole/mole silver

Furthermore, the resulting emulsion was subjected to optimal gold-sulfur sensitization by use of chloroauric acid and triethylthiourea, and then admixed with Cpd-71 of a structural formula illustrated below in the amount of $9.0\times10^{-4}$ mole per mole of silver halide.

A medium-sized grain emulsion (RM-01) (grain shape: cube, grain size: 0.174 μm, grain size distribution: 0.12, halide composition: Br/Cl=25/75) was prepared in the same manner as RO-01, except that the grain-formation temperature was changed. Therein were used Sensitizing dyes (D') to (F') of formulae illustrated below in the following amounts.

Red sensitizing dye (D'): $7.0\times10^{-5}$ mole/mole silver

Red sensitizing dye (E'): $1.0\times10^{-5}$ mole/mole silver

Red sensitizing dye (F'): $0.4\times10^{-5}$ mole/mole silver

A small-sized grain Emulsion (RU-01) (grain shape: cube, grain size: 0.121 μm, grain size distribution: 0.13, halide composition: Br/Cl=25/75) was prepared in the same manner as RO-01, except that the grain-formation temperature was changed. Therein were used Sensitizing dyes (D') to (F') of formulae illustrated below in the following amounts:

Red sensitizing dye (D'): $8.9\times10^{-5}$ mole/mole silver

Red sensitizing dye (E'): $1.2\times10^{-5}$ mole/mole silver

Red sensitizing dye (F'): $0.5\times10^{-5}$ mole/mole silver

—Preparation of Green-Sensitive Silver Halide Emulsion—

A large-sized grain Emulsion (GO-01) (grain shape: cube, grain size: 0.20 μm, grain size distribution: 0.11, halide composition: Br/Cl=3/97) was prepared by admixing an aqueous silver nitrate solution with an aqueous solution of sodium chloride-potassium bromide mixture in accordance with the controlled-double-jet method well known in the art. The iridium content therein was adjusted to $2\times10^{-7}$ mole/mole silver. To this emulsion, Sensitizing dyes (G') to (I') of the structural formulae illustrated below were added in the following amounts;

Green sensitizing dye (G'): $2.8\times10^{-4}$ mole/mole silver

Green sensitizing dye (H'): $0.8\times10^{-4}$ mole/mole silver

Green sensitizing dye (I'): $1.2\times10^{-4}$ mole/mole silver

Green sensitizing dye (J'): $1.2\times10^{-4}$ mole/mole silver

Further, the resulting emulsion was subjected to optimal gold-sulfur sensitization by use of chloroauric acid and triethylthiourea.

A medium-sized grain Emulsion (GM-01) (grain shape: cube, grain size: 0.146 μm, grain size distribution: 0.12, halide composition: Br/Cl=3/97) was prepared in the same manner as GO-01, except that the grain-formation temperature was changed. And therein were used the sensitizing dyes (G') to (J') of formulae illustrated below in the following amounts.

Green sensitizing dye (G'): $3.8\times10^{-4}$ mole/mole silver

Green sensitizing dye (H'): $1.3\times10^{-4}$ mole/mole silver

Green sensitizing dye (I'): $1.4\times10^{-4}$ mole/mole silver

Green sensitizing dye (J'): $1.2\times10^{-4}$ mole/mole silver

A small-sized grain Emulsion (GU-01) (grain shape: cube, grain size: 0.102 μm, grain size distribution: 0.10, halide composition: Br/Cl=3/97) was prepared in the same manner as GO-01, except that the grain-formation temperature was changed. Therein were used Sensitizing dyes (G') to (J') of formulae illustrated below in the following amounts.

Green sensitizing dye (G'): $5.1\times10^{-4}$ mole/mole silver

Green sensitizing dye (H'): $1.7\times10^{-4}$ mole/mole silver

Green sensitizing dye (I'): $1.9\times10^{-4}$ mole/mole silver

Green sensitizing dye (J'): $1.2\times10^{-4}$ mole/mole silver

Sensitizing dye (A′)

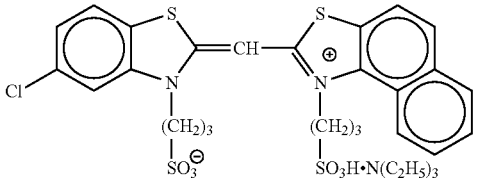

Sensitizing dye (B′)

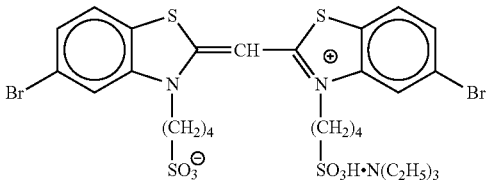

Sensitizing dye (C′)

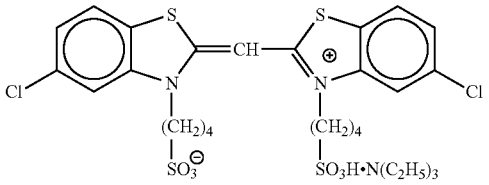

Sensitizing dye (D′)

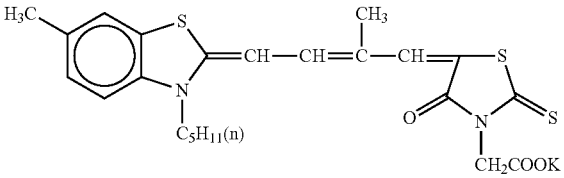

Sensitizing dye (E′)

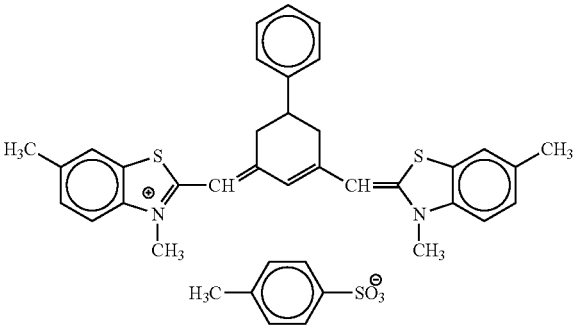

Sensitizing dye (F′)

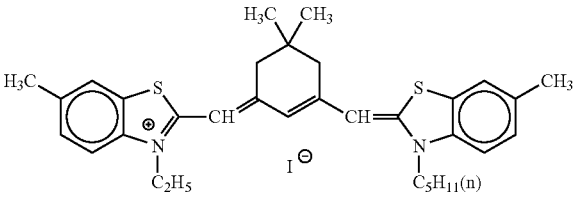

-continued

Sensitizing dye (G′)

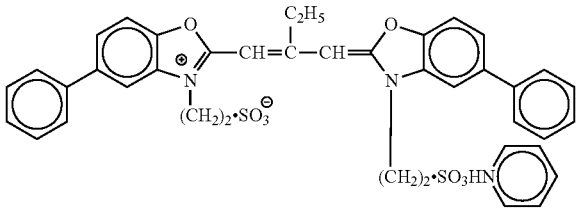

Sensitizing dye (H′)

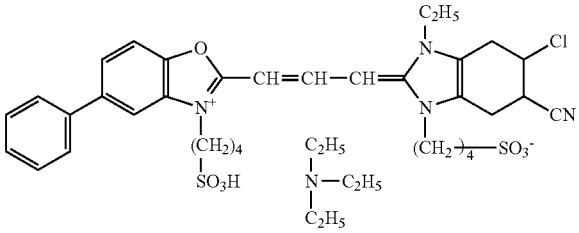

Sensitizing dye (I′)

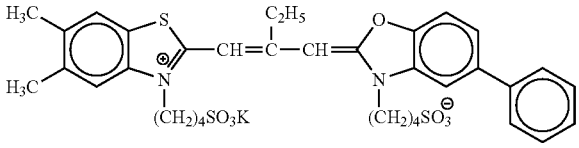

Sensitizing dye (J′)

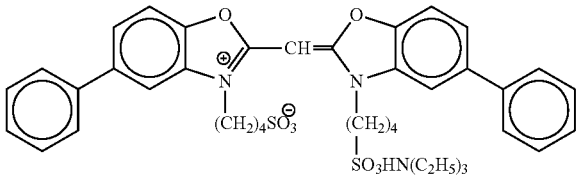

(Cpd-71)

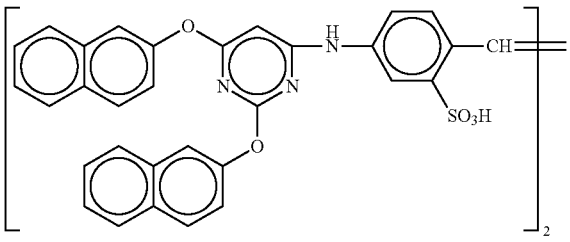

(Preparation of a Solid Fine-Particle Dispersion of a Dye)

A methanol wet cake of Compound (D-1) was weighed such that the net amount of the compound was 240 g, and 48 g of the below-shown Compound (Pm-1) as a dispersing aid was weighed. To both compounds was added water, to make the total amount be 4,000 g. The mixture was crushed by using "a flow system sand grinder mill (UVM-2)" (manufactured by AIMEX K.K.) filled with 1.7 liter of zirconia beads (diameter: 0.5 mm) at a discharge rate of 0.5 l/min and a peripheral velocity of 10 m/s for 2 hours. Then, the dispersion was diluted such that the concentration of the compound was 3 mass %, and the following compound of the formula (Pm-1) was added in an amount of 3% in terms of mass ratio to the dye (referred to as Dispersion A11). The average particle size of this dispersion was 0.45 μm.

Further, a dispersion containing 5 mass % of Compound (D-2) (referred to as Dispersion B11) was prepared in the same manner.

(D-1)

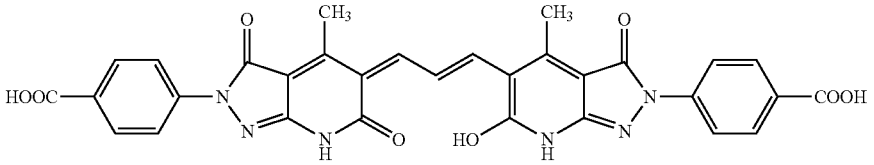

(D-2)

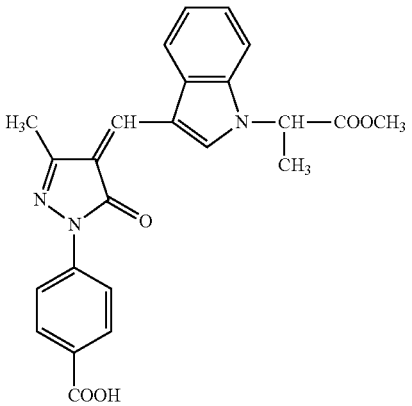

(Pm-1)

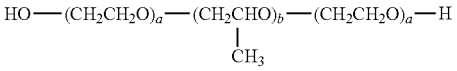

a:b = 8:2
Average molecular weight 11400

(Pm-2)

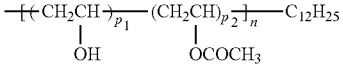

p1 = 88 mol %
p2 = 12 mol %
Polymerization degree 300

(Preparation of Sample 101)

Each layer having the composition shown below was applied to the support by multilayer-coating, thereby producing a multilayer silver halide color photosensitive material as Sample 101.

—Layer Constitution—

The composition of each layer is shown below. The numerals show the coating amount (g/m$^2$). The coating amount of each silver halide emulsion is expressed in terms of silver. In addition, as a gelatin hardener for each layer, 1-oxy-3,5-dichloro-s-triazine sodium salt was used.

(Layer Constitution of Sample 101)

Support

Polyethylene terephthalate film described above

| First layer (Halation preventive layer (Non-photosensitive hydrophilic colloidal layer)) | |
|---|---|
| Gelatin | 1.03 |
| Dispersion A11 (in terms of the coating amount of dye) | 0.10 |
| Dispersion B11 (in terms of the coating amount of dye) | 0.03 |
| **Second layer (Blue-sensitive silver halide emulsion layer)** | |
| A 3:1:6 mixture of silver chlorobromide emulsion BO-01, emulsion BM-01, and emulsion BU-01 (mol ratio of silver) | 0.57 |
| Gelatin | 2.71 |
| Yellow coupler (ExY') | 1.19 |
| (Cpd-41) | 0.0006 |
| (Cpd-42) | 0.01 |
| (Cpd-43) | 0.05 |
| (Cpd-44) | 0.003 |
| (Cpd-45) | 0.012 |
| (Cpd-46) | 0.001 |
| (Cpd-54) | 0.08 |
| Solvent (Solv-21) | 0.26 |
| **Third layer (Color-mixing-preventing layer)** | |
| Gelatin | 0.59 |
| (Cpd-49) | 0.02 |

-continued

| | |
|---|---|
| (Cpd-43) | 0.05 |
| (Cpd-53) | 0.005 |
| (Cpd-61) | 0.02 |
| (Cpd-62) | 0.05 |
| Solvent (Solv-21) | 0.06 |
| Solvent (Solv-23) | 0.04 |
| Solvent (Solv-24) | 0.002 |
| **Fourth layer (Red-sensitive silver halide emulsion layer)** | |
| A 2:2:6 mixture of silver chlorobromide Emulsion RO-01, Emulsion RM-01, and Emulsion RU-01(mole ratio of silver) | 0.40 |
| Gelatin | 2.79 |
| Cyan coupler (ExC') | 0.80 |
| (Cpd-47) | 0.06 |
| (Cpd-48) | 0.06 |
| (Cpd-50) | 0.03 |
| (Cpd-52) | 0.03 |
| (Cpd-53) | 0.03 |
| (Cpd-57) | 0.05 |
| (Cpd-58) | 0.01 |
| (Cpd-60) | 0.02 |
| Solvent (Solv-21) | 0.53 |
| Solvent (Solv-22) | 0.28 |
| Solvent (Solv-23) | 0.04 |
| **Fifth Layer (Color-mixing-preventing layer)** | |
| Gelatin | 0.56 |
| (Cpd-49) | 0.02 |
| (Cpd-43) | 0.05 |
| (Cpd-53) | 0.005 |
| (Cpd-62) | 0.04 |
| (Cpd-64) | 0.002 |
| Solvent (Solv-21) | 0.06 |
| Solvent (Solv-23) | 0.04 |
| Solvent (Solv-24) | 0.002 |
| **Sixth Layer (Green-sensitive silver halide emulsion layer)** | |
| A 1:3:6 mixture of silver chlorobromide emulsions GO-01, GM-01, and GU-01 (mol ratio of silver) | 0.49 |
| Gelatin | 1.55 |
| Magenta coupler (ExM') | 0.70 |

-continued
| | |
|---|---|
| (Cpd-49) | 0.012 |
| (Cpd-51) | 0.001 |
| (Cpd-52) | 0.02 |
| Solvent (Solv-21) | 0.15 |
| Seventh layer (Protective layer) | |
| Gelatin | 0.97 |
| Acryl resin (average particle diameter: 2 μm) | 0.002 |
| (Cpd-52) | 0.03 |
| (Cpd-55) | 0.005 |
| (CPd-56) | 0.08 |
The compounds used here are shown below.
ExY′A mixture in 80:10:10 (mol ratio) of (1)/(2)/(3)
(1)
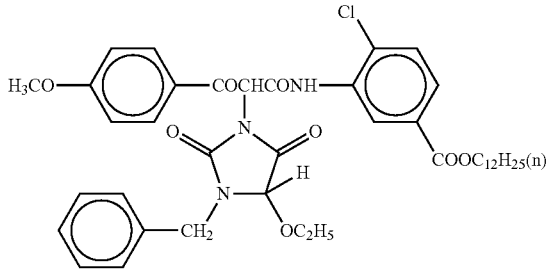
(2)
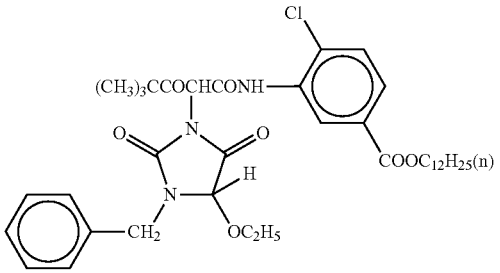
(3)
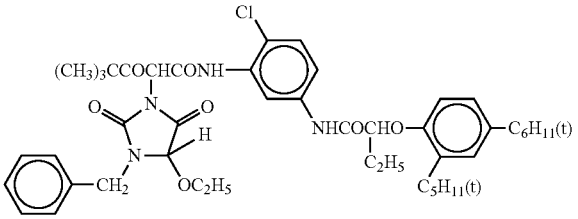
ExC′A compound in 40:40:10:10 (mol ratio) of (1)/(2)/(3)/(4)
(1)
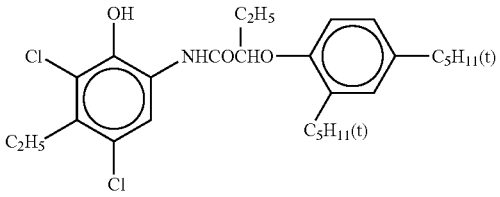
(2)
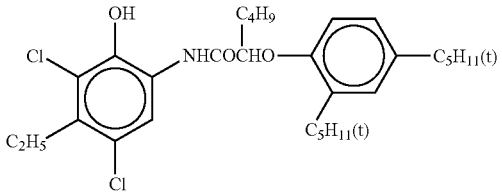
(3)
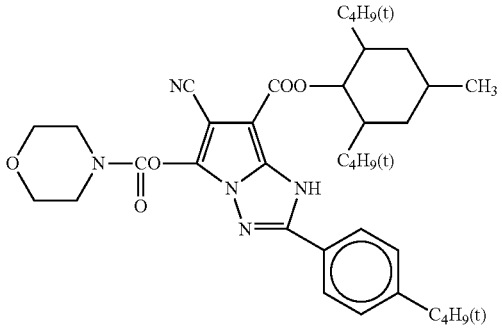
(4)
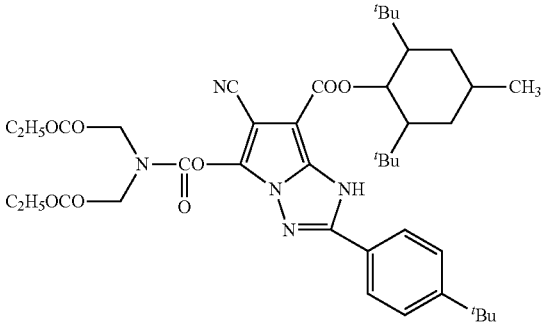
ExM′A mixture in 90:5:5 (mol ratio) of (1)/(2)/(3)
(1)
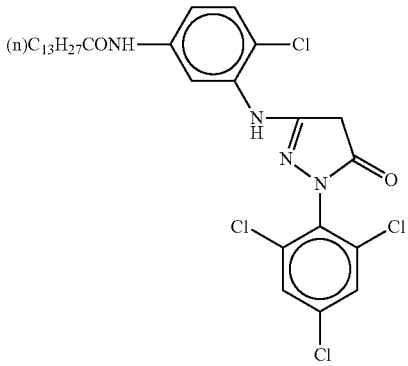
(2)
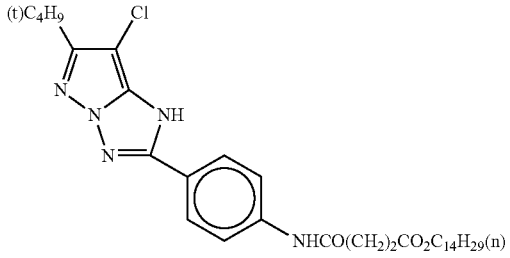

-continued
(3)
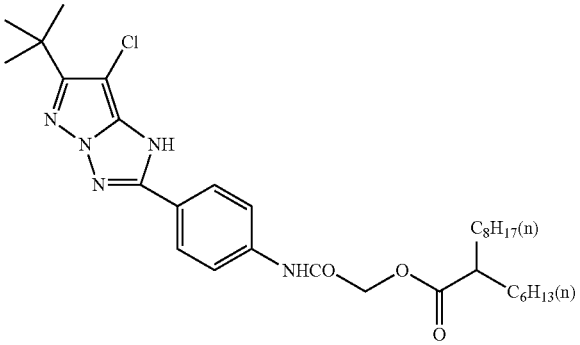
(Cpd-41)
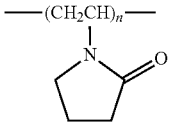
(Cpd-42)
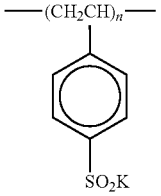
(Cpd-43)
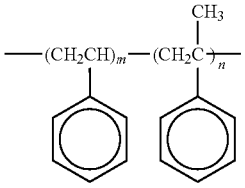
Number-average molecular weight 600
m/n = 10/90
(Cpd-44)
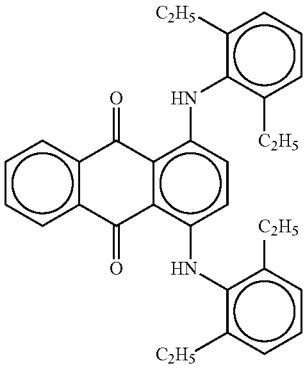
-continued
(Cpd-45)
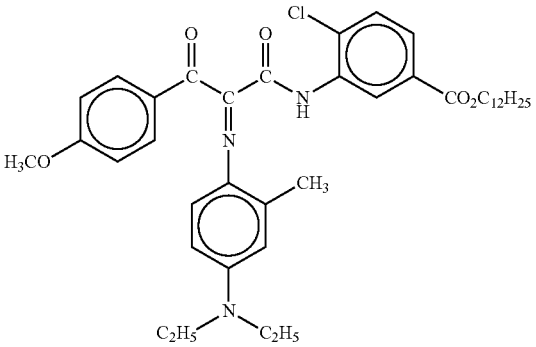
(Cpd-46)
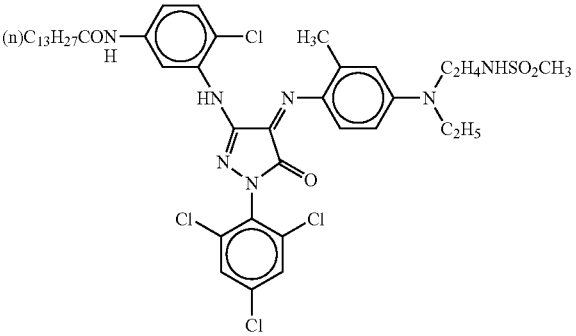
(Cpd-47)
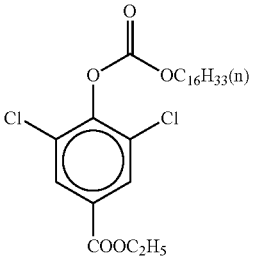
(Cpd-48)
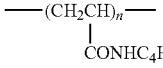
Average molecular weight about 60,000
(Cpd-49)
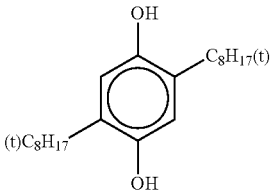
(Cpd-50)
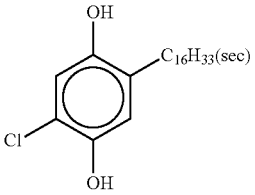

-continued
(Cpd-51)
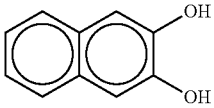
(Cpd-52)
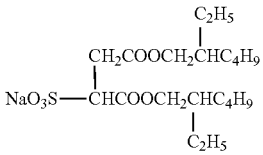
(Cpd-53)
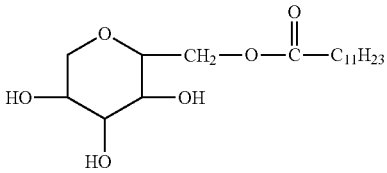
(Cpd-54)
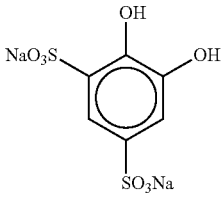
(Cpd-55)
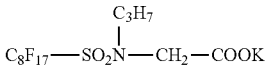
(Cpd-56)
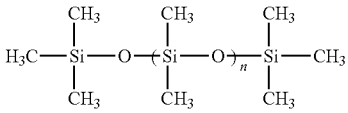
(Cpd-57)
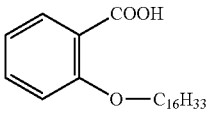
(Cpd-58)
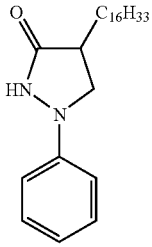
(Cpd-60)
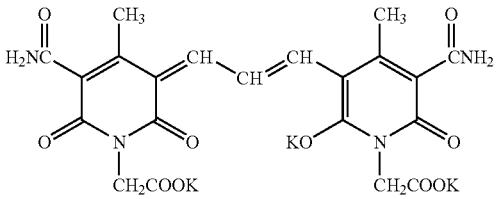
-continued
(Cpd-61)
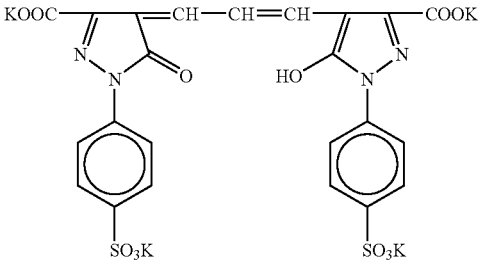
(Cpd-62)
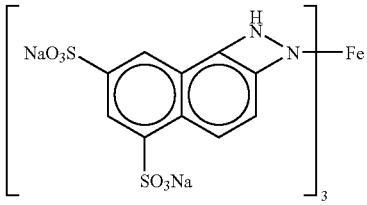
(Cpd-64)
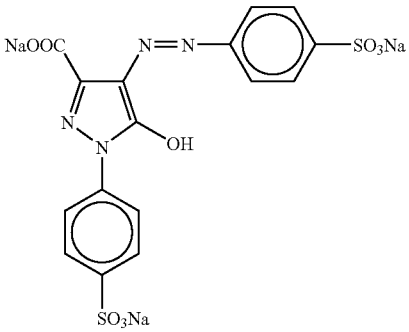
(Cpd-65)
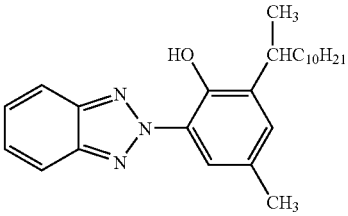
(Solv-21)
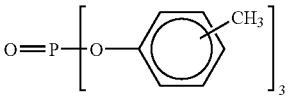
(Solv-22)
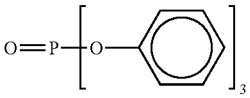
(Solv-23)
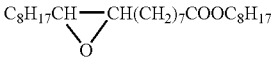
(Solv-24)
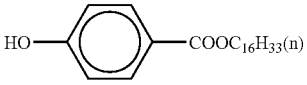
(Solv-25)
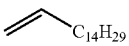
Sample 101 was produced in the manner as mentioned above.
Production of Sample 102)
Sample 102 was produced in the same manner as Sample 101, except that a UV-sensitive layer and a color-mixing-preventing layer were further inserted between the red-sensitive silver halide emulsion layer and the green-sensitive silver halide emulsion layer.

(Preparation of Coating Solution for Sixth Layer (UV-Sensitive Layer))

81 g of Infrared-absorbing-dye-forming coupler (ExIR-1) was dissolved in 10 g of a solvent (Solv-23), 40 g of a solvent (Solv-25), and 100 ml of ethyl acetate. The solution was emulsified and dispersed in 1000 g of an aqueous 10% gelatin solution containing 40 ml of 10% sodium dodecylbenzene sulfonate, to prepare Emulsified dispersion R.

On the other hand, a silver chlorobromide emulsion U1 (grain shape: cube, grain size: 0.174 μm, grain size distribution: 0.12; halide composition: Br/Cl=25/75) was prepared by admixing an aqueous silver nitrate solution with an aqueous solution of sodium chloride-potassium bromide mixture in accordance with the controlled-double-jet method well known in the art. The iridium content therein was adjusted to $2\times10^{-7}$ mole/mole silver. Further, the emulsion obtained was chemically ripened to the optimum by addition of a sulfur sensitizer and a gold sensitizer.

A sixth-layer coating solution was prepared by mixing the foregoing emulsified dispersion R and this silver chlorobromide emulsion U1, dissolving them, and further adding thereto a required amount of gelatin, so that the coating solution prepared had the following composition.

(ExIR-1)

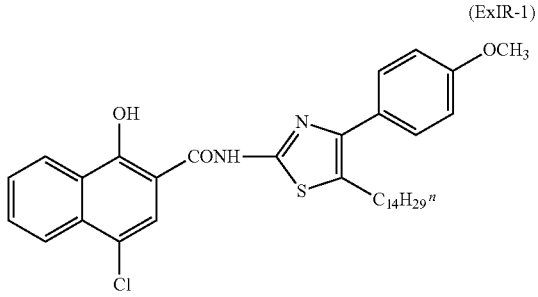

(ExIR-2)

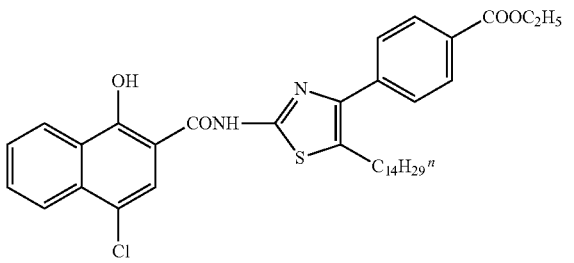

A seventh-layer coating solution was prepared in the same manner as in the case of the sixth-layer coating solution. The coating solutions used for forming first to fifth layers and eighth to ninth layers were the same as those used in the production of Sample 101, respectively. The gelatin hardener used in each layer was sodium salt of 1-oxy-3,5-dichloro-s-triazine as in the case of Sample 101. The layer structure and the coating amount of each ingredient are described below. As to the layers that were the same as those of Sample 101, the names of their corresponding layers in Sample 101 are written therein. Additionally, the coating amount of each emulsion is expressed in terms of silver.

(Layer Structure of Sample 102)

Support

Polyethylene terephthalate film (the same as in Sample 101)

First layer (Halation preventive layer (non-photosensitive hydrophilic colloidal layer))

The same as the first layer of Sample 101

Second layer (Blue-sensitive silver halide emulsion layer)

The same as the second layer of Sample 101

Third Layer (Color-mixing-preventing layer)

The same as the third layer of Sample 101

Fourth layer (Red-sensitive silver halide emulsion layer)

The same as the fourth layer of Sample 101

Fifth layer (Color-mixing-preventing layer)

The same as the fifth layer of Sample 101

| Sixth layer (UV-sensitive silver halide emulsion layer) | |
|---|---|
| Silver chlorobromide emulsion U-1 | 0.13 |
| Gelatin | 1.20 |
| IR coupler (ExIR-1) | 0.22 |
| Solvent (Solv-23) | 0.02 |
| Solvent (Solv-25) | 0.11 |
| Seventh Layer (Color-mixing-preventing layer) | |
| Gelatin | 0.56 |
| (Cpd-49) | 0.02 |
| (Cpd-43) | 0.05 |
| (Cpd-53) | 0.005 |
| Solvent (Solv-21) | 0.06 |
| Solvent (Solv-23) | 0.04 |
| Solvent (Solv-24) | 0.002 |

Eighth layer (Green-sensitive silver halide emulsion layer)

The same as the sixth layer of Sample 101

Ninth layer (Protective layer)

The same as the seventh layer of Sample 101

(Production of Samples 103 to 105)

Samples 103 to 105 were produced in the same manner as Sample 102, except that Cpd-65 was further added to the sixth layer in the amounts shown in Table 7, respectively.

(Production of Sample 106)

Sample 106 was produced in the same manner as Sample 104, except that the sixth layer and the eighth layer were made to change their places.

(Production of Sample 107)

Sample 107 was produced in the same manner as Sample 101, except that the third layer and the fifth layer of Sample 101 were changed as described below:

| Third layer (UV-sensitive silver halide emulsion layer serving also as a color-mixing-preventing layer) | |
|---|---|
| Silver chlorobromide emulsion U-1 | 0.07 |
| Gelatin | 1.00 |
| IR coupler (ExIR-1) | 0.11 |
| (Cpd-49) | 0.01 |
| (Cpd-43) | 0.01 |
| (Cpd-61) | 0.02 |
| (Cpd-62) | 0.04 |
| (Cpd-65) | 0.01 |
| Solvent (Solv-23) | 0.02 |
| Solvent (Solv-25) | 0.06 |
| Fifth layer (UV-sensitive silver halide emulsion layer serving also as a color-mixing-preventing layer) | |

-continued

| | |
|---|---|
| Silver chlorobromide emulsion U-1 | 0.07 |
| Gelatin | 1.00 |
| IR coupler (ExIR-1) | 0.11 |
| (Cpd-49) | 0.01 |
| (Cpd-43) | 0.01 |
| (Cpd-62) | 0.04 |
| (Cpd-64) | 0.002 |
| (Cpd-65) | 0.01 |
| Solvent (Solv-23) | 0.02 |
| Solvent (Solv-25) | 0.06 |

(Preparation for Sample 108)

Sample 108 was produced in the same manner as Sample 104, except that ExIR-1 in the sixth layer was replaced with ExIR-2 in the equimolecular amount.

(Preparation for Sample 109)

Sample 109 was produced in the same manner as Sample 107, except that ExIR-1 in the third layer and the fifth layer were replaced with ExIR-2 in their respective equimolecular amounts.

(Preparation of Processing Solution)

A processing process, which was based on a process according to the ECP-2D process published from Eastman Kodak as a standard method of processing a color film for movies, was utilized with the modification that the sound development step was excluded from the ECP-2D process. Then, for the purpose of preparing a developing process condition placed in a running equilibrium state, all samples produced as above were respectively exposed to such an image that about 30% of the amount of applied silver would be developed, and then each sample which had been exposed was subjected to continuous processing (running test) performed according to the above processing process, until the amount of the replenisher solution to a color developing bath reached twice the tank volume.

ECP-2D Process (Excluding the Sound Developing Step)

<Step>

| Name of steps | Process temp. (° C.) | Process time (sec) | Replenisher amount (ml per 35 mm × 30.48 m) |
|---|---|---|---|
| 1. Developing | 39.0 ± 0.1 | 180 | 690 |
| 2. Stop | 27 ± 1 | 40 | 770 |
| 3. Washing | 27 ± 3 | 40 | 1200 |
| 4. First fixing | 27 ± 1 | 40 | 200 |
| 5. Washing | 27 ± 3 | 40 | 1200 |
| 6. Bleach | 27 ± 1 | 60 | 200 |
| 7. Washing | 27 ± 3 | 40 | 1200 |
| 8. Second fixing | 27 ± 1 | 40 | 200 |
| 9. Washing | 27 ± 3 | 60 | 1200 |
| 10. Rinsing | 27 ± 3 | 10 | 400 |
| 11. Drying | | | |

<Formulation of Processing Solutions>

Composition per 1 l is shown.

| Name of steps | Name of chemicals | Tank solution | Replenisher |
|---|---|---|---|
| Developing | Kodak Anti-calcium No. 4 | 1.0 ml | 1.4 ml |
| | Sodium sulfite | 4.35 g | 4.50 g |
| | CD-2 | 2.95 g | 6.00 g |
| | Sodium carbonate | 17.1 g | 18.0 g |
| | Sodium bromide | 1.72 g | 1.60 g |
| | Sodium hydroxide | — | 0.6 g |
| | Sulfuric acid (7N) | 0.62 ml | — |
| Stop | Sulfuric acid (7N) | 50 ml | 50 ml |
| Fixing (common to the first fixing and the second fixing) | | | |
| | Ammonium thiosulfate (58%) | 100 ml | 170 ml |
| | Sodium sulfite | 2.5 g | 16.0 g |
| | Sodium hydrogen sulfite | 10.3 g | 5.8 g |
| | Potassium iodide | 0.5 g | 0.7 g |
| Bleaching | Proxel GXL | 0.07 ml | 0.10 ml |
| | Aqueous ammonia (28%) | 54.0 ml | 64.0 ml |
| | PDTA | 44.8 g | 51.0 g |
| | Ammonium bromide | 23.8 g | 30.7 g |
| | Acetic acid (90%) | 10.0 ml | 14.5 ml |
| | Ferric nitrate anhydride | 53.8 g | 61.2 g |
| Rinsing | Kodak Stabilizer Additive | 0.14 ml | 0.17 ml |
| | Dearcide 702 | 0.7 ml | 0.7 ml |

In the above, CD-2 used in the developing step is a developing agent (4-amino-3-methyl-N,N-dimethylaniline), and Proxel GXL used in the bleaching step and Dearcide 702 used in the rinsing step each are a mildewproof agent.

The processing using the thus obtained processing solutions in running equilibrium conditions is referred to as Processing A. The processing that is a processing in which a sound development step is added to Processing A is referred to as Processing B.

<Step of Process B>

<Step>

| Name of steps | Process temp. (° C.) | Process time (sec) | Replenisher amount (ml per 35 mm × 30.48 m) |
|---|---|---|---|
| 1. Developing | 39.0 ± 0.1 | 180 | 690 |
| 2. Stop | 27 ± 1 | 40 | 770 |
| 3. Washing | 27 ± 3 | 40 | 1200 |
| 4. 1st fixing | 27 ± 1 | 40 | 200 |
| 5. Washing | 27 ± 3 | 40 | 1200 |
| 6. Bleaching | 27 ± 1 | 60 | 200 |
| 7. Washing | 27 ± 3 | 40 | 1200 |
| 8. Sound development | Room temperature | 20 | Application |
| 9. Spray washing | 27 ± 3 | 2 | Spray |
| 10. 2nd fixing | 27 ± 1 | 40 | 200 |
| 11. Washing | 27 ± 3 | 60 | 1200 |
| 12. Rinsing | 27 ± 3 | 10 | 400 |
| 13. Drying | | | |

<Formulation for Processing Solutions>

Each figure on the right side designates the per-liter amount of the ingredient corresponding thereto. Incidentally, as to the formula for the sound development, only the formula for the tank solution is presented because the sound development was carried out by an application work.

| | | |
|---|---|---|
| Sound development | Natrosol 250HR | 2.0 g |
| | Sodium hydroxide | 8.0 g |
| | Hexylene glycol | 2.0 ml |
| | Sodium sulfite anhydrate | 50 g |
| | Hydroquinone | 60 g |
| | Ethylene diamine | 13 ml |

(Evaluations on Samples)

The following three varieties of filters were prepared for exposure of each sample.

Filter (1): A filter cutting out light wavelengths shorter than 500 nm, which is used for making traditional silver-image soundtracks Filter (2): A filter cutting out light wavelengths shorter than 650 nm, which is used for making cyan-dye soundtracks Filter (3): A filter cutting out light wavelengths from 400 to 600 nm, which is used for making infrared soundtracks on the photosensitive materials in this example Sharpness evaluations were made on the cyan-dye images and the infrared-absorbing-dye images in Samples 101 to 109 (the silver image in Sample 101, however). Each sample was subjected to light exposure via an optical wedge for sharpness measurement, as well as a filter chosen from the foregoing three varieties of the filters so as to form dye image or silver image, and then to color-development processing in accordance with Processing A (Processing B in the case of Sample 101, however). After completion of the processing, the CTF of each sample was measured at every 2 c/mm in the range of 2 c/mm to 20 c/mm. Then, the ratio between the CTF of the cyan dye image and that of the infrared-absorbing-dye image was calculated at each spatial frequency, and the value most greatly deviating from 1, among the values obtained by the calculations, was taken as the value for evaluation.

Next, the following cross-modulation test was carried out to conduct evaluation on the sound characteristics of samples. First, six varieties of processed sound negative films (Panchromatic Sound Negative Film No. 2374, manufactured by Eastman Kodak Company), on which two types of signals: namely, 1,000-Hz signals of uniform intensity, and 7,000-Hz sound signals modulated with 400 Hz, were recorded at negative densities from 2.8 to 3.8 in 0.2 steps, were prepared. Then, three cyan-dye track samples were prepared from each photosensitive material sample, by controlling exposure intensities so that the processed samples would have cyan densities of 2.0, 2.2, and 2.4, respectively, as measured with a densitometer Xrite 350 (made by Xrite); the exposure was performed via one of the negative films and Filter (2) mentioned above. Herein, density adjustment was carried out by intensity control of the light source used. The thus-prepared 18 varieties of cyan-dye tracks were reproduced with a sound reader for cyan-dye-track use, and the intensities of reproduced 1,000-Hz signals were compared with the intensities of 400 Hz-component signals of reproduced 7,000-Hz signals, and thereby the signal intensity ratios were determined.

Separately, Sample 101 was subjected to exposure using Filter (1) and the negative film lowest in 400 Hz-component signal intensity, among the aforementioned negative films, while the other samples were subjected to exposure via Filter (3) and the same negative film, and then those samples were subjected to Processing A (Processing B in the case of Sample 101, however), thereby making infrared soundtracks. Herein, five varieties of infrared-soundtrack samples were prepared from each photosensitive material sample, by controlling exposure densities so that the processed samples would have infrared densities from 1.0 to 1.5, as measured with a Macbeth densitometer TD-904s. The thus-obtained infrared soundtracks were reproduced with a usual sound reader (a sound reader attached to a projector CINEFORWARD Model FC-10 (trade name), manufactured by Fuji Photo Film Co., Ltd.), and, as described above, the intensities of reproduced 1,000-Hz signals were compared with the intensities of 400 Hz-component signals of reproduced 7,000-Hz signals. If such a signal intensity ratio is about the same as the signal intensity ratio of a cyan-dye track corresponding thereto, it means that the sample yielding such a result permits the formation of both cyan-dye and infrared soundtracks of equivalent quality from the same sound negative.

TABLE 7

Description of samples and evaluation results

| Sample No. | Infrared-absorbing-dye-forming coupler Kind | Infrared-absorbing-dye-forming coupler Amount ($g/m^2$) | Cpd-65 amount ($g/m^2$) | CTF ratio | Signal intensity ratio (dB) Cyan-dye soundtrack | Signal intensity ratio (dB) Infrared soundtrack |
|---|---|---|---|---|---|---|
| 101 | — | — | — | 0.91 | −41 | −22 |
| 102 | ExIR-1 | 0.22 | — | 0.82 | −42 | −20 |
| 103 | ExIR-1 | 0.22 | 0.01 | 0.97 | −42 | −35 |
| 104 | ExIR-1 | 0.22 | 0.02 | 0.99 | −42 | −40 |
| 105 | ExIR-1 | 0.22 | 0.04 | 0.94 | −42 | −30 |
| 106 | ExIR-1 | 0.22 | 0.02 | 0.98 | −41 | −39 |
| 107 | ExIR-1 | 0.22 | 0.02 | 0.99 | −42 | −43 |
| 108 | ExIR-2 | 0.24 | 0.02 | 0.99 | −42 | −44 |
| 109 | ExIR-2 | 0.24 | 0.02 | 1 | −43 | −43 |

(Evaluation Results)

As can be seen from a comparison between Samples 103 and 104, the closer to 1 the sharpness ratio between the cyan-dye image and the infrared-absorbing-dye image formed in accordance with the present invention is, the more analogous in sound reproduction quality the negative cyan-dye soundtrack and infrared soundtrack formed from the same sound negative film is. Further, as can be seen from comparisons between Samples 106 to 109, the aforesaid effect arose from only the CTF ratio standing for sharpness and not from the coupler species and the layer structure. In other words, the photosensitive materials of the third embodiment of the present invention permit formation of soundtracks usable in cyan-dye-sound-track-capable readers, as well as traditional sound readers, from one kind of sound negative film.

Example 3-2

Production of Sample 201

Sample 201 was produced in the same manner as Sample 102 used in Example 3-1, except that the sixth layer alone was changed as described below.

<Preparation of Coating Solution for Sixth Layer (UV-Sensitive Layer)>

In 48 g of a solvent (Solv-21) and 100 ml of ethyl acetate, 12 g of a bleach-inhibitor releasing coupler (E×B) was dissolved. The resulting solution was emulsified and dispersed into 1,000 g of a 10% aqueous gelatin solution containing 40 ml of 10% sodium dodecylbenzenesulfonate, thereby preparing an Emulsified dispersion B12.

Separately, a silver chlorobromide emulsion U1 (grain shape: cube, grain size: 0.174 μm, grain size distribution: 0.12, halide composition: Br/Cl=25/75) was prepared by admixing an aqueous silver nitrate solution with an aqueous solution of sodium chloride-potassium bromide mixture in accordance with the controlled-double-jet method well known in the art. The emulsion was adjusted so as to have an iridium content of $2\times10^{-7}$ mole per silver. Further, this emulsion was chemically ripened to the optimum by addition of a sulfur sensitizer and a gold sensitizer.

Emulsified dispersion B12 and the thus-treated silver chlorobromide emulsion U1 were mixed and dissolved, thereto a required amount of gelatin was added, and therefrom a coating solution for the sixth layer was prepared so as to have the composition described below.

(ExB)

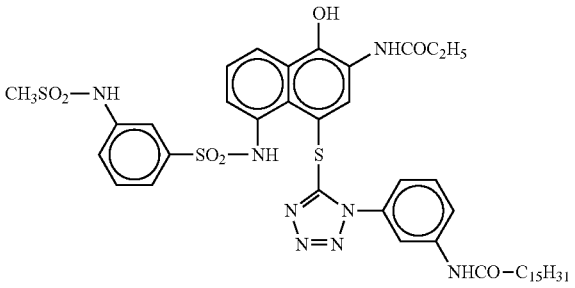

The coating solutions used for forming first to fifth layers and seventh to ninth layers were the same as those used in the production of Sample 102, respectively. The gelatin hardener used in each layer was sodium salt of 1-oxy-3,5-dichloro-s-triazine as in the case of Sample 102. The coating amount ($g/m^2$) of each ingredient in the sixth layer is described below. Additionally, the coating amount of each emulsion is expressed in terms of silver.

| Sixth layer (UV-sensitive silver halide emulsion layer) | |
|---|---|
| Silver chlorobromide emulsion U1 | 0.98 |
| Gelatin | 2.35 |
| Bleach-inhibitor-releasing coupler (ExB) | 0.14 |
| Solvent (Solv-21) | 0.56 |

(Production of Samples 202 to 205)

Samples 202 to 205 were produced in the same manner as Sample 201, except that Cpd-65 was further added to the sixth layer in the amounts shown in Table 8, respectively.

(Production of Sample 206)

Sample 206 was produced in the same manner as Sample 203, except that the sixth layer and the eighth layer were made to change their places.

(Evaluations on Samples)

Sound-quality evaluations by sharpness and cross-modulation tests as conducted in Example 3-1 were made on Samples 201 to 206 produced in the foregoing manners. The development processing of each sample was carried out using the processing solutions in running equilibrium conditions as prepared in Example 3-1. Incidentally, the processing of every sample under silver-image sound track formation was performed in accordance with Processing B as in Example 3-1. The results obtained are shown in Table 8.

TABLE 8

Description of samples and evaluation results

| | Bleach-inhibitor-releasing coupler | | Cpd-65 | | Signal intensity ratio (dB) | |
|---|---|---|---|---|---|---|
| Sample No | Kind | Amount ($g/m^2$) | Amount ($g/m^2$) | CTF ratio | Cyan-dye soundtrack | Silver-image soundtrack |
| 201 | ExB | 0.14 | — | 0.79 | −42 | −19 |
| 202 | ExB | 0.14 | 0.01 | 0.96 | −42 | −36 |
| 203 | ExB | 0.14 | 0.02 | 0.98 | −42 | −41 |
| 204 | ExB | 0.14 | 0.04 | 0.97 | −42 | −37 |

TABLE 8-continued

Description of samples and evaluation results

| | Bleach-inhibitor-releasing coupler | | Cpd-65 | | Signal intensity ratio (dB) | |
|---|---|---|---|---|---|---|
| Sample No | Kind | Amount ($g/m^2$) | Amount ($g/m^2$) | CTF ratio | Cyan-dye soundtrack | Silver-image soundtrack |
| 205 | ExB | 0.14 | 0.06 | 0.91 | −42 | −28 |
| 206 | ExB | 0.14 | 0.02 | 0.98 | −41 | −40 |

(Evaluation Results)

As can be seen from comparisons between Samples 202, 203, 204, and 206, the closer to 1 the sharpness ratio between the cyan-dye image and the silver image formed in accordance with the present invention is, the more analogous in sound reproduction quality the negative cyan-dye sound track and silver-image sound track formed from the same sound negative film is. Further, as can be seen in Sample 206, the aforesaid effect arose from only the CTF ratio standing for sharpness and not from the layer structure.

Collating these results with those in Example 3-1, it can be said that, although the infrared-absorbing-dye image and the silver image were used as traditional-type sound tracks, the photosensitive materials of the present invention permit formation of sound tracks usable in cyan-dye-sound-track-capable readers as well as traditional sound readers from one kind of sound negative film.

Example 3-3

Samples 303 and 304 were produced in the same manners as Sample 104 produced in Example 3-1 (which is referred to as Sample 301 in this example) and Sample 203 produced in Example 3-2 (which is referred to as Sample 302 in this example), respectively, except that Cpd-62 added in the third layer and the fifth layer was replaced with Cpd-66. The coating amounts of ingredients contained in the third and fifth layers of each of Sample 303 and Sample 304 are shown below.

Third Layer (Color-Mixing-Preventing Layer)

| Third Layer (Color-mixing-preventing layer) | |
|---|---|
| Gelatin | 0.59 |
| (Cpd-49) | 0.02 |
| (Cpd-43) | 0.05 |
| (Cpd-53) | 0.005 |
| (Cpd-61) | 0.02 |
| (Cpd-66) | 0.04 |
| Solvent (Solv-21) | 0.06 |
| Solvent (Solv-23) | 0.04 |
| Solvent (Solv-24) | 0.002 |
| Fifth Layer (Color-mixing-preventing layer) | |
| Gelatin | 0.56 |
| (Cpd-49) | 0.02 |
| (Cpd-43) | 0.05 |
| (Cpd-53) | 0.005 |
| (Cpd-66) | 0.04 |
| (Cpd-64) | 0.002 |

-continued

| | |
|---|---|
| Solvent (Solv-21) | 0.06 |
| Solvent (Solv-23) | 0.04 |
| Solvent (Solv-24) | 0.002 |

(Cpd-66)

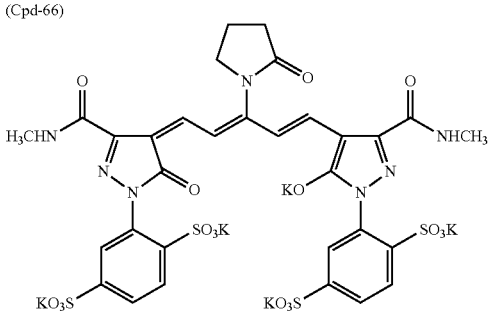

(Evaluations on Samples)

Before light exposure, the thus produced Samples 301 to 304 were subjected to aging for 2 weeks under conditions of a temperature of 35° C., a relative humidity of 60%, and a pressure of 5 atmospheres. As in the case of Example 3-1, sharpness and sound-quality evaluations were made on the samples before and after the aging test. The Fe contents and the sharpness and sound-quality evaluation results before and after the aging test are shown in Table 9. Additionally, the term "Signal Intensity Ratio Differential" in the table refers to the absolute value of a difference between the signal intensity ratio (dB) of a cyan-dye sound track and the signal intensity ratio of an infrared-absorbing-dye-image or silver-image sound track in the cross-modulation test. Accordingly, the sound qualities are more analogous the closer the signal intensity ratio differential is to 0. In other words, the probability of forming two types of sound tracks of the same quality from the same sound negative becomes higher the closer the signal intensity ratio differential is to 0.

TABLE 9

Description of samples and evaluation results

| | | CTF ratio | | Signal intensity ratio (dB) | |
|---|---|---|---|---|---|
| Sample number | Fe amount (mol/m$^2$) | Before aging | After ageing | Before aging | After aging |
| 301 (same as 104) | $1 \times 10^{-4}$ | 0.99 | 0.96 | 2 | 8 |
| 302 (same as 203) | $1 \times 10^{-4}$ | 0.98 | 0.95 | 1 | 10 |
| 303 | $8 \times 10^{-6}$ | 0.99 | 0.98 | 1 | 3 |
| 304 | $8 \times 10^{-6}$ | 0.99 | 0.97 | 1 | 5 |

(Evaluation Results)

As can be seen from the comparisons between Samples 301 to 304, the photosensitive materials lower in Fe content were more advantageous from the viewpoint of storability of unexposed films.

INDUSTRIAL APPLICABILITY

The silver halide color cinematographic photosensitive material according to the first and second embodiments of the present invention can be suitably used as a photosensitive material that can be processed without application development for analog sound track information, thereby enhancing the processing capacity of the cinematographic photosensitive materials per hour; and that is improved in development speed of yellow-color-forming layer at the image-forming region, which constitutes a rate-determining factor in the achievement of improved processing speed.

Further, the silver halide color cinematographic photosensitive material according to the third embodiment of the present invention requires no sound development process expressly meant for soundtrack formation, and is suited as a photosensitive material that can form, from the same sound negative film, soundtracks ensuring sound of substantially the same quality in reproduction with either of two types of projectors, namely a cyan-dye-track-ready projector and a traditional-type projector.

Having described our invention as related to the present embodiments, it is our intention that the invention not be limited by any of the details of the description, unless otherwise specified, but rather be construed broadly within its spirit and scope as set out in the accompanying claims.

This non-provisional application claims priority under 35 U.S.C. §119 (a) on Patent Application No. 2004-284124 filed in Japan on Sep. 29, 2004, Patent Application No. 2004-284136 filed in Japan on Sep. 29, 2004, and Patent Application No. 2004-285290 filed in Japan on Sep. 29, 2004, each of which is entirely herein incorporated by reference.

The invention claimed is:

1. A silver halide color photosensitive material, which is for use as a silver halide color printing photosensitive material, comprising, on a transparent support, at least one yellow-color-forming photosensitive silver halide emulsion layer, at least one cyan-color-forming photosensitive silver halide emulsion layer, at least one magenta-color-forming photosensitive silver halide emulsion layer, in order of mention from the support, and at least one non-photosensitive hydrophilic colloid layer, wherein the silver halide color photosensitive material contains a compound capable of forming a dye having absorption in the infrared region, upon reaction with an oxidized product of a developing agent, in one of the yellow-, cyan-, and magenta-color-forming photosensitive silver halide emulsion layers, or in a photosensitive silver halide emulsion layer having a color-sensitive region different from those of the yellow-, cyan-, and magenta-color-forming photosensitive silver halide emulsion layers, wherein silver halide grains in the silver halide emulsion layer containing the compound capable of forming a dye having absorption in the infrared region, upon reaction with an oxidized product of a developing agent, have a cubic form, and wherein CTF of an infrared-absorbing-dye image formed, which is denoted by CI, and CTF of a cyan dye image formed from the cyan-color-forming photosensitive silver halide emulsion layer, which is denoted by CC, satisfy a relationship expressed by the following formula (1) in a spatial frequency range of 2 c/mm to 20 c/mm:

$$0.95 < CI/CC < 1.05. \quad \text{formula (1)}$$

2. The silver halide color photosensitive material as claimed in claim 1, wherein the CTF of the infrared-absorbing-dye image formed, which is denoted by CI, and the CTF of the cyan dye image formed from the cyan-color-forming photosensitive silver halide emulsion layer, which is denoted by CC, satisfy a relationship expressed by the following formula (2) in a spatial frequency range of 2 c/mm to 20 c/mm:

$$0.98 < CI/CC < 1.02 \quad \text{formula (2)}$$

3. The silver halide color photosensitive material as claimed in claim 1, which is a silver halide color photosensitive material for film screening.

4. The silver halide color photosensitive material as claimed in claim 1, which has an Fe content of $2\times10^{-5}$ mole/$m^2$ or below.

5. The silver halide color photosensitive material as claimed in claim 1, which has an Fe content of $8\times10^{-6}$ mole/$m^2$ or below.

6. A method of processing a silver halide color photosensitive material for use in film screening, wherein a silver halide color photosensitive material as claimed in claim 3 is subjected to exposure via images for formation of a soundtrack, and then to color-development processing without undergoing redevelopment for formation of the soundtrack at the time of execution of development processing.

7. The silver halide color photosensitive material as claimed in claim 1, wherein the silver halide color photosensitive material contains the compound capable of forming a dye having absorption in the infrared region, upon reaction with an oxidized product of a developing agent in the photosensitive silver halide emulsion layer having a color sensitive region different from those of the yellow-, cyan-, and magenta-color-forming photosensitive silver halide emulsion layers.

8. The silver halide color photosensitive material as claimed in claim 1, wherein the cyan-color-forming photosensitive silver halide emulsion layer comprises a cyan coupler represented by formula (3) or (4):

(3)

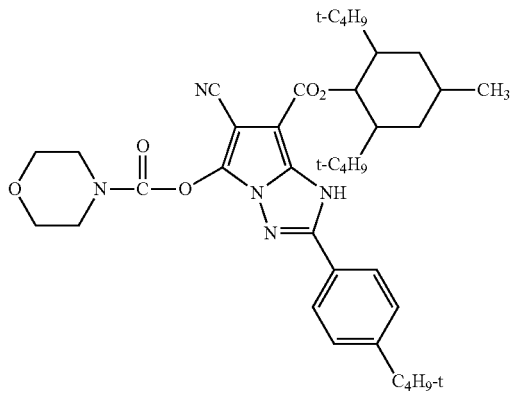

(4)

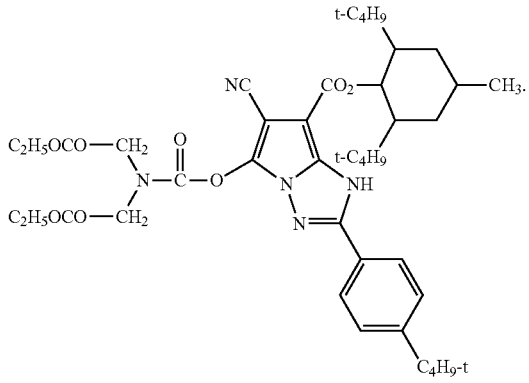

9. The silver halide color photosensitive material as claimed in claim 1, wherein the total amount of silver contained in the silver halide color photosensitive material is 0.01 to 2.0 g/$m^2$.

10. The silver halide color photosensitive material as claimed in claim 1, wherein the yellow-color-forming photosensitive silver halide emulsion layer, the cyan-color-forming photosensitive silver halide emulsion layer, and the magenta-color-forming photosensitive silver halide emulsion layer each comprises two or more types of emulsions differing in at least one feature among the grain size, the distribution of grain size, the halogen composition, the shape of grain, and the sensitivity of photosensitive silver halide emulsion.

11. A silver halide color photosensitive material, which is for use as a silver halide color printing photosensitive material, comprising, on a transparent support, at least one yellow-color-forming photosensitive silver halide emulsion layer, at least one cyan-color-forming photosensitive silver halide emulsion layer, at least one magenta-color-forming photosensitive silver halide emulsion layer, and at least one non-photosensitive hydrophilic colloid layer, wherein the silver halide color photosensitive material contains a compound capable of forming a dye having absorption in the infrared region, upon reaction with an oxidized product of a developing agent, in a photosensitive silver halide emulsion layer having a color-sensitive region different from those of the yellow-, cyan-, and magenta-color-forming photosensitive silver halide emulsion layers, and wherein CTF of an infrared-absorbing-dye image formed, which is denoted by CI, and CTF of a cyan dye image formed from the cyan-color-forming photosensitive silver halide emulsion layer, which is denoted by CC, satisfy a relationship expressed by the following formula (1) in a spatial frequency range of 2 c/mm to 20 c/mm:

$$0.95<CI/CC<1.05. \qquad \text{formula (1)}$$

12. A silver halide color photosensitive material, which is for use as a silver halide color printing photosensitive material, comprising, on a transparent support, at least one yellow-color-forming photosensitive silver halide emulsion layer, at least one cyan-color-forming photosensitive silver halide emulsion layer, at least one magenta-color-forming photosensitive silver halide emulsion layer, and at least one non-photosensitive hydrophilic colloid layer, wherein the silver halide color photosensitive material contains a compound capable of forming a dye having absorption in the infrared region, upon reaction with an oxidized product of a developing agent, in one of the yellow-, cyan-, and magenta-color-forming photosensitive silver halide emulsion layers, or in a photosensitive silver halide emulsion layer having a color-sensitive region different from those of the yellow-, cyan-, and magenta-color-forming photosensitive silver halide emulsion layers, and wherein CTF of an infrared-absorbing-dye image formed, which is denoted by CI, and CTF of a cyan dye image formed from the cyan-color-forming photosensitive silver halide emulsion layer, which is denoted by CC, satisfy a relationship expressed by the following formula (1) in a spatial frequency range of 2 c/mm to 20 c/mm:

$$0.95<CI/CC<1.05; \text{ and} \qquad \text{formula (1)}$$

wherein the cyan-color-forming photosensitive silver halide emulsion layer contains a cyan coupler represented by formula (3) or (4):

(3)
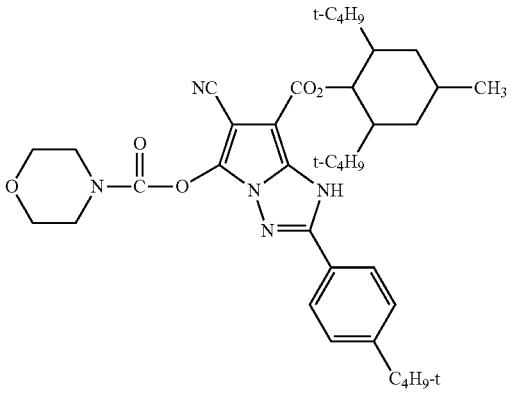
-continued
(4)
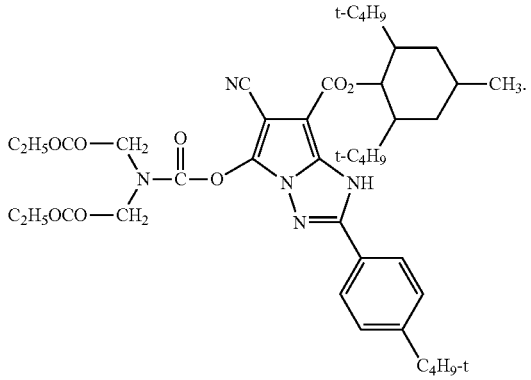
* * * * *